US010502433B2

(12) United States Patent
Park et al.

(10) Patent No.: US 10,502,433 B2
(45) Date of Patent: Dec. 10, 2019

(54) OVEN

(71) Applicant: SAMSUNG ELECTRONICS CO., LTD., Suwon-si, Gyeonggi-do (KR)

(72) Inventors: Sang Jun Park, Yongin-si (KR); Jae Jun Kim, Seoul (KR); Tai Kyung Kim, Seoul (KR); Yun Ho Yang, Yongin-si (KR); Jae Moon Lee, Seoul (KR); Bin Na Kim, Seoul (KR); Woo Joo Kim, Siheung-si (KR); Nam Soo Park, Suwon-si (KR); Hyeong Ju Seo, Seoul (KR); Jea Won Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 135 days.

(21) Appl. No.: 15/317,650

(22) PCT Filed: May 14, 2015

(86) PCT No.: PCT/KR2015/004853
§ 371 (c)(1),
(2) Date: Dec. 9, 2016

(87) PCT Pub. No.: WO2015/190713
PCT Pub. Date: Dec. 17, 2015

(65) Prior Publication Data

US 2017/0108228 A1 Apr. 20, 2017

(30) Foreign Application Priority Data

Jun. 10, 2014 (KR) ..... 10-2014-0070304
Dec. 5, 2014 (KR) ..... 10-2014-0173803

(51) Int. Cl.
*F24C 15/02* (2006.01)
*F24C 15/08* (2006.01)
(Continued)

(52) U.S. Cl.
CPC ..... *F24C 15/024* (2013.01); *E05C 1/10* (2013.01); *E05C 3/16* (2013.01); *E05C 7/005* (2013.01);
(Continued)

(58) Field of Classification Search
CPC ..... F24C 15/02; F24C 15/022; F24C 15/024; F24C 15/023; F24C 15/028; E05C 1/04; E05C 1/06; E05C 1/10; E05C 3/16
See application file for complete search history.

(56) References Cited

U.S. PATENT DOCUMENTS 2,668,222 A 2/1954 McCormick
2007/0175891 A1* 8/2007 Maeda ..... E05C 9/041 219/720
(Continued)

FOREIGN PATENT DOCUMENTS

CN 103705136 4/2014
JP 48-83961-01 1/1972
(Continued)

OTHER PUBLICATIONS

Chinese Office Action dated Jun. 5, 2018 in Chinese Patent Application No. 201580042819.7.
(Continued)

*Primary Examiner* — David J Laux
(74) *Attorney, Agent, or Firm* — Staas & Halsey LLP

(57) ABSTRACT

An oven that has an improved structure so that the convenience of use and the energy efficiency may be improved includes a casing that has a front panel, a cooking chamber that is provided inside the casing, a door that is rotatably disposed in the casing so as to open and close the cooking chamber, and has a frame, and an individual door that is rotatably provided in the frame so as to open and close an opening provided in the frame.

19 Claims, 35 Drawing Sheets

(51) Int. Cl.

| | |
|---|---|
| ***E05C 3/16*** | (2006.01) |
| ***E05C 7/00*** | (2006.01) |
| ***F24C 15/04*** | (2006.01) |
| ***E05C 1/10*** | (2006.01) |

(52) U.S. Cl.
CPC ..... *F24C 15/02* (2013.01); *F24C 15/04* (2013.01); *F24C 15/08* (2013.01)

(56) References Cited

U.S. PATENT DOCUMENTS

| | | | | |
|---|---|---|---|---|
| 2010/0282237 | A1 | 11/2010 | Atkinson et al. | |
| 2014/0097172 | A1* | 4/2014 | Kang ..... | F24C 15/02 219/394 |

FOREIGN PATENT DOCUMENTS

| | | |
|---|---|---|
| JP | 2005-249345 | 9/2005 |
| JP | 2007-255726 | 10/2007 |
| KR | 20-1996-0008213 | 9/1996 |
| KR | 20-1997-0006516 | 2/1997 |
| KR | 10-0774205 | 11/2007 |
| KR | 10-2014-0045202 | 4/2014 |

OTHER PUBLICATIONS

Canadian Office Action dated Feb. 2, 2018 in Canadian Patent Application No. 2,951,634.
Extended European Search Report dated Dec. 21, 2017 in European Patent Application No. 15805914.7.
International Search Report dated Aug. 21, 2015 in International Patent Application No. PCT/KR2015/004853.
Chinese Office Action dated Feb. 26, 2019 in Chinese Patent Application No. 201580042819.7.
Japanese Office Action dated Mar. 26, 2019 in Japanese Patent Application No. 2016-572569.
Canadian Notice of Allowance dated Apr. 24, 2019 in Canadian Patent Application No. 2,951,634.
European Communication under Rule 71(3) dated Dec. 21, 2018 in European Patent Application No. 15805914.7.
Indian Office Action dated Jun. 26, 2019 in Indian Patent Application No. 201627041986.
Chinese Office Action dated Sep. 18, 2019 in Chinese Patent Application No. 201580042819.7.

* cited by examiner

1500: 1510, 1520, 1530, 1540, 1550
1600: 1610, 1620, 1630, 1640, 1650, 1660, 1670, 1681

OVEN

CROSS-REFERENCE TO RELATED APPLICATIONS

This application is a U.S. national stage application of International Application No. PCT/KR2015/004853 filed on May 14, 2015, and claims the priority benefit of Korean Application Nos. 10-2014-0070304 and 10-2014-0173803, filed on Jun. 10, 2014, and Dec. 5, 2014, respectively, in the Korean Intellectual Property Office, the disclosures of all of which are incorporated by reference in their entirety.

BACKGROUND

1. Field

The disclosure herein relates to an oven, and more particularly, to an oven that has an improved structure so that the convenience of use and energy efficiency are improved.

2. Description of the Related Art

Ovens are devices that cook a material to be cooked by sealing and heating the material, and may be generally classified into an electric oven, a gas oven, and a microwave oven depending on its heat source. The electric oven uses an electric heater as its heat source, the gas oven uses heat caused by a gas as its heat source, and the microwave oven uses frictional heat of water molecules caused by a high frequency as its heat source.

Ovens may include a casing that forms the appearance, a door that opens and closes an opened one side of the casing, and a cooking chamber that is provided inside the casing.

A user cooks a material to be cooked contained inside the cooking chamber in such a manner that the door is rotated, the material to be cooked is put into the cooking chamber, the cooking chamber is sealed, and a heater is operated to heat the sealed cooking chamber. In this instance, an interior space of the cooking chamber is heated to an appropriate temperature depending on the type and amount of the material to be cooked.

In general, the door is mounted in the casing so that the whole cooking chamber is opened and closed. Thus, when the user checks the status of the material to be cooked during a cooking process, or even when the user cooks the material to be cooked using only a part of the cooking chamber, the whole cooking chamber should be opened, and therefore this may result in inconvenience of the user and a heat loss.

SUMMARY

The disclosure is directed to providing an oven that has an improved structure so that the whole or a part of a cooking chamber may be selectively opened and closed.

Additional aspects and/or advantages will be set forth in part in the description which follows and, in part, will be apparent from the description, or may be learned by practice of the disclosure.

One aspect of the disclosure provides an oven including: a casing that has a front panel, a cooking chamber that is provided inside the casing, a door that is rotatably disposed in the casing so as to open and close the cooking chamber, and has a frame, and an individual door that is rotatably provided in the frame so as to open and close an opening provided in the frame.

Here, the individual door may have a separate rotational axis from that of the door.

Also, the individual door may be provided on a front side of the opening, and a seating portion that protrudes forward may be provided in the door so that the individual door is seated in the seating portion.

Also, the oven may further include an operation unit that is provided in at least one of the door and the individual door so that rotation of the door and the individual door is selectively adjusted.

Also, the oven may further include a handle that is provided on a front surface of at least one of the door and the individual door. Here, the operation unit may be provided in the handle.

Also, the oven may further include a locking unit that connects the door and the individual door so that the cooking chamber is opened and closed by the individual door integrally with or separately from the door.

Also, the oven may further include a locking unit that connects the door and the individual door so that the individual door is moved integrally with or separately from the door in accordance with an operation of the operation unit. Here, the locking unit may include a fastening groove that is provided on the front panel so that whether the door is opened and closed with respect to the cooking chamber is adjusted.

Also, the locking unit may include a rear holder that is provided inside the door, a rear link that is rotatably coupled to the rear holder, and a rear rotational axis that passes through the rear holder and the rear link and connects the rear holder and the rear link, and the rear link may be moved about the rear rotational axis in a vertical direction.

Also, the rear link may include a hook that is detachably coupled to the fastening groove.

Also, the hook may be detachably coupled to the fastening groove by a restoring force of an elastic member provided between a support and the hook. Here, the support may extend from the rear holder so that the support faces the hook in a vertical direction.

Also, the locking unit may further include a front holder that is provided inside the individual door, a front link that selectively transmits movement of the operation unit to the rear link and is rotatably coupled to the front holder, and a front rotational axis that connects the front holder and the front link such that the front rotation axis passes through the front holder and the front link and is disposed to be in parallel with the rear rotational axis. Here, the front link may be moved about the front rotational axis in a vertical direction.

Also, the rear link may further include a press portion that transmits movement of the front link to the hook, and the rear holder may include a coupling groove that is provided to face the front link.

Also, the front link may include a latch portion that is detachably coupled to the coupling groove in accordance with the movement of the operation unit, and the hook may be separated from the fastening groove when the latch portion is coupled to the coupling groove while pressing the press portion positioned on an inner side of the coupling groove.

Also, the front link may further include a body having a convex portion that protrudes forward, and the operation unit may include a press member that is provided to be pressed by a user and a pressure member that is rotatably coupled to the press member so that the pressure member selectively presses the convex portion in accordance with whether the press member is pressed.

Also, when the user presses the press member, the pressuring member may be rotated about a rotational axis that connects the press member and the pressure member to press the convex portion, and when the convex portion is pressurized, the latch portion may be separated from the coupling groove.

Another aspect of the disclosure provides an oven including: a casing that has a front panel, a cooking chamber that is provided inside the casing, and a plurality of doors that are provided to open and close at least a part of the cooking chamber. Here, the plurality of doors may include a first door that is provided to open and close a part of the cooking chamber, and a second door that is rotatably provided on the front panel so as to open and close the whole of the cooking chamber together with the first door. Here, the second door may include a frame, and an opening that is provided in the frame and opened and closed by the first door.

Also, the first door may be rotatably provided in the frame.

Also, the oven may further include a handle that is provided on a front surface of at least one of the plurality of doors, and an operation unit that is provided in the handle so as to adjust opening and closing of the at least a part of the cooking chamber.

Also, the operation unit may include a press member that is provided on a rear surface of the handle so that the press member is pressed. Here, the first door may be rotated when a user pulls the handle toward a front side of the casing while the press member is pressed and the first door and the second door may be integrally rotated when the user pulls the handle toward the front side of the casing while the press member is not pressed.

Still another aspect of the disclosure provides an oven including: a casing that has an opened front surface, a cooking chamber that is provided inside the casing, and a plurality of doors that are rotatably provided on a front side of the casing so as to open and close at least a part of the cooking chamber, wherein the plurality of doors includes a first door that is provided so as to open and close a part of the cooking chamber, and a second door that opens and closes the whole of the cooking chamber together with the first door, and is provided to be rotatable about a separate rotational axis parallel to a rotational axis of the first door, and wherein the oven further includes an operation unit that is provided in at least one of the first door and the second door so that opening and closing of the first door are adjusted independently from or integrally with opening and closing of the second door.

Here, the second door may include a frame and an opening that is provided in the frame, and the first door may be provided in the frame so as to open and close the opening.

According to embodiments of the disclosure, it is possible to selectively open and close the whole or a part of a cooking chamber, thereby reducing a heat loss due to opening and closing of the cooking chamber.

In addition, it is possible to readily adjust rotation of a plurality of doors only through a simple manipulation of an operation unit, thereby improving use convenience of a user.

In addition, an individual door may be provided, so that a cooking chamber which is highly frequently used may be selectively opened and closed, thereby improving the space utilization of the cooking chamber.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
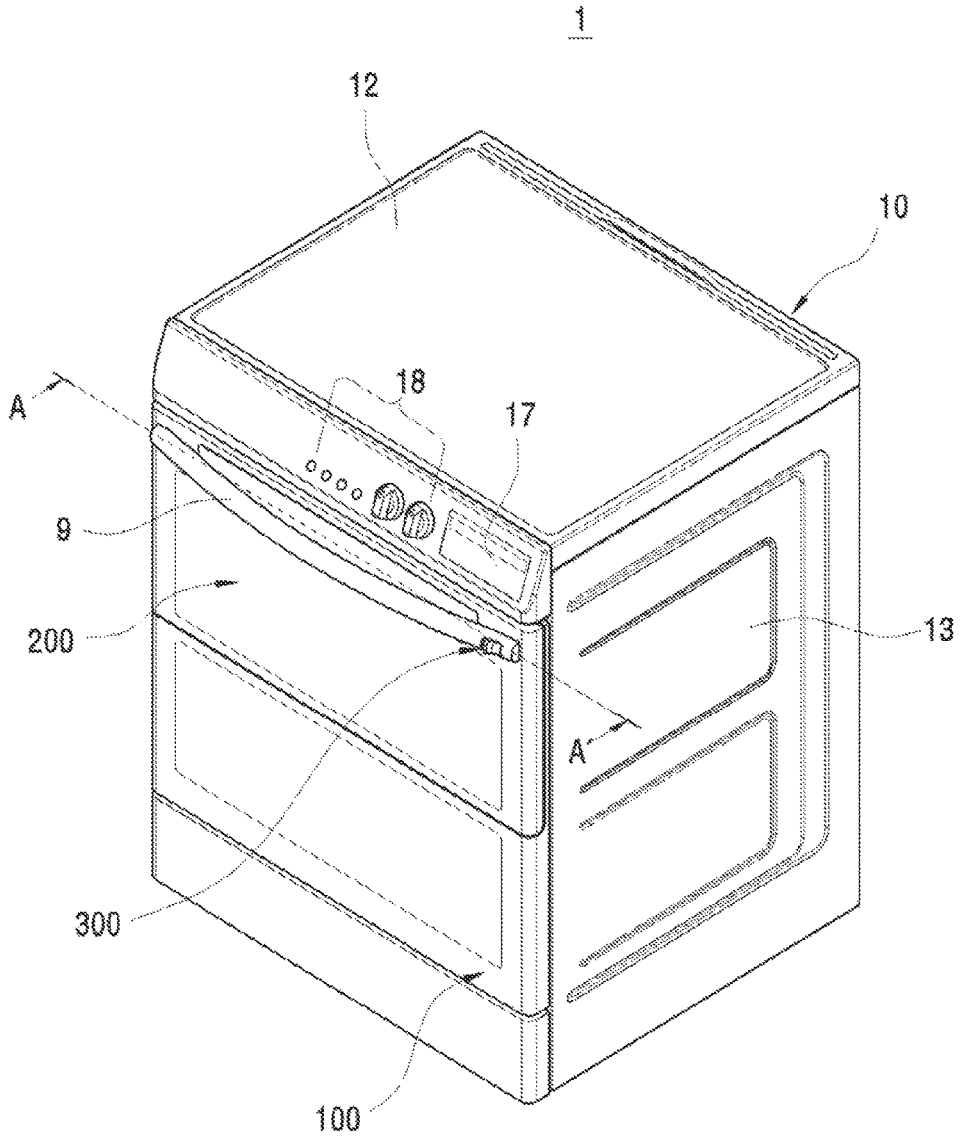
FIG. 1 illustrates an appearance of an oven in accordance with a first embodiment of the disclosure.

Reference will now be made in detail to embodiments of the disclosure, examples of which are illustrated in the accompanying drawings, wherein like reference numerals refer to like elements throughout. The embodiments are described below to explain the disclosure by referring to the figures.

Hereinafter, embodiments of the disclosure will be described in detail with reference to the accompanying drawings. Meanwhile, terms used in the following description such as "distal end", "rear end", "lower portion", "upper portion", "top", "bottom", and the like are defined based on the drawings, and shapes and positions of respective components are not limited by the terms. Hereinafter, a first door may be used to indicate an individual door 200, and a second door may be used to indicate a door 100.

Figure 2:
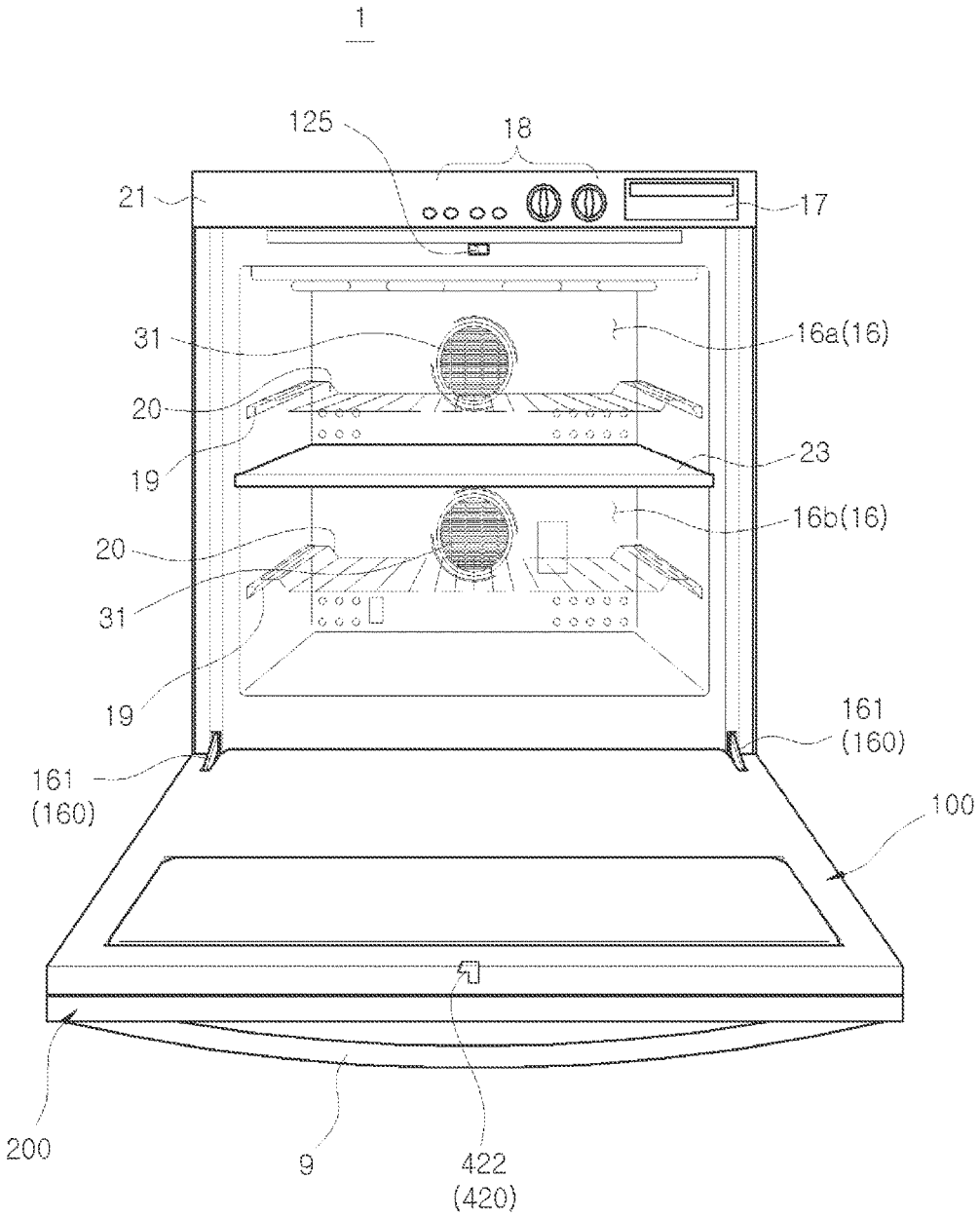
FIG. 2 illustrates a state in which a door of an oven in accordance with a first embodiment of the disclosure is opened.
Figure 3:
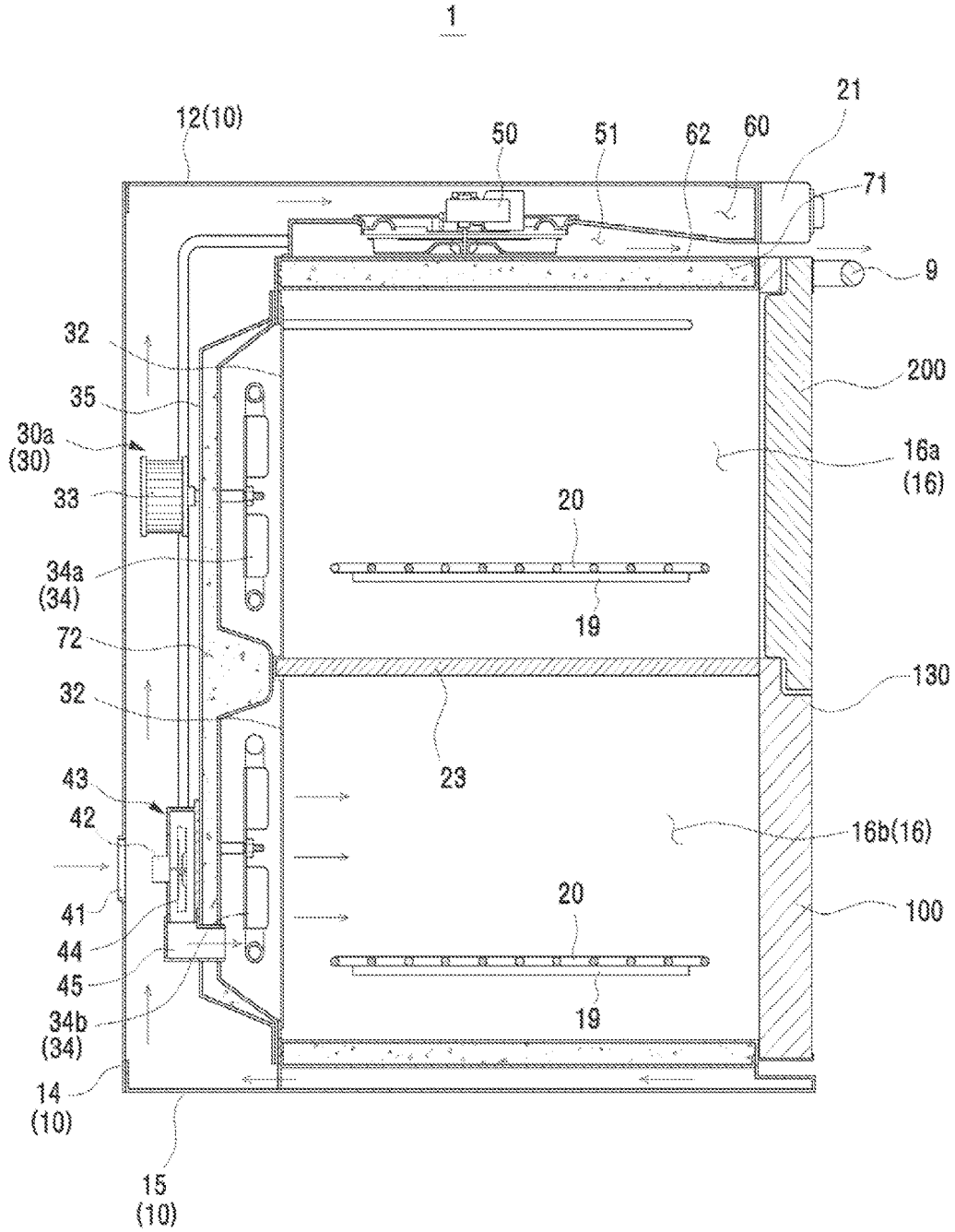
FIG. 3 is a side cross-sectional view showing an oven in accordance with a first embodiment of the disclosure.

FIG. 1 illustrates an appearance of an oven in accordance with a first embodiment of the disclosure, FIG. 2 illustrates a state in which a door of an oven in accordance with a first embodiment of the disclosure is opened, and FIG. 3 is a side cross-sectional view showing an oven in accordance with a first embodiment of the disclosure.

As shown in FIGS. 1 to 3, an oven 1 may include a casing 10 that forms an appearance thereof, and a cooking chamber 16 that is provided inside the casing 10.

The casing 10 may include a front panel 11 that forms a front appearance, a top panel 12 that forms a top appearance, a side panel 13 that forms a side appearance, a rear panel 14 that forms a rear appearance, and a bottom panel 15 that forms a bottom appearance.

The casing 10 may have an opened front surface. That is, the front panel 11 of the casing 10 may have an opening. A fixing groove 125 may be formed in the front panel 11. A latched jaw (see 125*a* of FIG. 5) may be provided inside the fixing groove 125. The latched jaw 125*a* may limit the movement of a second locking unit (see 420 of FIG. 5). Specifically, a latch portion 422 of the second locking unit 420 may be coupled to the latched jaw 125*a*, and by this coupling between the latch portion 422 and the latched jaw 125*a*, the movement of the second locking unit 420 in a direction of an inner side of the casing 10 may be limited. The latched jaw 125*a* may have a shape that protrudes in an inward direction of the fixing groove 125.

The cooking chamber 16 is formed in a box shape, and may include an opened front surface so that a material to be cooked may be put into or taken out from the cooking chamber 16. The opened front surface of the cooking chamber 16 may be opened or closed by a door 100 that is hinge-coupled to the cooking chamber 16 to be rotatable in a vertical direction. At least a part of the door 100 may be formed of a transparent material such as glass or the like so that a cooking process of the material to be cooked loaded within the cooking chamber 16 can be seen from the outside.

A plurality of supports 19 may be provided inside the cooking chamber 16. Racks 20 on which the material to be cooked can be loaded may be mounted in the plurality of supports 19. The plurality of supports 19 may be provided to protrude from left and right walls of the cooking chamber 16.

A divider 23 capable of dividing the cooking chamber 16 may be detachably mounted on the plurality of supports 19. The divider 23 may divide the cooking chamber 16 into a plurality of sections. Specifically, the divider 23 may be horizontally mounted in the cooking chamber 16, so that the cooking chamber 16 may be divided into a first cooking chamber 16*a* positioned in an upper portion of the cooking chamber 16 and a second cooking chamber 16*b* positioned in a lower portion thereof.

Sizes of the first and second cooking chambers 16*a* and 16*b* are not required to be the same as each other, and may be different from each other. The divider 23 may have a heat insulating material, and insulate between the first cooking chamber 16*a* and the second cooking chamber 16*b*. In addition, the cooking chamber 16 may not necessarily include the first cooking chamber 16*a* and the second cooking chamber 16*b*, and may include only one cooking chamber.

The oven 1 may further include a door 100 that is provided in the casing 10 so as to open and close the cooking chamber 16. The door 100 may be rotatably disposed in the casing 10. The door 100 may be rotatably provided in a front surface of the casing 10. That is, the door 100 may be rotatably provided in the front panel 11.

In addition, the oven 1 may further include an individual door 200 that is rotatable separately from the door 100, so that a part of the cooking chamber 16 is opened and closed. The individual door 200 may be provided in the door 100.

The door 100 may include an opening 110 corresponding to the cooking chamber 16. That is, the door 100 may include the opening 110 facing the front panel 11. The individual door 200 may be provided on a front side of the opening 110. The individual door 200 may be rotatably provided in the door 100, so as to open and close the opening 110. The individual door 200 may be provided in the door 100 so as to open and close the opening 110 in a vertical direction, but the disclosure is not limited thereto. By way of example, the individual door 200 may be provided in the door 100 so as to open and close the opening 110 in the left and right directions.

The individual door 200 may be provided in the door 100 so as to easily open and close a part of the cooking chamber 16 which is highly frequently used. The individual door 200 may be provided in an upper end portion of the door 100 so as to easily open and close the first cooking chamber 16*a*. In this instance, the first cooking chamber 16*a*, the opening of the front panel 11, and the opening 110 of the door 100 are communicated with each other and are shielded by the individual door 200.

In other words, the oven 1 may further include a plurality of doors 100 and 200 provided in the casing 10 so as to open and close at least a part of the cooking chamber 16. The plurality of doors 100 and 200 may be rotatably provided on a front side of the casing 10.

The plurality of doors 100 and 200 may include a first door and a second door. The first door may open and close a part of the cooking chamber 16, and the second door may open and close the whole of the cooking chamber 16 together with the first door. The first door may be rotatably disposed or mounted on a front side of the second door.

Meanwhile, on the front panel 11 of the casing 10, the door 100 and a main sealing member (not shown) for sealing the cooking chamber 16 may be provided. On a rear surface of the individual door 200, a sub-sealing member (not shown) for sealing the individual door 200 and the opening 110 may be provided.

The positions of the main sealing member (not shown) and the sub-sealing member (not shown) are not limited thereto, and any position is possible as long as it is an appropriate position for sealing.

Thus, the main sealing member (not shown) may be provided on a rear surface of the door 100 rather than the front panel 11 of the casing 10. In addition, the sub-sealing member (not shown) may be provided on a front surface of the door 100 rather than a rear surface of the individual door 200.

The plurality of doors 100 and 200 may be hinge-coupled by a door hinge 160. The door 100 may be fastened to the front panel 11 by a first door hinge 161, and the individual door 200 may be fastened to the door 100 by a second door hinge 162. Specifically, both side ends of a lower end portion of the rear surface of the door 100 may be fastened to both side ends of a lower end portion of the front surface of the front panel 11 by the first door hinge 161, and the door 100 may be rotated about the first door hinge 161 serving as the center of rotation in a vertical direction, and therefore a user may open and close the cooking chamber 16 by rotating the door 100 in the vertical direction. In addition, both side ends of a lower end portion of a rear surface of the individual door 200 may be fastened to both side ends of the front surface of the door 100 by the second door hinge 162, and the individual door 200 may be rotated about the second door hinge 162 serving as the center of rotation in the vertical direction, and therefore a user may rotate the individual door 200 in the vertical direction to open and close a part of the cooking chamber 16.

Each of the door 100 and the individual door 200 may have a separate rotational axis. That is, the door 100 is rotated with respect to the first door hinge 161 serving as the rotational axis, and the individual door 200 is rotated about the second door hinge 162 serving as the rotational axis. The rotational axis of the door 100 and the rotational axis of the individual door 200 may be parallel to each other.

The oven 1 may further include an operation unit 300 that is provided in at least one of the door 100 and the individual door 200 so that the rotation of the door 100 and the individual door 200 may be selectively adjusted.

The operation unit 300 may be provided on a front surface of at least one of the door 100 and the individual door 200.

The operation unit 300 may include a sliding type, a rotary type using a knob, and a button type operation unit capable of pressing. Hereinafter, the sliding type operation unit 300 will be mainly described.

The oven 1 may further include a handle 9 that is provided in at least one of the door 100 and the individual door 200 so as to facilitate user's grip. The handle 9 may be formed on a front surface of at least one of the door 100 and the individual door 200 in such a manner that the handle 9 protrudes forward. The shape of the handle 9 may be changed to facilitate the user's grip. By way of example, the handle 9 may have a shape that is recessed rearward.

The operation unit 300 may be provided in the handle 9. The operation unit 300 may be provided on one side of the handle 9, but the disclosure is not limited thereto. Detailed description of the operation unit 300 will be described later.

The oven 1 may further include a locking unit that detachably connects the door 100 and the individual door 200 in accordance with operation of the operation unit 300. Detailed description of the locking unit will be described later.

In an upper portion of the cooking chamber 16, a machine room 60 in which a variety of machine parts (not shown) such as a circuit board are disposed may be provided. A control panel 21 may be provided on one surface that forms an appearance of the machine room 60. In the control panel 21, a display 17 that displays a variety of information of the oven 1 and a manipulation unit 18 that manipulates the operation of the oven 1 may be provided.

A circulating fan unit 30 may be coupled to a rear surface of the first cooking chamber 16*a* and a rear surface of the second cooking chamber 16*b* so as to circulate the air inside the first cooking chamber 16*a* and the second cooking chamber 16*b*. That is, a first circulating fan unit 30*a* is coupled to the rear portion 35 of the first cooking chamber 16*a*, and a second circulating fan unit (not shown) is coupled to the rear side of the second cooking chamber 16*b*. A first circulating fan 34*a* of the first circulating fan unit 30*a* may convect the air of the first cooking chamber 16*a*, and a second circulating fan 34*b* of the second circulating fan unit (not shown) may convect the air of the second cooking chamber 16*b*.

Each circulating fan unit 30 may include a circulating motor 33 and a circulating fan 34. A circulating fan cover 32 that is formed of a plate-shaped member may be coupled to a front side of the circulating fan 34. A through-hole portion 31 may be formed in the circulating fan cover 32. Thus, a fluid having passed through the circulating fan 34 may be moved to the inside of the cooking chamber 16 through the through-hole portion 31.

Inside the machine room 60, a cooling fan unit 50 for cooling a temperature inside the machine room 60 is provided. The cooling fan unit 50 sucks the external air into the machine room 60, and discharges the sucked air to a front side of the oven 1.

In addition, the cooking chamber 16 and the cooling fan unit 50 may communicate with each other by a separate flow passage (not shown). In a process of cooking the material to be cooked, at least a part of the fluid inside the cooking chamber 16 flows into the cooling fan unit 50 through the flow passage (not shown), and then is discharged to the front side of the oven 1.

The air flowing into the cooling fan unit 50 may be discharged to the outside through a front flow passage 51 provided in a lower portion of the machine room 60 so that the front flow passage 51 may communicate with the outside.

A shield frame 62 may be provided between the first cooking chamber 16*a* and the machine room 60, thereby shielding an inner space between the first cooking chamber 16*a* and the machine room 60 from being exposed. In a space of an upper portion of the first cooking chamber 16*a* with a lower portion of the machine room 60 and a shield frame 62, a first heat insulating material 71 may be positioned. The first heat insulating material 71 prevents heat inside the first cooking chamber 16*a* from being transmitted into the machine room 60.

In addition, between a rear portion of the circulating fan unit 30 and the casing 10, a second heat insulating material 72 may be positioned. The second heat insulating material 72 may prevent heat inside the first and second cooking chambers 16*a* and 16*b* from being transmitted to the outside of the casing 10.

On the rear panel 14 positioned on a rear surface of the casing 10, an inflow hole 41 for allowing the external air to flow into at least one of the cooking chambers 16*a* and 16*b* may be provided. According to an embodiment of the disclosure, the inflow hole 41 may be provided close to the second cooking chamber 16*b* so that the external air may be allowed to flow into the second cooking chamber 16*b*.

The inflow of the air into the inflow hole 41 may be caused by operation of an inflow motor 42. The air flowing into the inflow hole 41 may flow into the second cooking chamber 16*b* through a guide bracket 45 that is coupled to the inflow motor 42.

The inflow motor 42 may be coupled to an inflow fan 44. In addition, an inflow fan housing 43 may be coupled to the inflow fan 44. In addition, one side of the inflow fan housing 43 may be provided to communicate with the guide bracket 45. The guide bracket 45 may be coupled to a communicating hole (not shown) that communicates with the second cooking chamber 16*b*. Accordingly, an external fluid that has been allowed to flow into the inflow fan 44 by operation of the inflow motor 42 may be allowed to flow into the second cooking chamber 16*b* through the guide bracket 45, thereby reducing a temperature inside the second cooking chamber 16*b*. That is, a flow passage through which a fluid is allowed to flow is formed inside the guide bracket 45.

In addition, a discharge pipe (not shown) that is a flow passage through which a fluid is allowed to flow may be separately coupled to the rear panel 14, so that a fluid having an amount corresponding to an amount of the fluid that has been allowed to flow into the cooking chamber 16 can be discharged from the cooking chamber 16.

The discharge pipe (not shown) may be coupled to a discharge hole (not shown) positioned in at least a part of the casing 10. According to an embodiment of the disclosure, the discharge hole (not shown) is positioned in at least a part of the rear panel 14, and the fluid that has been allowed to flow out from the discharge hole (not shown) is moved along the discharge pipe (not shown).

Figure 4:
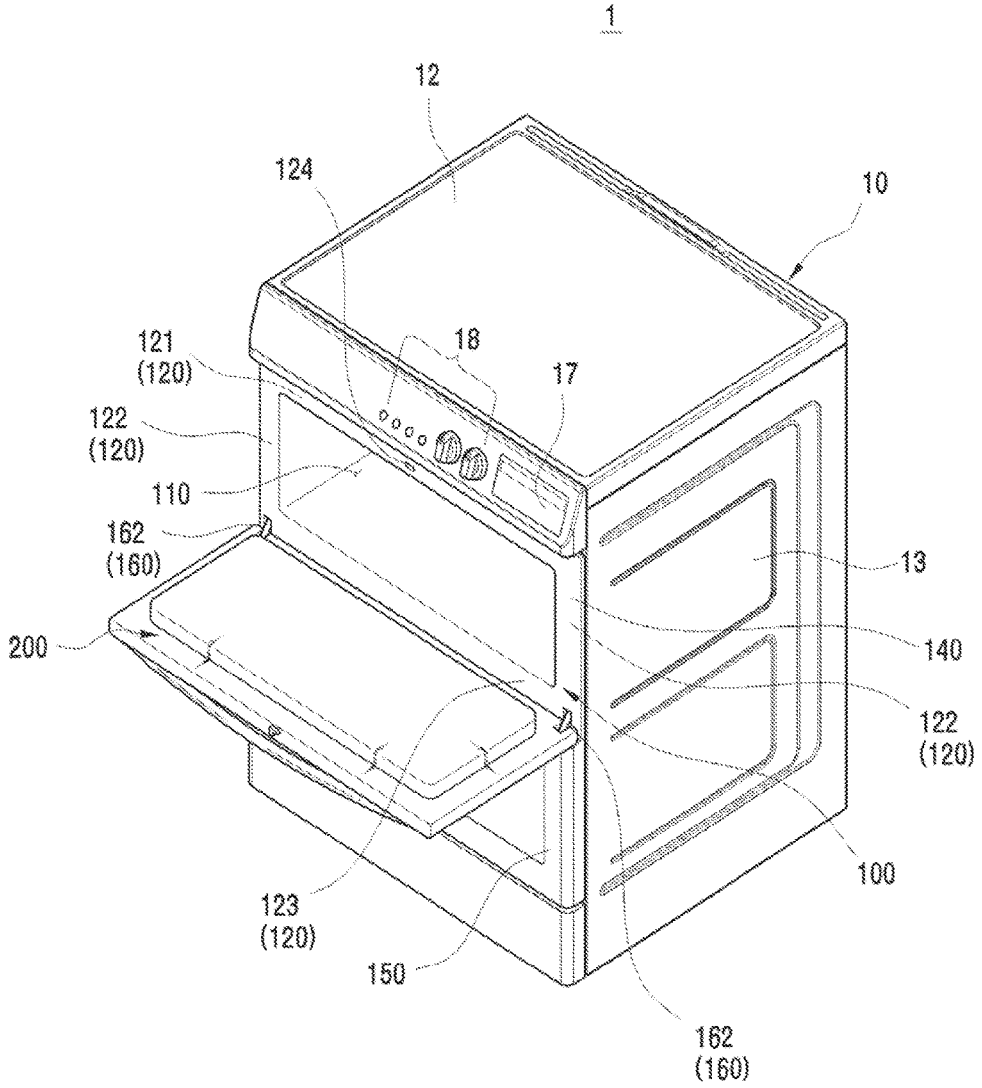
FIG. 4 illustrates a state in which a first door of an oven in accordance with a first embodiment of the disclosure is opened.

FIG. 4 illustrates a state in which a first door of an oven in accordance with a first embodiment of the disclosure is opened. Hereinafter, reference numerals which are not shown may be referred to those in FIGS. 1 to 3.

As illustrated in FIG. 4, a door 100 may face a front panel 11.

The door 100 may include an opening 110 and a frame 120. The opening 110 may be provided inside the frame 120 so as to communicate with a cooking chamber 16. In other words, the frame 120 may be disposed outside the opening 110. The opening 110 may be opened and closed by an individual door 200.

In addition, the door 100 may include a first portion 140 and a second portion 150 connected to the first portion 140.

The opening 110 may be provided in the first portion 140. Specifically, the first portion 140 may include the opening 110 and the frame 120 that surrounds a periphery of the opening 110. The frame 120 may include an upper frame 121 positioned on an upper side of the opening 110, a side frame 122 positioned on both sides of the opening 110, and a lower frame 123 positioned on a lower side of the opening 110. The lower frame 123 may be continued to the second portion 150.

The second portion 150 may be fastened to the front panel 11 by the first door hinge 161.

A fastening groove 124 may be formed in the frame 120. The fastening groove 124 may be formed on the upper frame 121 of the first portion 140, but the disclosure is not limited thereto.

The fastening groove 124 and the fixing groove 125 formed on the front panel 11 may be positioned on a straight line. Specifically, the fastening groove 124 and the fixing groove 125 may be positioned on a straight line that extends in a front and rear direction of the casing 10. Detailed descriptions of the fastening groove 124 and the fixing groove 125 will be described later.

A seating portion 130 (see, FIG. 3) that protrudes forward may be provided in the door 100 so that the individual door 200 may be seated in the seating portion 130. The seating portion 130 may be provided in the second portion 150. The seating portion 130 may be provided in at least a part of the second portion 150.

Figure 5:
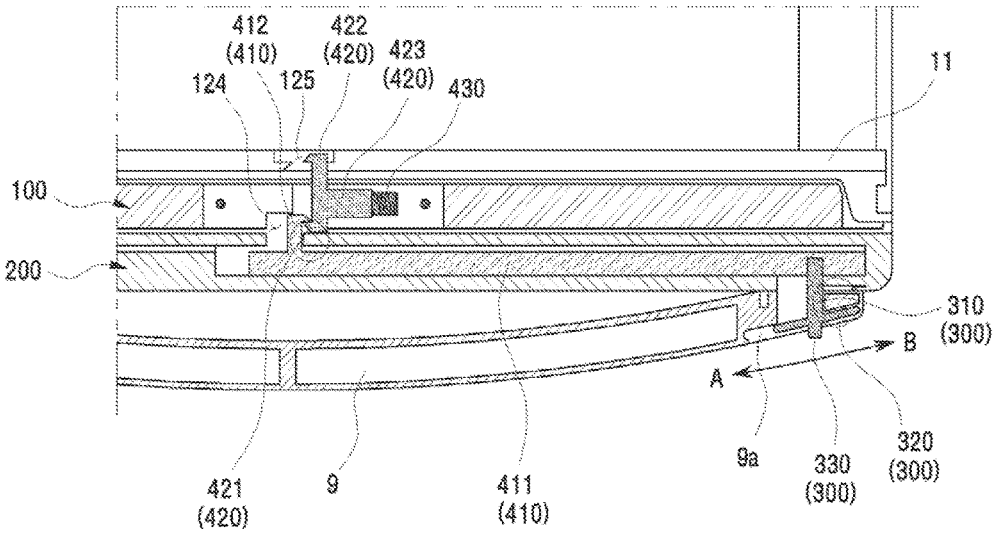
FIG. 5 is a cross-sectional view taken along a line A-A' of FIG. 1 showing a state in which locking of a second door of an oven in accordance with a first embodiment of the disclosure is released when the second door is opened.
Figure 6:
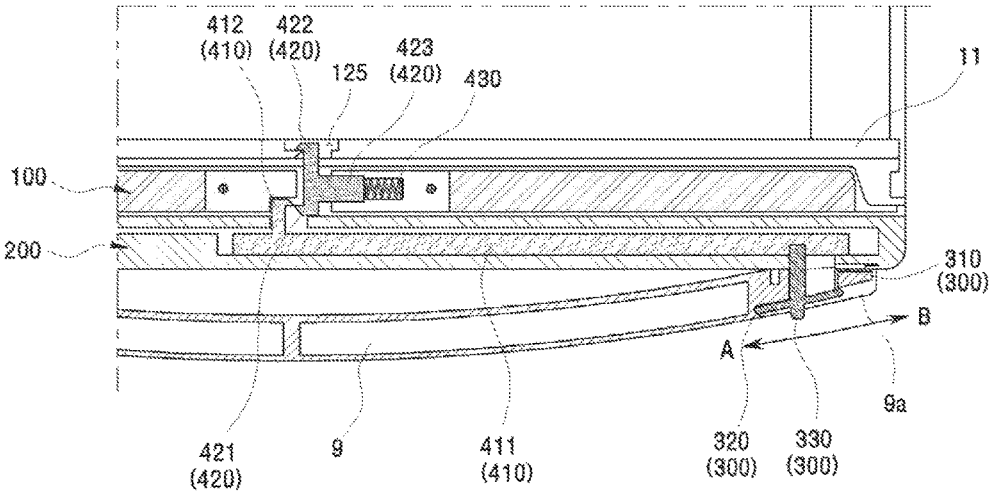
FIG. 6 is a cross-sectional view taken along a line A-A' of FIG. 1 showing a state in which locking of a first door of an oven in accordance with a first embodiment of the disclosure is released when the first door is opened.

FIG. 5 is a cross-sectional view taken along a line A-A' of FIG. 1 showing a state in which locking of a second door of an oven in accordance with a first embodiment of the disclosure is released when the second door is opened, and FIG. 6 is a cross-sectional view taken along a line A-A' of FIG. 1 showing a state in which locking of a first door of an oven in accordance with a first embodiment of the disclosure is released when the first door is opened. Reference numerals which are not shown may be referred to those in FIGS. 1 to 4.

As shown in FIGS. 5 and 6, the oven 1 may further include the operation unit 300 that adjusts opening and closing of at least a part of the cooking chamber 16.

The operation unit 300 may be provided in the handle 9. The operation unit 300 may be moved along a guide 9*a* provided inside the handle 9.

The operation unit 300 may include a body 310, a movement portion 320, and a gripper 330. Specifically, the body 310 is coupled to a first locking unit 410 so that the operation unit 300 is integrally moved with the first locking unit 410. The movement portion 320 is connected to the body 310, and is fastened to the guide 9*a* in a movable manner. The gripper 330 is connected to the movement portion 320 and the body 310, and protrudes toward the front side of the casing 10 so that a user can easily manipulate the gripper 330. The body 310, the movement portion 320, and the gripper 330 may be integrally formed.

The operation unit 300 may be moved in inward and outward directions of the casing 10. By way of example, the operation unit 300 may be moved in the left and right direction or a vertical direction of the casing 10.

The oven 1 may further include a locking unit that connects the door 100 and the individual door 200. The locking unit may detachably connect the door 100 and the individual door 200 in accordance with the movement of the operation unit 300.

The locking unit may be provided inside the door 100 and the individual door 200.

The locking unit may include a first locking unit 410 and a second locking unit 420.

The first locking unit 410 may be provided inside the individual door 200. The first locking unit 410 may be coupled to the operation unit 300 so as to be integrally moved with the operation unit 300.

The first locking unit 410 may include a support 411 and a locking portion 412.

The support 411 may be coupled to the body 310 of the operation unit 300.

The locking portion 412 may be connected to the support 411. The locking portion 412 may protrude toward a rear side of the individual door 200. The locking portion 412 may be integrally formed with the support 411.

The first locking unit 410 may be detachably inserted into the fastening groove 124 of the door 100.

The second locking unit 420 may be provided inside the door 100. The second locking unit 420 may be detachably coupled to the first locking unit 410.

The second locking unit 420 may be provided inside the door 100 so as to correspond to the first locking unit 410. Specifically, the second locking unit 420 may be provided inside the first portion 140 of the door 100. The second locking unit 420 may be provided inside the upper frame 121 of the first portion 140.

The second locking unit 420 may include a coupling portion 421, the latch portion 422, and a connection portion 423.

The coupling portion 421 may be detachably coupled to the locking portion 412. The latch portion 422 may protrude toward a rear side of the door 100, and may be detachably coupled to the fixing groove 125 formed on the front panel 11. The connection portion 423 connects the coupling portion 421 and the latch portion 422.

The coupling portion 421 and the latch portion 422 of the second locking unit 420 may have a hook shape that is bent in the same direction. The locking portion 412 of the first locking unit 410 may have a hook shape that is bent in a direction different from those of the coupling portion 421 and the latch portion 422.

The second locking unit 420 may be connected to an elastic member 430 provided inside the door 100. The elastic member 430 may serve to provide an elastic force to the second locking unit 420 in the inward and outward directions of the casing 10. The elastic member 430 may be retracted in the outward direction of the casing 10 when the operation unit 300 is moved in the outward direction of the casing 10. The elastic member 430 may include a spring. However, the elastic member 430 is not limited to the spring, it is sufficient as long as it can provide the elastic force to the second locking unit 420.

Hereinafter, opening and closing operations of the door 100 and the individual door 200 will be described.

For ease of description, an inward direction of the casing 10 is defined as a first direction A, and an outward direction of the casing 10 is defined as a second direction B.

A user may selectively adjust rotation of the door 100 and the individual door 200 using the operation unit 300. That is, when the operation unit 300 is moved in the first direction A, the individual door 200 is rotated, and when the operation unit 300 is moved in the second direction B, the door 100 is rotated.

Specifically, when the operation unit 300 is moved in the first direction A, the first locking unit 410 is moved in the first direction A together with the operation unit 300, and the locking portion 412 of the first locking unit 410 is separated from the coupling portion 421 of the second locking unit 420. Accordingly, the individual door 200 may be rotatable separately from the door 100. In this instance, the second locking unit 420 remains in a state in which the second locking unit 420 is fixed to the fixing groove 125 of the front panel 11. Specifically, the movement of the second locking unit 420 in the first direction A is limited when the latch portion 422 of the second locking unit 420 is coupled to the latched jaw 125*a*. That is, the rotation of the door 100 is limited when the latch portion 422 of the second locking unit 420 is coupled to the latched jaw 125*a*.

When the operation unit 300 is moved in the second direction B, the first locking unit 410 is moved in the second direction B together with the operation unit 300, and the locking portion 412 of the first locking unit 410 is coupled to the coupling portion 421 of the second locking unit 420. Accordingly, the individual door 200 and the door 100 may be rotated integrally with each other. In this instance, the second locking unit 420 is moved in the second direction B while it is coupled to the first locking unit 410, and the latch portion 422 of the second locking unit 420 is separated from the latched jaw 125*a*. As the latch portion 422 of the second locking unit 420 is separated from the fixing groove 125, the individual door 200 and the door 100 may be rotated integrally with each other.

Figure 7:
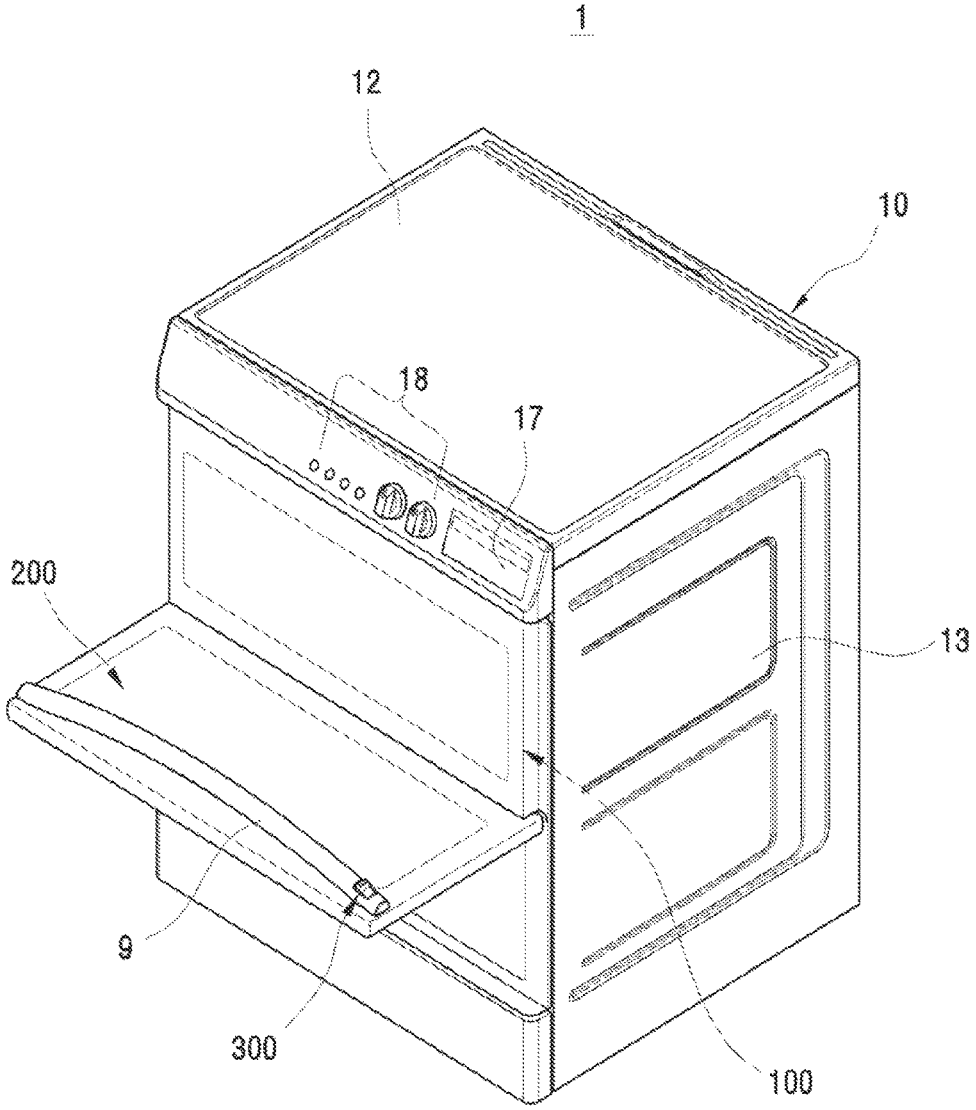
FIG. 7 illustrates a state in which a first door of an oven in accordance with a second embodiment of the disclosure is opened.

FIG. 7 illustrates a state in which a first door of an oven in accordance with a second embodiment of the disclosure is opened. Reference numerals which are not shown may be referred to those in FIGS. 1 to 6. Hereinafter, the first door may be used to indicate an individual door 200 and the second door may be used to indicate a door 100. Hereinafter, repeated description with respect to the description in reference to FIGS. 1 to 6 will be omitted.

As illustrated in FIG. 7, the individual door 200 may be provided in a lower portion of the door 100 so that the second cooking chamber 16*b* may be easily opened and closed. In this instance, the second cooking chamber 16*b*, the opening of the front panel 11, and the opening 110 of the door 100 may communicate with each other, and may be respectively shielded by the individual door 200.

The door 100 may be fastened to the front panel 11 by the first door hinge 161, and the individual door 200 may be fastened to the door 100 by the second door hinge 162. Specifically, both side ends of an upper end portion of the rear surface of the door 100 may be fastened to both side ends of an upper end portion of the front surface of the front panel 11 by the first door hinge 161, and the door 100 may be rotated about the first door hinge 161 serving as the center of rotation in a vertical direction, and therefore a user may open and close a part of the cooking chamber 16 by rotating the individual door 100 in the vertical direction.

The plurality of doors 100 and 200 may be rotated in the left and right direction of the casing 10 so as to open and close at least a part of the cooking chamber 16.

Individual doors 1200, 2200, and 3200 of ovens 1000, 2000, and 3000 according to third, fourth, and fifth embodiments of the disclosure which will be described later may be respectively provided in the lower end portion of doors 1100, 2100, and 3100 so as to easily open and close the second cooking chamber 16*b* in the same manner as in the individual door 200 of the oven according to the second embodiment of the disclosure.

A plurality of doors 1100, 2100, 3100, 1200, 2200, and 3200 of the ovens 1000, 2000, and 3000 according to third, fourth, and fifth embodiments of the disclosure which will be described later may be rotated in the left and right direction of the casing 10 so as to open and close at least a part of the cooking chamber 16.

Figure 8:
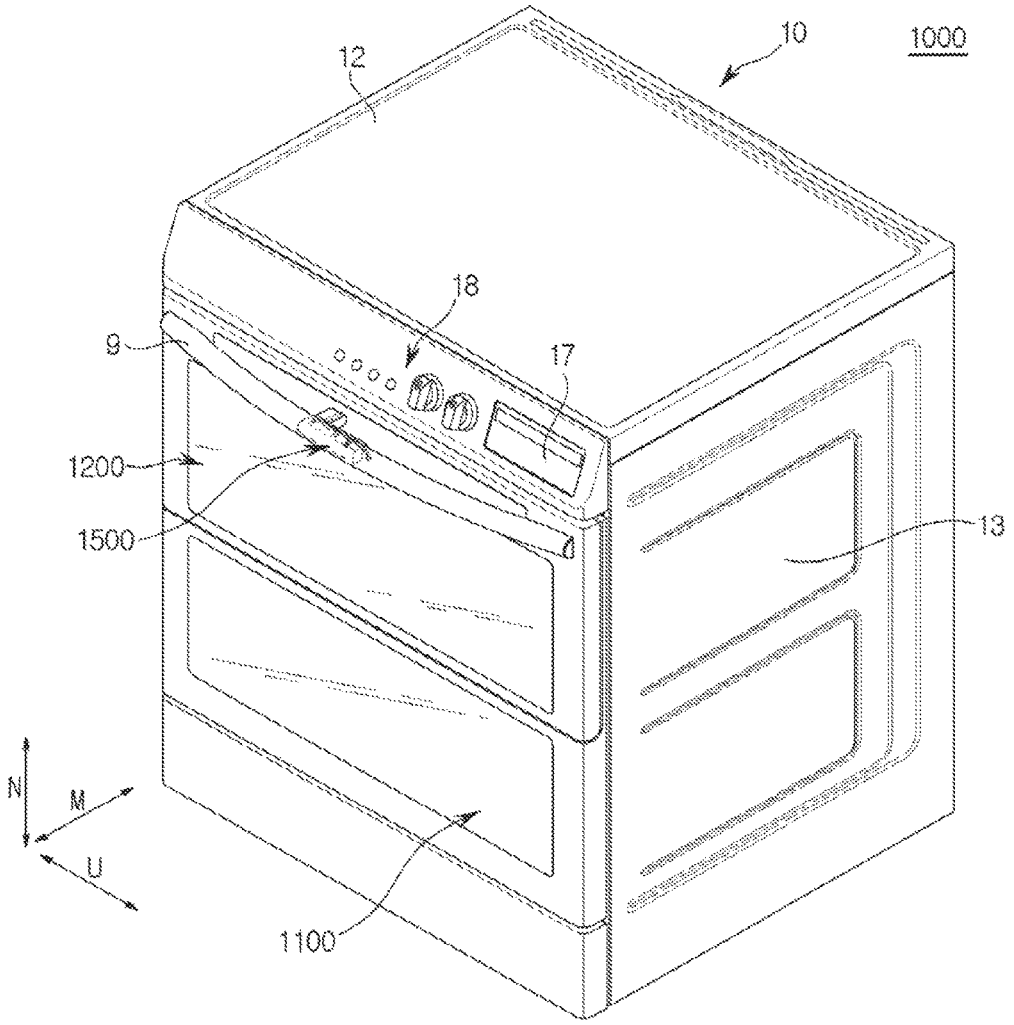
FIG. 8 illustrates an appearance of an oven in accordance with a third embodiment of the disclosure.
Figure 9:
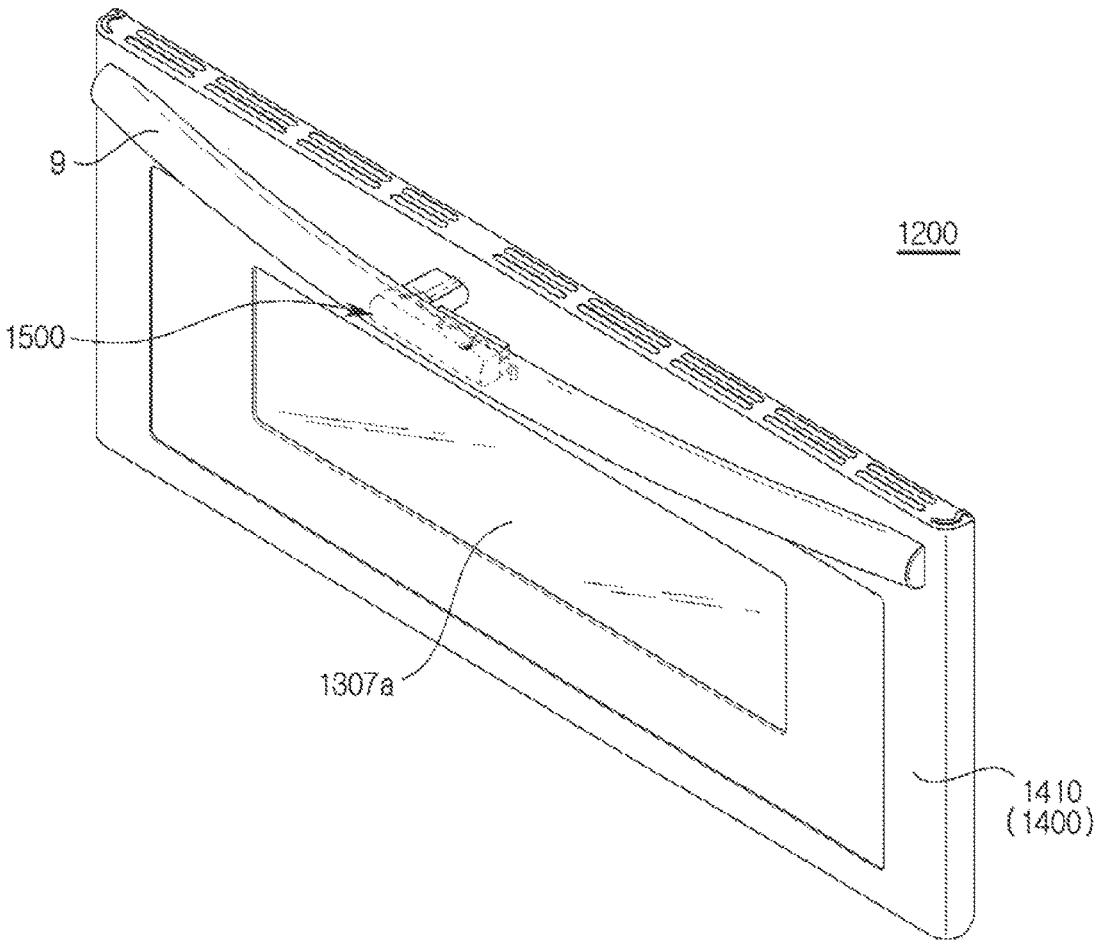
FIG. 9 illustrates a first door of an oven in accordance with a third embodiment of the disclosure.
Figure 10:
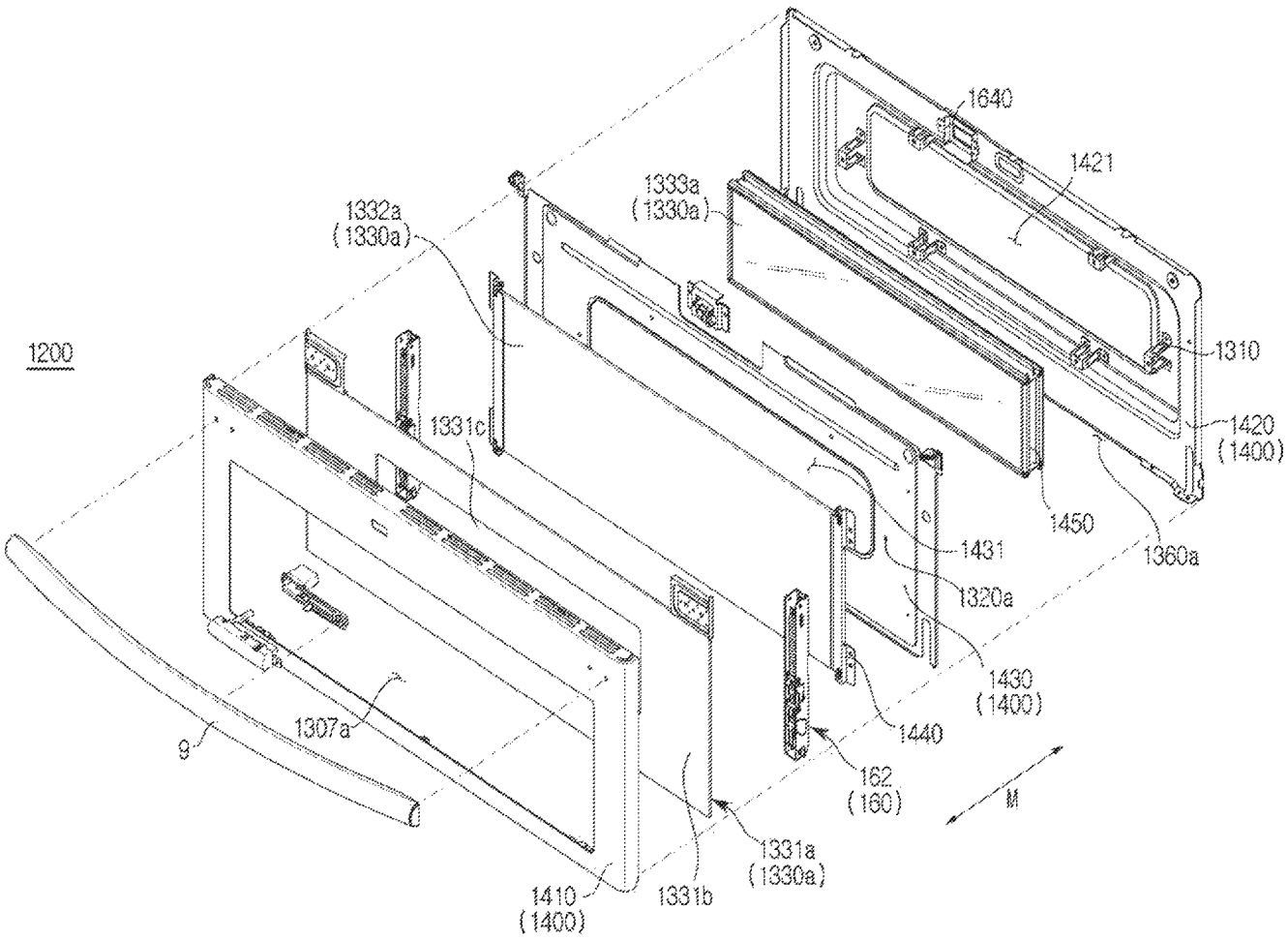
FIG. 10 is an exploded perspective view showing a first door of an oven in accordance with a third embodiment of the disclosure.
Figure 11:
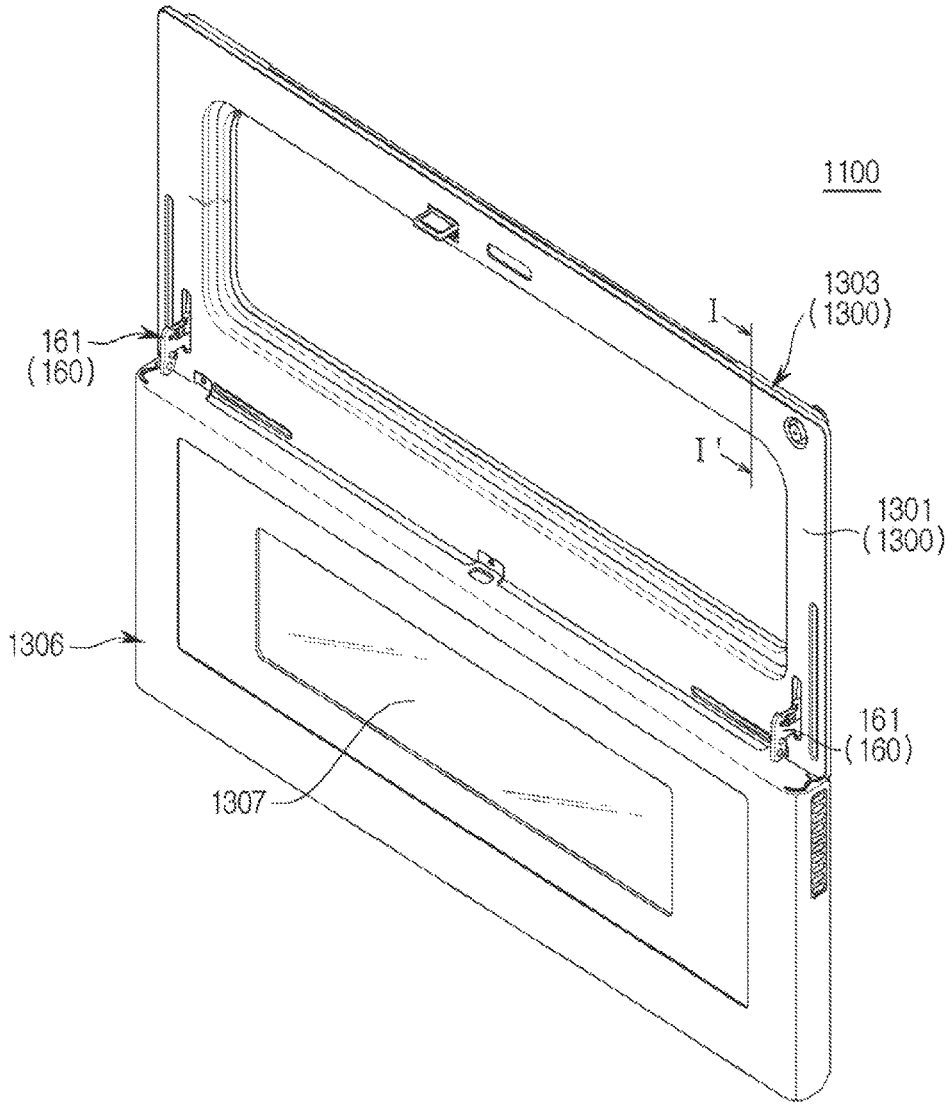
FIG. 11 illustrates a second door of an oven in accordance with a third embodiment of the disclosure.
Figure 12:
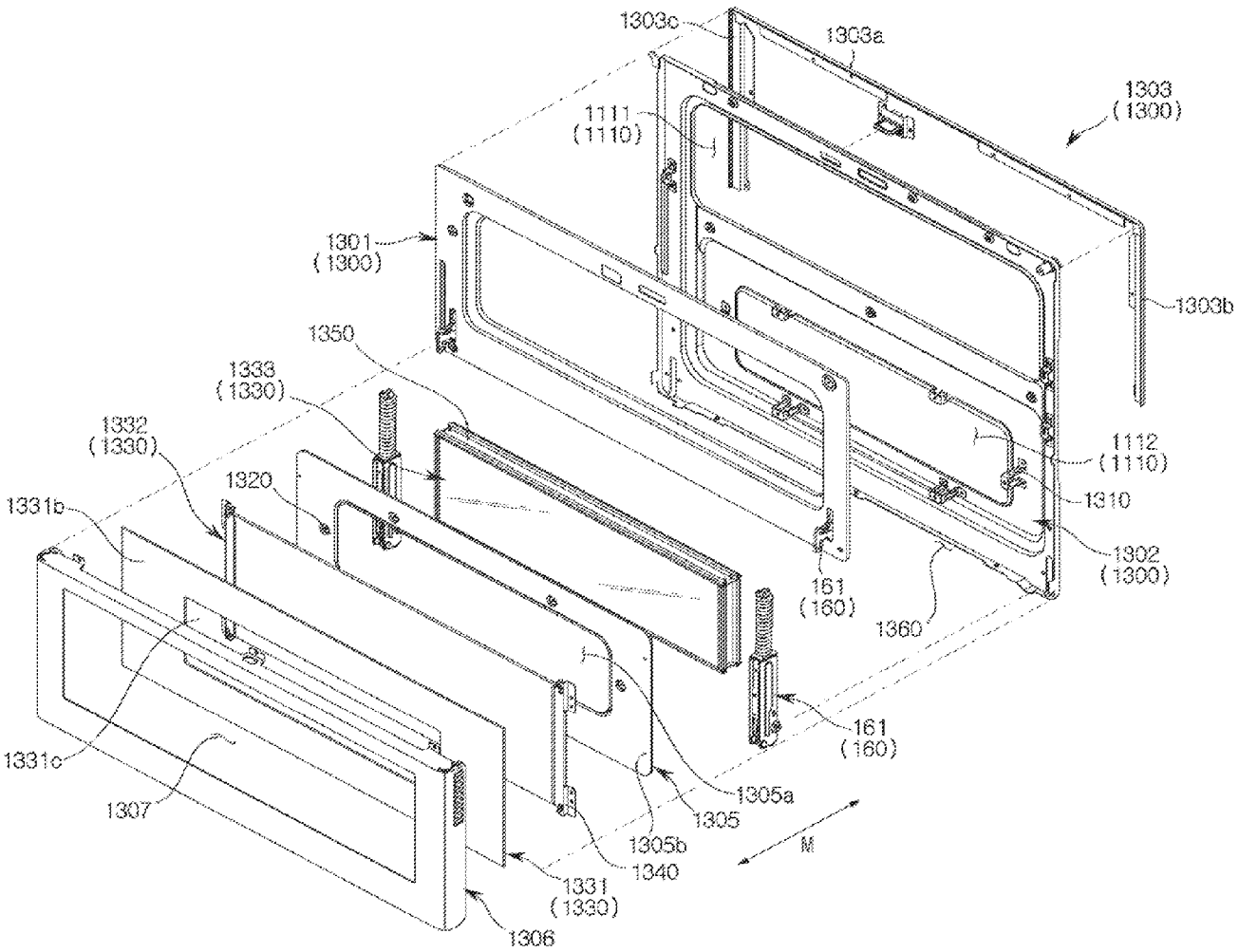
FIG. 12 is an exploded perspective view showing a second door of an oven in accordance with a third embodiment of the disclosure.
Figure 13:
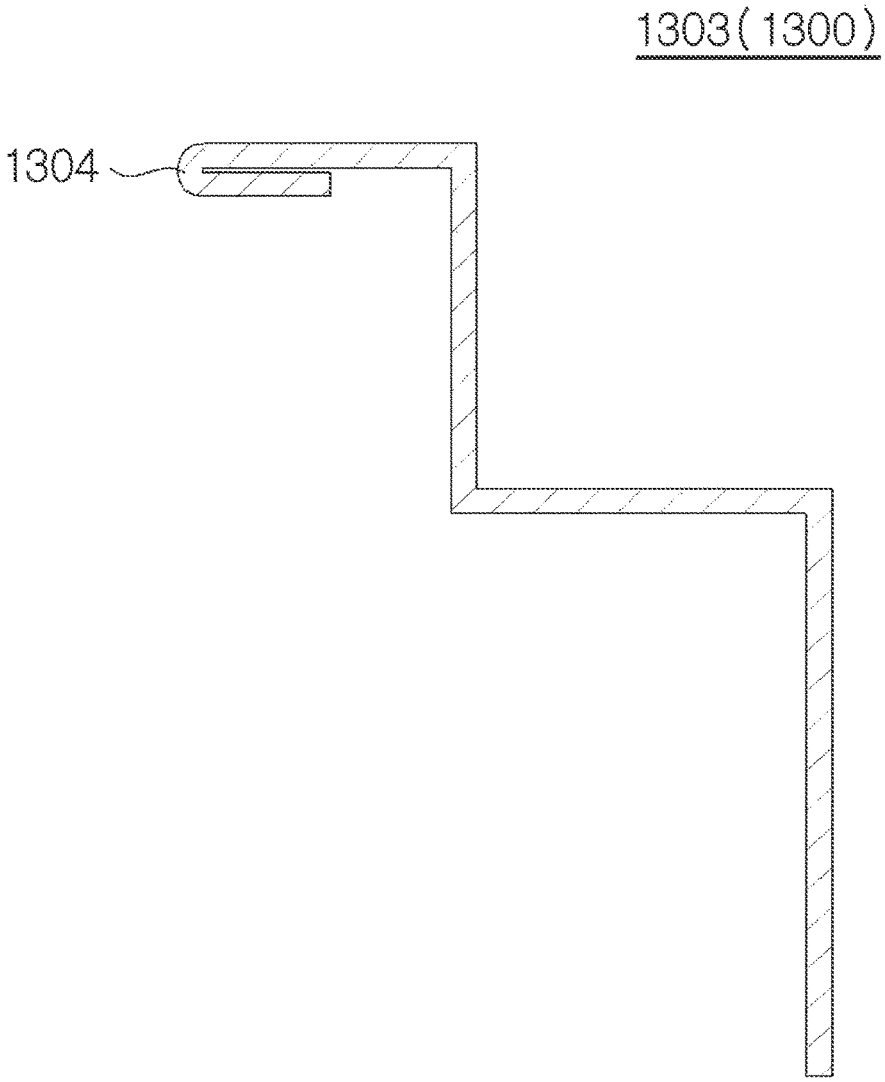
FIG. 13 is a cross-sectional view in which a third frame of FIG. 11 is cut along a line I-I'.

FIG. 8 illustrates an appearance of an oven in accordance with a third embodiment of the disclosure, FIG. 9 illustrates a first door of an oven in accordance with a third embodiment of the disclosure, FIG. 10 is an exploded perspective view showing a first door of an oven in accordance with a third embodiment of the disclosure, FIG. 11 illustrates a second door of an oven in accordance with a third embodiment of the disclosure, FIG. 12 is an exploded perspective view showing a second door of an oven in accordance with a third embodiment of the disclosure, and FIG. 13 is a cross-sectional view in which a third frame of FIG. 11 is cut along a line I-I'. Hereinafter, the first door may be used to indicate the individual door 1200, and the second door may be used to indicate the door 1100. Hereinafter, repeated description with respect to the description in reference to FIGS. 1 to 4 will be omitted. In addition, reference numerals which are not shown may be referred to those in FIGS. 1 to 4.

As illustrated in FIGS. 8 to 13, the oven 1000 may include a casing 10 that forms an appearance thereof, and a cooking chamber 16 that is provided inside the casing 10.

The casing 10 may include a front panel 11 that forms a front appearance, a top panel 12 that forms a top appearance, a side panel 13 that forms a side appearance, a rear panel (not shown) that forms a rear appearance, and a bottom panel (not shown) that forms a bottom appearance.

The casing 10 may have an opened front surface. That is, the front panel 11 of the casing 10 may have an opening. A fastening groove 1681 may be formed on the front panel 11. A hook 1651 of a rear link 1650 which will be described later may be detachably coupled to the fastening groove 1681.

The cooking chamber 16 is formed in a box shape, and may include an opened front surface so that a material to be cooked may be put into or taken out from the cooking chamber 16. The opened front surface of the cooking chamber 16 may be opened or closed by a door 100 that is hinge-coupled to the cooking chamber 16 to be rotatable in a vertical direction.

The oven 1000 may further include a plurality of doors 1100 provided in the casing so as to open and close the cooking chamber 16. The door 1100 may be rotatably disposed in the casing 10. The door 1100 may be rotatably provided on a front surface of the casing 10. That is, the door 1100 may be rotatably provided on the front panel 11.

The door 1100 may include a frame 1300.

The frame 1300 may include a first frame 1301 that is positioned on a front side in the front and rear direction M of the cooking chamber 16, and a second frame 1302 that is positioned on a rear side in the front and rear direction M of the cooking chamber 16. The first frame 1301 and the second frame 1302 may be coupled to each other.

In addition, the frame 1300 may further include a third frame 1303 that connects the first frame 1301 and the second frame 1302.

The third frame 1303 may have a rectangular shape whose one surface is opened.

The third frame 1303 may have a rectangular shape whose lower surface is opened. That is, the third frame 1303 may have a shape formed in such a manner that an upper surface 1303*a*, a right side surface 1303*b*, and a left side surface 1303*c* are coupled. However, the shape of the third frame 1303 is not limited thereto, and is variously modified.

The third frame 1303 may be provided between the first frame 1301 and the second frame 1302.

The third frame 1303 may be provided between the first frame 1301 and the second frame 1302 so that at least one surface of the third frame 1303 is exposed toward the outside. The third frame 1303 may be provided between the first frame 1301 and the second frame 1302 so that the upper surface 1303*a*, the right side surface 1303*b*, and the left side surface 1303*c* of the third frame 1303 may be exposed toward the outside.

The third frame 1303 may be provided to surround a coupled portion between the first frame 1301 and the second frame 1302. In other words, the third frame 1303 may be provided to surround edges of the first frame 1301 and the second frame 1302. Specifically, the upper surface 1303*a* of the third frame may be provided to surround an upper coupled portion between the first frame 1301 and the second frame 1302. The right side surface 1303*b* of the third frame 1303 may be provided to surround a right coupled portion between the first frame 1301 and the second frame 1302. The left side surface 1303*c* of the third frame 1303 may be provided to surround a left coupled portion between the first frame 1301 and the second frame 1302. Through the third frame 1303, it is possible to conceal the complex configuration of the coupled portions between the first frame 1301 and the second frame 1302, thereby achieving a neat appearance of the frame 1300.

The frame 1300 may have a sharpness prevention structure. Specifically, the third frame 1303 may have the sharpness prevention structure. The third frame 1303 that is provided to surround the coupled portion between the first frame 1301 and the second frame 1302 may have a sharp contact portion. The sharp contact portion of the third frame 1303 may be mainly formed at an upper edge of the third frame 1303 that faces forward in the front and rear direction M of the cooking chamber 16, but the position of the sharp contact portion of the third frame 1303 is not limited thereto. The third frame 1303 may have a bent portion 1304 so that a user may be prevented from being hurt by the sharp contact portion of the third frame 1303. The bent portion 1304 may be formed by pressure of the sharp contact portion of the third frame 1303. Specifically, the bent portion 1304 may have a bent shape so that the upper edge of the third frame 1303 facing forward in the front and rear direction M of the cooking chamber 16 is positioned between at least one of the first frame 1301 and the second frame 1302 and the third frame 1303. That is, the bent portion 1304 may be pressed and formed while being bent rearward in the front and rear direction M of the cooking chamber 16 so that the upper edge of the third frame 1303 facing forward in the front and rear direction M of the cooking chamber 16 may face an upper surface of at least one of the first frame 1301 and the second frame 1302. The bent portion 1304 of the third frame 1303 may be formed, and therefore a smooth contact portion of the third frame 1303 may be implemented.

The frame 1300 may be subjected to enamel treatment. At least one of the first frame 1301, the second frame 1302, and the third frame 1303 may be subjected to enamel treatment.

The door 1100 may further include an opening 1110 that communicates with the cooking chamber 16. The opening 1110 may be provided inside the frame 1300. The opening 1110 may be opened and closed by the individual door 1200.

In other words, the door 1100 may further include one or more openings 1110. By way of example, the door 1100 may further include a first opening 1111 and a second opening 1112. The first opening 1111 may be provided on an inner side of the frame 1300 so as to be positioned on an upper side in a vertical direction N of the cooking chamber 16. The second opening 1112 may be provided on the inner side of the frame 1300 so as to be positioned on a lower side in the vertical direction N of the cooking chamber 16. Specifically, the first opening 1111 may be provided on an inner side of the second frame 1302 so as to be positioned on the upper side in the vertical direction N of the cooking chamber 16. The second opening 1112 may be provided on the inner side of the second frame 1302 so as to be positioned on a lower side of the cooking chamber 16. The first opening 1111 may be opened and closed by the individual door 1200.

The door 1100 may further include an inner frame 1305.

The inner frame 1305 may be positioned on the front side of the frame 1300 in the front and rear direction M of the cooking chamber 16. Specifically, the inner frame 1305 may be fixedly coupled to the second frame 1302 so as to be positioned on the front side of the second opening 1112 in the front and rear direction M of the cooking chamber 16. In the second frame 1302, a plurality of connection members 1310 may be provided along a periphery of the second opening 1112. The plurality of connection members 1310 may have a shape that protrudes forward so that a heat insulating glass receiving space 1360 may be formed between the second frame 1302 and the inner frame 1305. On an inner side of the inner frame 1305, an opening 1305*a* corresponding to the second opening 1112 may be provided. In addition, a plurality of fastening holes 1320 may be provided along a periphery of the opening 1305*a* so as to correspond to the plurality of connection members 1310. The inner frame 1305 and the second frame 1302 may be coupled to each other by a fixing member (not shown) that passes through the plurality of fastening holes 1320 and the plurality of connection members 1310.

The door 1100 may further include a door panel 1306. The door panel 1306 may be positioned on the front side of the frame 1300 in the front and rear direction M of the cooking chamber 16. In other words, the door panel 1306 may be positioned on the front side of the inner frame 1305 in the front and rear direction M of the cooking chamber 16.

The door panel 1306 may be coupled to the frame 1300. Specifically, the door panel 1306 may be fixedly coupled to the second frame 1302. The inner frame 1305 and one or more heat insulating glasses 1330 may be disposed between the door panel 1306 and the second frame 1302.

In the door panel 1306, a see-through window 1307 corresponding to the opening 1305*a* of the inner frame 1305 or the second opening 1112 of the second frame 1302 may be provided. A user may visually confirm an inner state of the cooking chamber 16 through the see-through window 1307.

The door 1100 may further include one or more heat insulating glasses 1330 that shut off heat inside the cooking chamber 16. By way of example, the one or more heat insulating glasses 1330 may include a first heat insulating glass 1331, a second heat insulating glass 1332, a third heat insulating glass 1333, and a fourth heat insulating glass (not shown). The first heat insulating glass 1331, the second heat insulating glass 1332, the third heat insulating glass 1333, and the fourth heat insulating glass (not shown) may be sequentially arranged in the front and rear direction M of the cooking chamber 16. Specifically, the first heat insulating glass 1331 may be positioned on a rear side of the door panel 1306 in the front and rear direction M of the cooking chamber 16 so as to face the door panel 1306. The first heat insulating glass 1331 may include a transparent portion 1331*c* corresponding to the see-through window 1307 of the door panel 1306, and a non-transparent portion 1331*b* disposed along a periphery of the transparent portion 1331*c*. The non-transparent portion 1331*b* serves to shield a complex internal structure of the door 1100. The second heat insulating glass 1332 may be positioned on a rear side of the first heat insulating glass 1331 in the front and rear direction M of the cooking chamber 16. In other words, the second heat insulating glass 1332 may be positioned between the first heat insulating glass 1331 and the inner frame 1305. On one side of the second heat insulating glass 1332, a first glass holder 1340 may be provided. Specifically, the first glass holder 1340 may be provided at both edges of the second heat insulating glass 1332. However, the position of the first glass holder 1340 is not limited to the both edges of the second heat insulating glass 1332, and may be variously changed. The second heat insulating glass 1332 may be fixedly coupled to the inner frame 1305 by the first glass holder 1340. Specifically, the second heat insulating glass 1332 may be fixedly coupled to the inner frame 1305 by the first glass holder 1340 and a fixing member (not shown) that passes through a fixing hole 1305*b* formed on the inner frame 1305. The third heat insulating glass 1333 and the fourth heat insulating glass (not shown) may be received in a heat insulating glass receiving space 1360 formed between the inner frame 1305 and the second frame 1302. The third heat insulating glass 1333 and the fourth heat insulating glass (not shown) may be coupled to a second glass holder 1350. In other words, the second glass holder 1350 may be provided along edges of the third heat insulating glass 1333 and the fourth heat insulating glass (not shown) so as to support the third heat insulating glass 1333 and the fourth heat insulating glass (not shown). The third heat insulating glass 1333 and the fourth heat insulating glass (not shown) may be received in the heat insulating glass receiving space 1360 while they are restrained to the second glass holder 1350. A plurality of connection members 1310 provided in the second frame 1302 may be arranged along an outer periphery of the second glass holder 1350 when the third heat insulating glass 1333 and the fourth heat insulating glass (not shown) are received in the heat insulating glass receiving space 1360. The plurality of connection members 1310 may serve to support the second glass holder 1350.

The door 1100 may further include the glass holders 1340 and 1350. Specifically, the glass holders 1340 and 1350 may include the first glass holder 1340 provided in the second heat insulating glass 1332, and the second glass holder 1350 that restrains the third heat insulating glass 1333 and the fourth heat insulating glass (not shown). The number and positions of the glass holders 1340 and 1350 are not limited thereto.

The door 1100 may be hinge-coupled by the door hinge 160. The door 1100 may be coupled to the front panel 11 by the first door hinge 161. Specifically, both side ends of a lower end portion of a rear surface of the door 1100 may be fastened to both side ends of a lower end portion of a front surface of the front panel 11 by the first door hinge 161, and the door 1100 may be rotated about the first door hinge 161 serving as the center of rotation in a vertical direction N of the cooking chamber 16, and therefore a user may open and close the cooking chamber 16 by rotating the door 100 in the vertical direction N of the cooking chamber 16.

The oven 1000 may further include the individual door 1200 that is provided on the front side of the frame 1300 so as to open and close the opening 1110. Specifically, the individual door 1200 may be provided on the front side of the first frame 1301 so as to open and close the first opening 1111. The individual door 1200 may be rotatably provided in the door 1100 so as to open and close the opening 1110. Specifically, the individual door 1200 may be rotatably provided in the first frame 1301 so as to open and close the first opening 1111. The individual door 1200 may be provided in the door 1100 so as to open and close the first opening 1111 in the vertical direction N of the cooking chamber 16.

The individual door 1200 may be provided in the door 1100 so as to open and close a part of the cooking chamber 16 which is highly frequently used. The individual door 1200 may be provided in an upper end portion of the door 1100 so as to open and close the first cooking chamber 16*a*. In this instance, the first cooking chamber 16*a*, the opening of the front panel 11, and the opening 1110 of the door 1100 may communicate with each other, and may be respectively shielded by the individual door 1200. In other words, the first cooking chamber 16*a*, the opening of the front panel 11, and the first opening 1111 of the frame 1300 may communicate with each other, and may be respectively shielded by the individual door 1200.

The individual door 1200 may include a panel 1400.

The panel 1400 may include a front panel 1410 positioned on a front side in the front and rear direction M of the cooking chamber 16. The front panel 1410 may form a front surface of the individual door 1200. In the front panel 1410, the handle 9 may be provided. The front panel 1410 may be coupled to a rear panel 1420. The inner panel 1430 and the one or more heat insulating glasses 1330*a* may be disposed between the front panel 1410 and the rear panel 1420. On the front panel 1410, a see-through window 1307*a* corresponding to a second opening 1431 of the inner panel 1430 or a first opening 1421 of the rear panel 1420 may be provided. Accordingly, a user may visually confirm an inner state of the cooking chamber 16 through the see-through window. The panel 1400 may further include the rear panel 1420 positioned on a rear side in the front and rear direction M of the cooking chamber 16. The rear panel 1420 may form a rear surface of the individual door 1200. The rear panel 1420 may be positioned on a front side of the first frame 1301 of the door 1100 in the front and rear direction M of the cooking chamber 16. The rear panel 1420 may be coupled to the front panel 1410. On the rear panel 1420, the first opening 1421 corresponding to the first opening 1111 of the first frame 1301 may be formed. The panel 1400 may further include the inner panel 1430 positioned between the front panel 1410 and the rear panel 1420. The inner panel 1430 may be fixedly coupled to the rear panel 1420 so as to be positioned on a front side of the first opening 1421 in the front and rear direction M of the cooking chamber 16. In the rear panel 1420, the plurality of connection members 1310 may be provided along a periphery of the first opening 1421. The plurality of connection members 1310 may have a shape that protrudes forward so as to form a heat insulating glass receiving space 1360*a* between the rear panel 1420 and the inner panel 1430. On an inner side of the inner panel 1430, a second opening 1431 corresponding to the first opening 1421 may be provided. In addition, in the inner panel 1430, a plurality of fastening holes 1320 may be provided along a periphery of the second opening 1431 so as to correspond to the plurality of connection members 1310. The inner panel 1430 and the rear panel 1420 may be coupled to each other by a fixing member (not shown) that passes through the plurality of fastening holes 1320*a* and the plurality of connection members 1310.

The individual door 1200 may further include one or more heat insulating glasses 1330*a* so as to improve heat insulating performance. By way of example, the one or more heat insulating glasses 1330*a* may include a first heat insulating glass 1331*a*, a second heat insulating glass 1332*a*, a third heat insulating glass 1333*a*, and a fourth heat insulating glass (not shown). The first heat insulating glass 1331*a*, the second heat insulating glass 1332*a*, the third heat insulating glass 1333*a*, and the fourth heat insulating glass (not shown) may be sequentially arranged in the front and rear direction M of the cooking chamber 16. Specifically, the first heat insulating glass 1331*a* may be positioned on the rear side of the front panel 1410 in the front and rear direction M of the cooking chamber 16 so as to face the front panel 1410. The first heat insulating glass 1331*a* may include a transparent portion 1331*c* corresponding to the see-through window 1307*a* of the front panel 1410, and a non-transparent portion 1331*b* disposed along an outer periphery of the transparent portion 1331*c*. The non-transparent portion 1331*b* serves to shield a complex inner structure of the individual door 1200. The second heat insulating glass 1332*a* may be positioned on a rear side of the first heat insulating glass 1331*a* in the front and rear direction M of the cooking chamber 16. In other words, the second heat insulating glass 1332*a* may be positioned between the first heat insulating glass 1331*a* and the inner panel 1430. On one side of the second heat insulating glass 1332*a*, a first holder 1440 may be provided. Specifically, the first holder 1440 may be provided at both edges of the second heat insulating glass 1332*a*. However, the position of the first holder 1440 is not limited to the both edges of the second heat insulating glass 1332*a*, and may be variously changeable. The second heat insulating glass 1332*a* may be fixedly coupled to the inner panel 1430 by the first holder 1440. Specifically, the second heat insulating glass 1332*a* may be fixedly coupled to the inner panel 1430 by a fixing member (not shown) that passes through the first holder 1440 and a fixing hole 1430*a* formed in the inner panel 1430. The third heat insulating glass 1333*a* and the fourth heat insulating glass (not shown) may be received in the heat insulating glass receiving space 1360*a* formed between the inner panel 1430 and the rear panel 1420. The third heat insulating glass 1333*a* and the fourth heat insulating glass (not shown) may be coupled to the second holder 1450. In other words, the second holder 1450 may be provided along edges of the third heat insulating glass 1333*a* and the fourth heat insulating glass (not shown) so as to support the third heat insulating glass 1333*a* and the fourth heat insulating glass (not shown). The third heat insulating glass 1333*a* and the fourth heat insulating glass (not shown) may be received in the heat insulating glass receiving space 1360*a* while they are restrained to the second holder 1450. The plurality of connection members 1310 provided in the rear panel 1420 may be arranged along the outer periphery of the second holder 1450 when the third heat insulating glass 1333*a* and the fourth heat insulating glass (not shown) are received in the heat insulating glass receiving space 1360*a*. The plurality of connection members 1310 may serve to support the second holder 1450.

The individual door 1200 may further include the glass holders 1440 and 1450. Specifically, the glass holders 1440 and 1450 may include the first holder 1440 that is provided in the second heat insulating glass 1332*a*, and the second holder 1450 that restrains the third heat insulating glass

1333*a* and the fourth heat insulating glass (not shown). The number and positions of the glass holders 1440 and 1450 are not limited thereto.

The individual door 1200 may be hinge-coupled to the door hinge 160. The individual door 1200 may be fastened to the door 1100 by the second door hinge 162. Specifically, the individual door 1200 may be rotatably provided in the first frame 1301 by the second door hinge 162. Both side ends of the lower end portion of the rear surface of the individual door 1200 may be fastened to both side ends of the front surface of the door 1100 by the second door hinge 162, and the individual door 1200 may be rotated about the second door hinge 162 serving as the center of rotation in the vertical direction N of the cooking chamber 16, and therefore a user may open and close a part of the cooking chamber 16 by rotating the individual door 1200 in the vertical direction N of the cooking chamber 16.

Each of the door 1100 and the individual door 1200 may have a separate rotational axis. That is, the door 1100 is rotated about the first door hinge 161 serving as the center of rotation, and the individual door 1200 is rotated about the second door hinge 162 serving as the center of rotation. The rotational axis of the door 1100 and the rotational axis of the individual door 1200 may be parallel to each other.

In other words, the oven 1000 may further include the plurality of doors 1100 and 1200 provided in the casing 10 so as to open and close at least a part of the cooking chamber 16. The plurality of doors 1100 and 1200 may be rotatably provided on the front side of the casing 10.

The plurality of doors 1100 and 1200 may include a first door and a second door. The first door may open and close a part of the cooking chamber 16, and the second door may open and close the whole of the cooking chamber 16 together with the first door. The first door may be rotatably disposed or mounted on the front side of the second door.

Meanwhile, on the front panel 11 of the casing 10, a first sealing member (not shown) for sealing the door 1100 and the cooking chamber 16 may be provided. On the rear surface of the individual door 1200, a second sealing member (not shown) for sealing the individual door 1200 and the opening, specifically, the first opening 1111 may be provided. The positions of the first sealing member (not shown) and the second sealing member (not shown) are not limited thereto, and it is sufficient as long as it is an appropriate position for sealing.

Thus, the first sealing member (not shown) may be provided on the rear surface of the door 1100 rather than the front panel 11 of the casing 10. In addition, the second sealing member (not shown) may be provided on the front surface of the door 1100 rather than the rear surface of the individual door 1200, in other words, provided on the front surface of the first frame 1301.

The oven 1000 may further include an operation unit 1500 that is provided in at least one of the door 1100 and the individual door 1200 so as to selectively adjust the rotation of each of the door 1100 and the individual door 1200.

The operation unit 1500 may be provided on a front surface of at least one of the door 1100 and the individual door 1200.

The oven 1000 may further include the handle 9 that is provided in at least one of the door 1100 and the individual door 1200 so as to facilitate user's grip. The handle 9 may be formed on a front surface of at least one of the door 1100 and the individual door 1200 so as to protrude toward the front side of the cooking chamber 16. The shape of the handle 9 may be changeable so as to facilitate user's grip.

The operation unit 1500 may be provided in the handle 9. Detailed description of the operation unit 1500 will be described later.

The oven 1000 may further include a locking unit 1600 that connects the door 1100 and the individual door 1200 so that the individual door 1200 may be moved integrally with or separately from the door 1100 in accordance with the operation of the operation unit 1500. Detailed description of the locking unit 1600 will be described later.

In the door 1100, a seating portion (not shown) that protrudes toward the front side of the cooking chamber 16 may be provided so that the individual door 1200 may be seated in the seating portion (not shown). The individual door 1200 may be rotatably seated in the seating portion (not shown).

Figure 14:
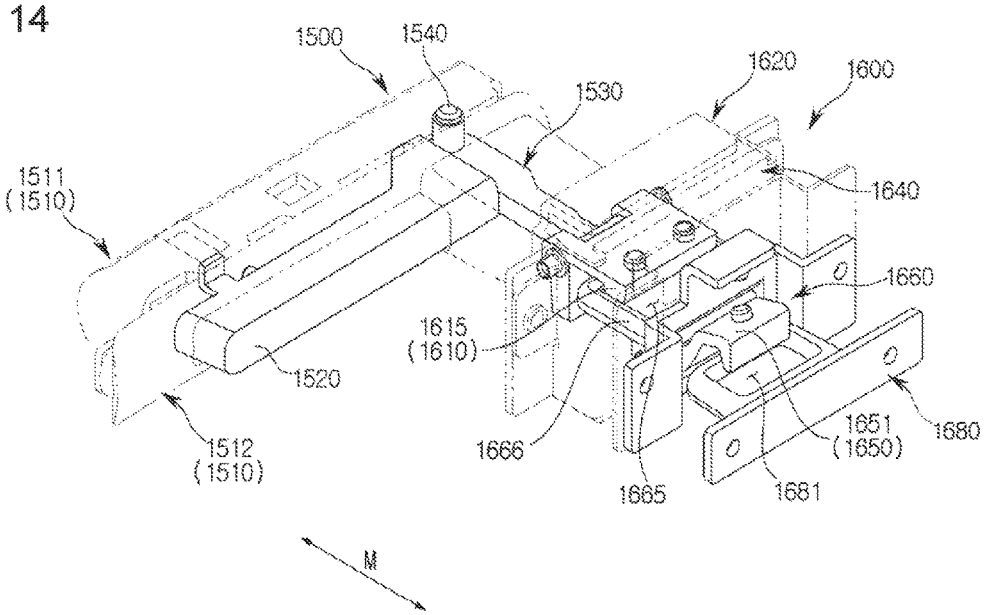
FIG. 14 illustrates an operation unit and a locking unit of an oven in accordance with a third embodiment of the disclosure.
Figure 15:
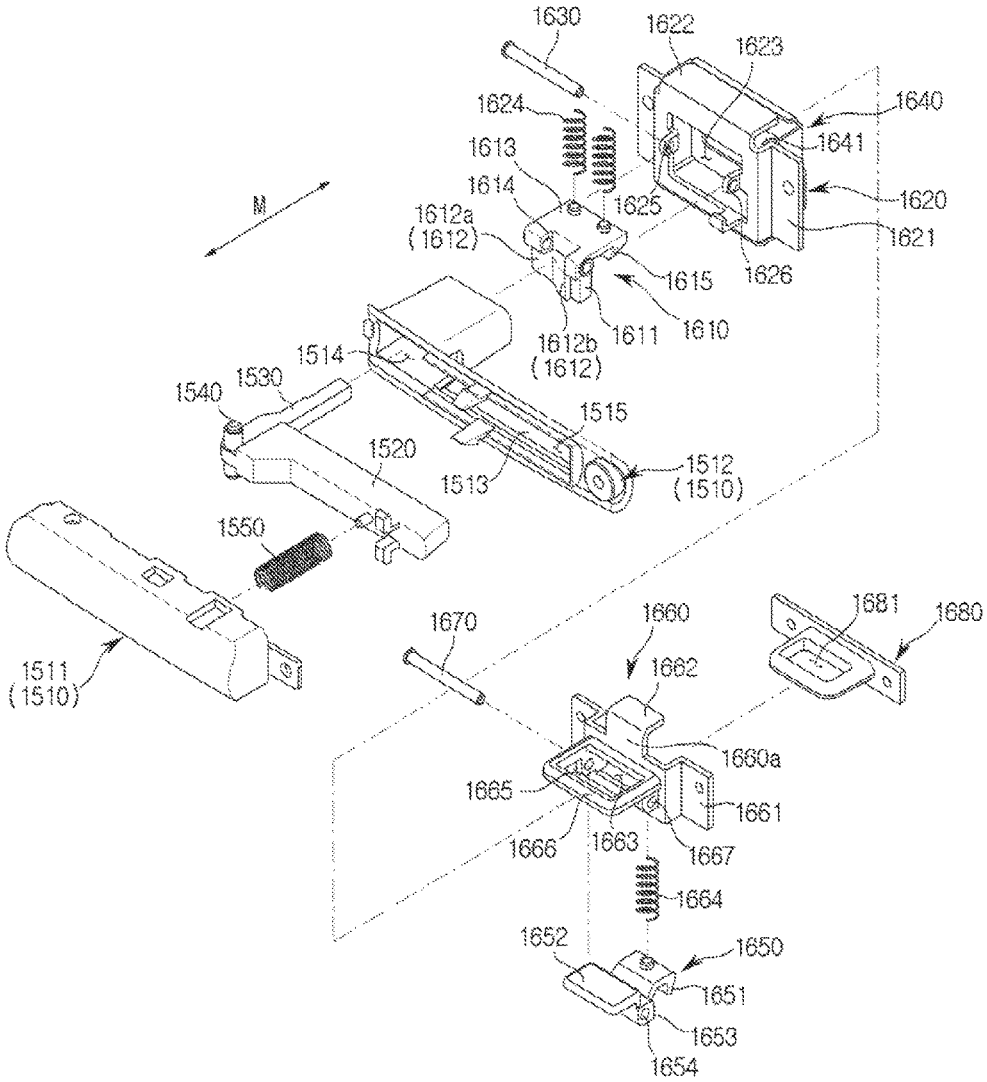
FIG. 15 is an exploded perspective view showing the operation unit and the locking unit of FIG. 14.

FIG. 14 illustrates an operation unit and a locking unit of an oven in accordance with a third embodiment of the disclosure, and FIG. 15 is an exploded perspective view showing the operation unit and the locking unit of FIG. 14. Hereinafter, reference numerals which are not shown may be referred to those in FIGS. 8 to 13. Hereinafter, a protrusion may be used to indicate a second portion 1612*b* of a guide surface 1612. In addition, a rear holder 1660 may be used to indicate a support portion of a second support 1662.

As illustrated in FIGS. 14 and 15, the oven 1000 may further include the operation unit 1500 that is provided in at least one of the door 1100 and the individual door 1200 so as to selectively adjust the rotation of each of the door 1100 and the individual door 1200. The operation unit 1500 may be provided in the handle 9. The operation unit 1500 may be provided inside the handle 9 so that a part of the operation unit 1500 may be exposed toward the outside. In other words, the operation unit 1500 may be provided inside the handle 9 so that a part of a press member 1520 may protrude toward the outside of the handle 9. That is, the operation unit 1500 may be provided inside the handle 9 so that the part of the press member 1520 may be directly pressed by a user.

The operation unit 1500 may further include a case 1510 that forms an appearance of the operation unit 1500.

The case 1510 may include a first case 1511 positioned on a front side in the front and rear direction M of the cooking chamber 16, and a second case 1512 positioned on a rear side in the front and rear direction M of the cooking chamber 16. The first case 1511 and the second case 1512 may be coupled to each other to form the appearance of the operation unit 1500. On the second case 1512, a press member receiving portion 1513 and a pressure member receiving unit 1514 may be provided. The press member receiving portion 1513 may include a cut portion 1515. The pressure member receiving unit 1514 may protrude toward the outside of the handle 9 so as to face the front panel 1410.

The operation unit 1500 may further include the press member 1520 that is provided to be pressed by a user. The press member 1520 may be disposed in the press member receiving portion 1513 so that a part of the press member 1520 may protrude toward the outside of the second case 1512 through the cut portion 1515. The part of the press member 1520 that is exposed toward the outside of the second case 1512 through the cut portion 1515 may protrude toward the outside of the handle 9 so as to face the front surface of the individual door 1200. In other words, the press member 1520 may be provided on a rear surface of the handle 9 so that the press member 1520 may be pressed.

The operation unit 1500 may further include a pressure member 1530 that is rotatably coupled to the press member 1520. The pressure member 1530 may be received in the pressure member receiving unit 1514 so as to selectively press a front link 1610. The pressure member 1530 may be rotatably coupled to the press member 1520 so as to selectively press a first portion 1612*a* of the front link 1610 in accordance with whether the press member 1520 is pressed.

The operation unit 1500 may further include a rotational axis 1540 that connects the press member 1520 and the pressure member 1530. In other words, the pressure member 1530 may be coupled to the press member 1520 so that the pressure member 1530 may be moved about the rotational axis 1540 along the guide surface 1612 formed on a body 1611 of the front link 1610.

The operation unit 1500 may further include an elastic body 1550. The elastic body 1550 may include a spring. The elastic body 1550 may be provided between the first case 1511 and the press member 1520. The elastic body 1550 may be coupled to at least one of the first case 1511 and the press member 1520. When a user presses the press member 1520, the elastic body 1550 may be retracted.

The oven 1000 may further include the locking unit 1600 that connects the door 1100 and the individual door 1200 so that the individual door 1200 may open and close the cooking chamber 16 integrally with or separately from the door 1100. In other words, the oven 1000 may further include the locking unit 1600 that connects the door 1100 and the individual door 1200 so that the individual door 1200 may be moved integrally with or separately from the door 1100 in accordance with the operation of the operation unit 1500.

The locking unit may include a front link 1610.

The front link 1610 may include a body 1611.

A guide surface 1612 may be formed on one surface of the body 1611. Specifically, the guide surface 1612 may be formed on one surface of the body 1611 that faces the pressure member 1530. On the guide surface 1612, irregularities may be formed. By way of an example, the guide surface 1612 may include a first portion 1612*a* and a second portion 1612*b*. The second portion 1612*b* may be connected to the first portion 1612*a* so as to protrude forward. In other words, the second portion 1612*b* may be connected to the first portion 1612*a* so as to convexly protrude forward. The pressure member 1530 may be rotated about the rotational axis 1540 along the guide surface 1612. The pressure member 1530 may be rotatably coupled to the press member 1520 so as to selectively press the second portion 1612*b* of the guide surface 1612 in accordance with whether to press the press member 1520. Specifically, when a user presses the press member 1520, the pressure member 1530 may press the second portion 1612*b* of the guide surface 1612 while being rotated about the rotational axis 1540.

The front link 1610 may further include a head 1613 that is connected to the body 1611.

The head 1613 may be connected to an upper portion of the body 1611 in the vertical direction N of the cooking chamber 16. On one end of the head 1613 that faces forward in the front and rear direction M of the cooking chamber 16, an axial through-hole 1614 may be formed.

The front link 1610 may further include a latch portion 1615 that is detachably coupled to a coupling groove 1665 in accordance with the movement of the operation unit 1500. Specifically, the latch portion 1615 may be formed on the other end of the head 1613 that faces rearward in the front and rear direction M of the cooking chamber 16. The latch portion 1615 may have a hook shape that can be detachably coupled to the coupling groove 1665 formed on the rear holder 1660. However, the shape of the latch portion 1615 is not limited to the hook shape, and may be variously modified.

The locking unit 1600 may further include a front holder 1620.

The front holder 1620 may be provided inside the individual door 1200.

The front holder 1620 may include a first fixing portion 1621 that is coupled to the support member 1640. The first fixing portion 1621 and the support member 1640 may be coupled to each other by a fixing member (not shown). The first fixing portion 1621 may extend toward a lateral side on a front surface 1620*a* of the front holder 1620 that faces forward.

The front holder 1620 may further include a first support 1622. The first support 1622 may extend toward a rear side on the front surface 1620*a* of the front holder 1620 that faces forward.

The front holder 1620 may further include a front link insertion portion 1623 into which the front link 1610 is inserted. When the front link 1610 is inserted in the front link insertion portion 1623, the first support 1622 and the head 1613 of the front link 1610 may face each other in the vertical direction N of the cooking chamber 16. A first elastic member 1624 may be provided between the first support 1622 and the head 1613 of the front link 1610. The first elastic member 1624 may be coupled to at least one of the first support 1622 and the head of the front link 1610. The latch portion 1615 may be detachably coupled to the coupling groove 1665 by a restoring force of the first elastic member 1624.

The front holder 1620 may further include a front axial coupling hole 1625. The front axial coupling hole 1625 may be formed in a protrusion 1626 that protrudes forward on the front surface 1620*a* of the front holder 1620.

The front link 1610 may be rotatably coupled to the front holder 1620 in the vertical direction N of the cooking chamber 16. Specifically, the front link 1610 may be coupled to the front holder 1620 to be rotatable about a front rotational axis 1630 that connects the front link 1610 and the front holder 1620 in the vertical direction N of the cooking chamber 16. The front rotational axis 1630 connects the front holder 1620 and the front link 1610 while passing through the front axial coupling hole 1625 of the front holder 1620 and an axial through-hole 1614 of the front link 1610.

The locking unit 1600 may further include the support member 1640. The support member 1640 may be fixed to the rear panel 1420. The first fixing portion 1621 of the front holder 1620 may be coupled to the support member 1640. On the support member 1640, the coupling groove 1665 of the rear holder 1660 and an insertion hole 1641 in which a press portion 1652 of the rear link 1650 may be formed.

The locking unit 1600 may further include the rear link 1650.

The rear link 1650 may be rotatably coupled to a rear holder 1660.

The rear link 1650 may include the hook 1651 that is detachably coupled to the fastening groove 1681 provided on the front panel 11. The hook 1651 may be formed on one end of the rear link 1650 that faces rearward in the front and rear direction M of the cooking chamber 16.

The rear link 1650 may further include the press portion 1652 that transmits the movement of the front link 1610 to the hook 1651. The press portion 1652 may be formed on the other end of the rear link 1650 that faces forward in the front and rear direction M of the cooking chamber 16.

The rear link 1650 may further include a connection portion 1653 that connects the hook 1651 and the press portion 1652. In the connection portion 1653, an axial through-hole 1654 may be formed.

The locking unit 1600 may further include the rear holder 1660.

The rear holder 1660 may be provided inside the door 1100.

The rear holder 1660 may include a second fixing portion 1661 that is coupled to the frame 1300 of the door 1100. Specifically, the second fixing portion 1661 may be fixedly coupled to the second frame 1302 of the door 1100. The second fixing portion 1661 and the second frame 1302 of the door 1100 may be coupled to each other by a fixing member (not shown). The second fixing portion 1661 may extend toward a lateral side on a front surface 1660*a* of the rear holder 1660 that faces forward.

The rear holder 1660 may further include the second support 1662. The second support 1662 may extend from the rear holder 1660 so as to face the hook 1651 in the vertical direction N of the cooking chamber 16. Specifically, the second support 1662 may extend toward a rear side on the front surface 1660*a* of the rear holder 1660 that faces forward.

The rear holder 1660 may further include a rear link insertion portion 1663 into which the rear link 1650 is inserted. Specifically, the rear holder 1660 may further include the rear link insertion portion 1663 into which the hook 1651 of the rear link 1650 is inserted. When the rear link 1650 is inserted into the rear link insertion portion 1663, the second support 1662 and the hook 1651 of the rear link 1650 may face each other in the vertical direction N of the cooking chamber 16. A second elastic member 1664 may be provided between the second support 1662 and the hook 1651 of the rear link 1650. The second elastic member 1664 may be coupled to at least one of the second support 1662 and the hook 1651 of the rear link 1650. The hook 1651 may be detachably coupled to a fastening groove 1681 by a restoring force of the second elastic member 1664.

The rear holder 1660 may further include the coupling groove 1665 that is provided to face the front link 1610. The coupling groove 1665 may be formed inside a coupling frame 1666. The coupling frame 1666 may have a shape that protrudes toward a front side on the front surface 1660*a* of the rear holder 1660. On the coupling groove 1665, the press portion 1652 of the rear link 1650 may be rotatably disposed in the vertical direction N of the cooking chamber 16.

The rear holder 1660 may further include a rear axial coupling hole 1667. The rear axial coupling hole 1667 may be formed in the coupling frame 1666 of the rear holder 1660. By way of example, the rear axial coupling hole 1667 may be formed in the coupling frame 1666 so as to be positioned on a lower portion of the coupling groove 1665 in the vertical direction N of the cooking chamber 16.

The rear link 1650 may be coupled to the rear holder 1660 so as to be rotatable in the vertical direction N of the cooking chamber 16. Specifically, the rear link 1650 may be coupled to the rear holder 1660 to be rotatable in the vertical direction N of the cooking chamber 16 about a rear rotational axis 1670 that connects the rear link 1650 and the rear holder 1660. The rear rotational axis 1670 connects the rear holder 1660 and the rear link 1650 while passing through the rear axial coupling hole 1667 of the rear holder 1660 and the axial through-hole 1654 of the rear link 1650.

The locking unit 1600 may further include a fastening groove 1681 that is provided on the front panel 11 so as to adjust whether to open and close the door 1100 with respect to the cooking chamber 16. Specifically, the fastening groove 1681 may be formed inside a restraining member 1680 that is fixed to the front panel 11. The hook 1651 of the rear link 1650 may be detachably coupled to the fastening groove 1681.

The locking unit 1600 may further include the rear rotational axis 1670 that connects the rear holder 1660 and the rear link 1650 while passing through the rear holder 1660 and the rear link 1650. The rear link 1650 may be moved about the rear rotational axis 1670 in the vertical direction N of the cooking chamber 16.

The locking unit 1600 may further include the front rotational axis 1630 that connects the front holder 1620 and the front link 1610 so as to pass through the front holder 1620 and the front link 1610, and may be disposed in parallel with the rear rotational axis 1670. The front link 1610 may be moved about the front rotational axis 1630 in the vertical direction N of the cooking chamber 16.

Figure 16:
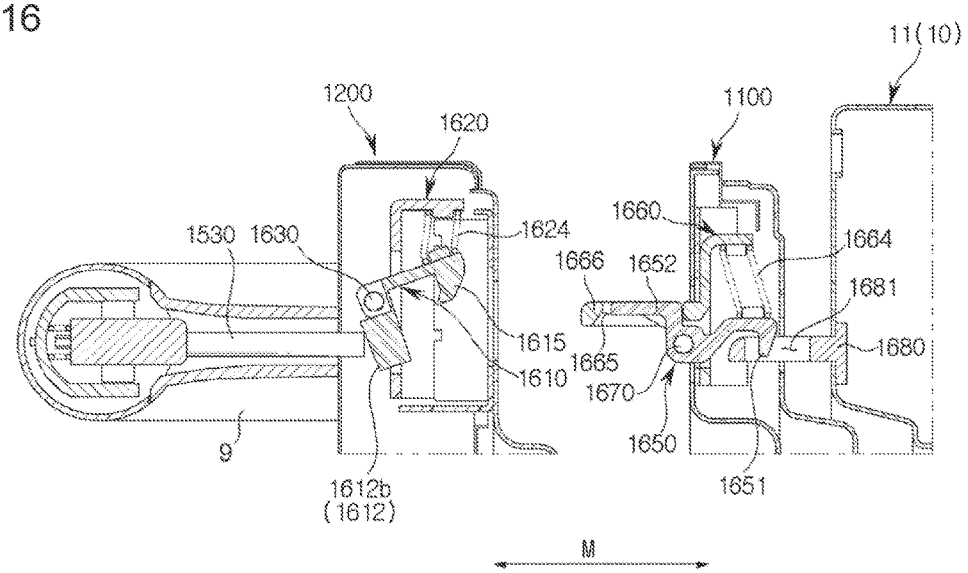
FIG. 16 illustrates a state in which a locking unit is operated when a first door of an oven in accordance with a third embodiment of the disclosure is opened.
Figure 17:
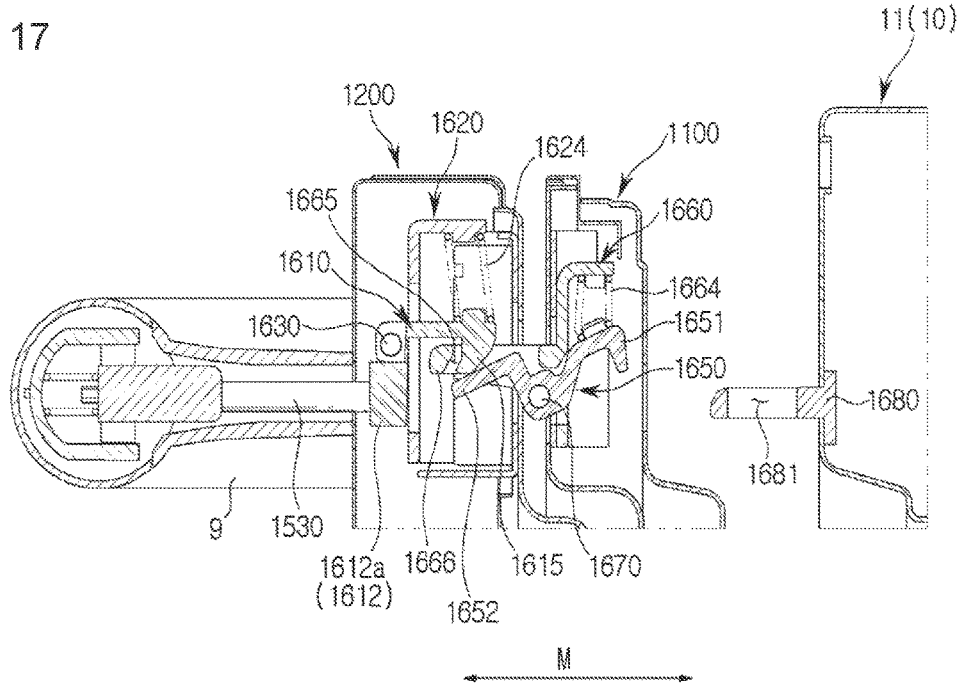
FIG. 17 illustrates a state in which a locking unit is operated when a second door of an oven in accordance with a third embodiment of the disclosure is opened.

FIG. 16 illustrates a state in which a locking unit is operated when a first door of an oven in accordance with a third embodiment of the disclosure is opened, and FIG. 17 illustrates a state in which a locking unit is operated when a second door of an oven in accordance with a third embodiment of the disclosure is opened. Hereinafter, reference numerals which are not shown may be referred to those in FIGS. 8 to 15.

As illustrated in FIGS. 16 and 17, when a user pulls the handle 9 toward the front side of the casing 10, that is, the front side of the cooking chamber 16 while pressing the press member 1520, the individual door 1200 may be rotated, when the user pulls the handle 9 toward the front side of the casing 10, that is, the front side of the cooking chamber 16 without pressing the press member 1520, the individual door 1200 and the door 1100 may be integrally rotated.

A process in which the individual door 1200 is opened will be described with reference to FIG. 16.

When a user presses the press member 1520, the pressure member 1530 may be rotated about the rotational axis 1540 and pressurize the second portion 1612*b* of the front link 1610. When the second portion 1612*b* of the front link 1610 is pressurized, the front link 1610 is rotated upward about the front rotational axis 1630. In this instance, the first elastic member 1624 is retracted, and the latch portion 1615 is separated from the coupling groove 1665 of the rear holder 1660. Accordingly, the individual door 1200 is rotatable separately from the door 1100. In other words, a locked state of the individual door 1200 is released separately from the door 1100. When the locked state of the individual door 1200 is released, the hook 1651 of the rear link 1650 may remain in a state in which the hook 1651 is coupled to a fastening groove 1681 of a restraining member 1680 by the second elastic member 1664. Accordingly, the door 1100 may remain in a state in which the door 1100 is restrained to the front panel 11 separately from the individual door 1200.

A process in which the door 1100 is opened will be described with reference to FIG. 17.

When a user does not press the press member 1520, one end of the pressure member 1530 that faces the rear side of the cooking chamber 16 may face the first portion 1612*a* of the front link 1610. In other words, when the user pulls the handle 9 without pressing the press member 1520, the pressure of the pressure member 1530 against the front link 1610 does not occur. In this instance, the latch portion 1615 may press the press portion 1652 positioned on the inner side of the coupling groove 1665 by the first elastic member 1624, and remain in a state in which the press portion 1652 is coupled to the coupling groove 1665. When the press portion 1652 of the rear link 1650 is pressed by the latch portion 1615, the rear link 1650 rotates upward with respect to the rear rotational axis 1670. In this instance, the second elastic member 1664 is retracted, and the hook 1651 is separated from the fastening groove 1681 of the restraining member 1680. Accordingly, the door 1100 becomes rotatable from the front panel 11. In other words, the locked state of the door 1100 is released. When the locked state of the door 1100 against the front panel 11 is released, the individual door 1200 is moved integrally with the door 1100. Specifically, when the locked state of the door 1100 against the front panel 11 is released, the individual door 1200 is moved integrally with the door 1100 by coupling between the latch portion 1615 of the front link 1610 and the coupling groove 1665 of the rear holder 1660.

Figure 18:
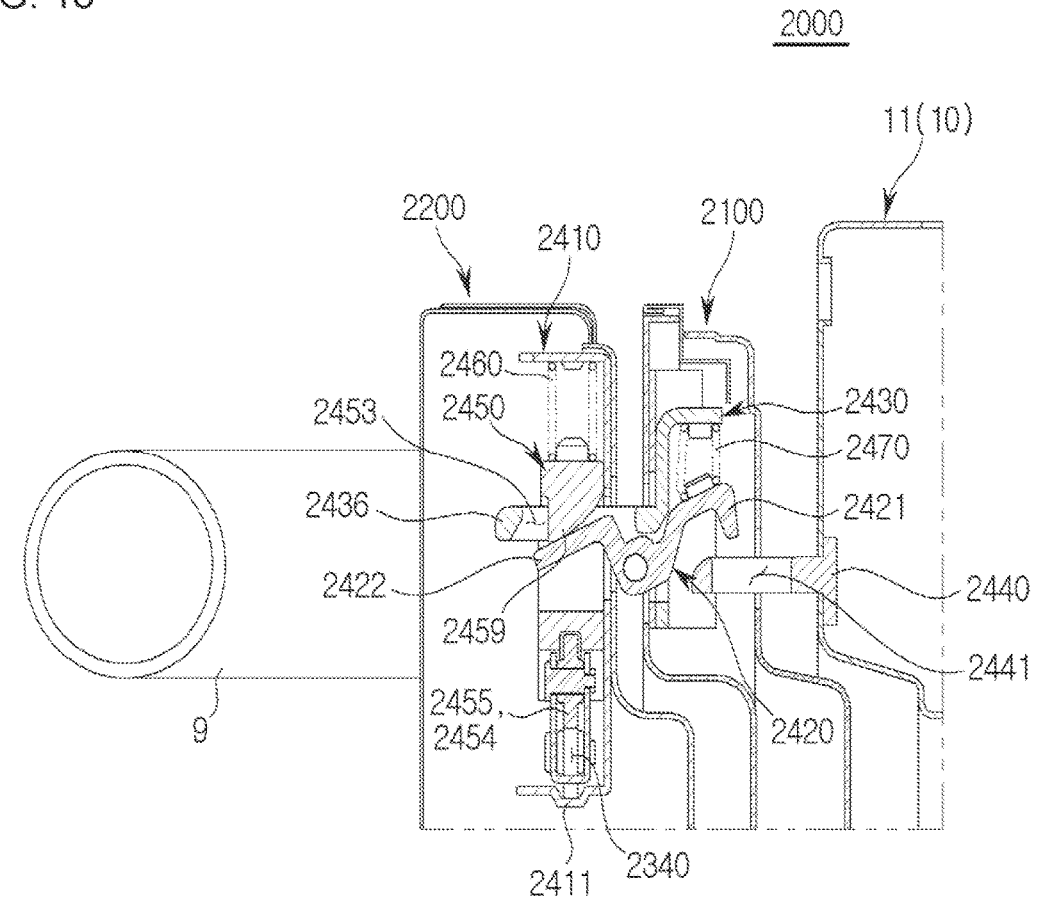
FIG. 18 is a cross-sectional view showing an oven in accordance with a fourth embodiment of the disclosure.
Figure 19:
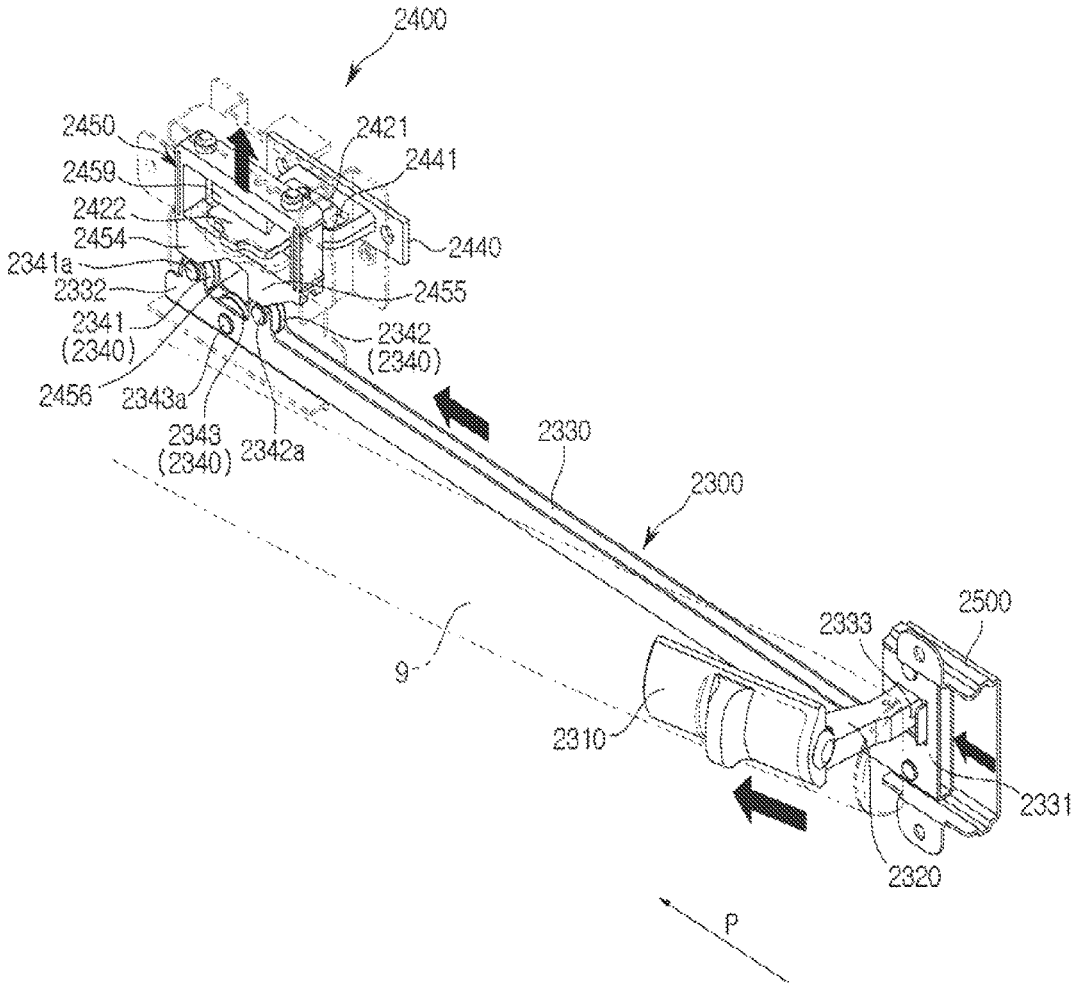
FIG. 19 illustrates a state in which a restraining unit is operated when an operation unit of an oven in accordance with a fourth embodiment of the disclosure is moved in a first direction.
Figure 20:
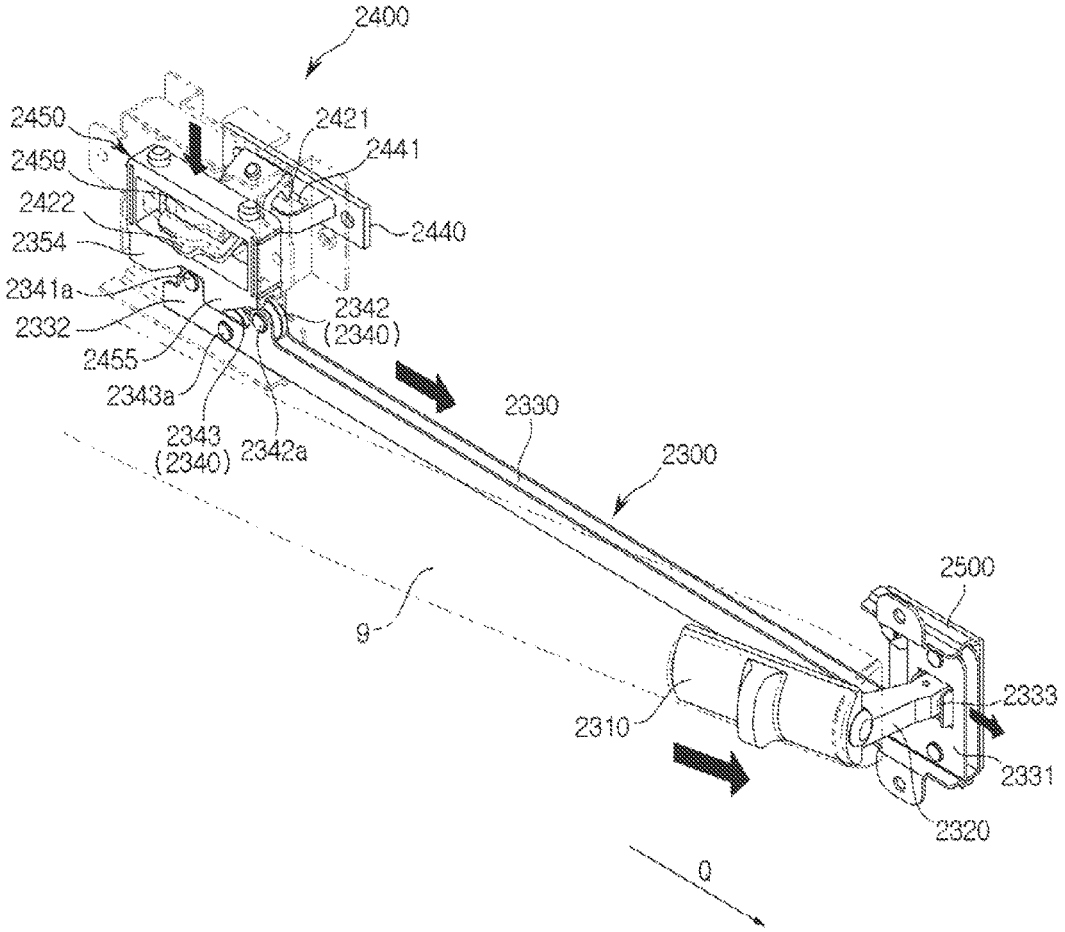
FIG. 20 illustrates a state in which a restraining unit is operated when an operation unit of an oven in accordance with a fourth embodiment of the disclosure is moved in a second direction.
Figure 21:
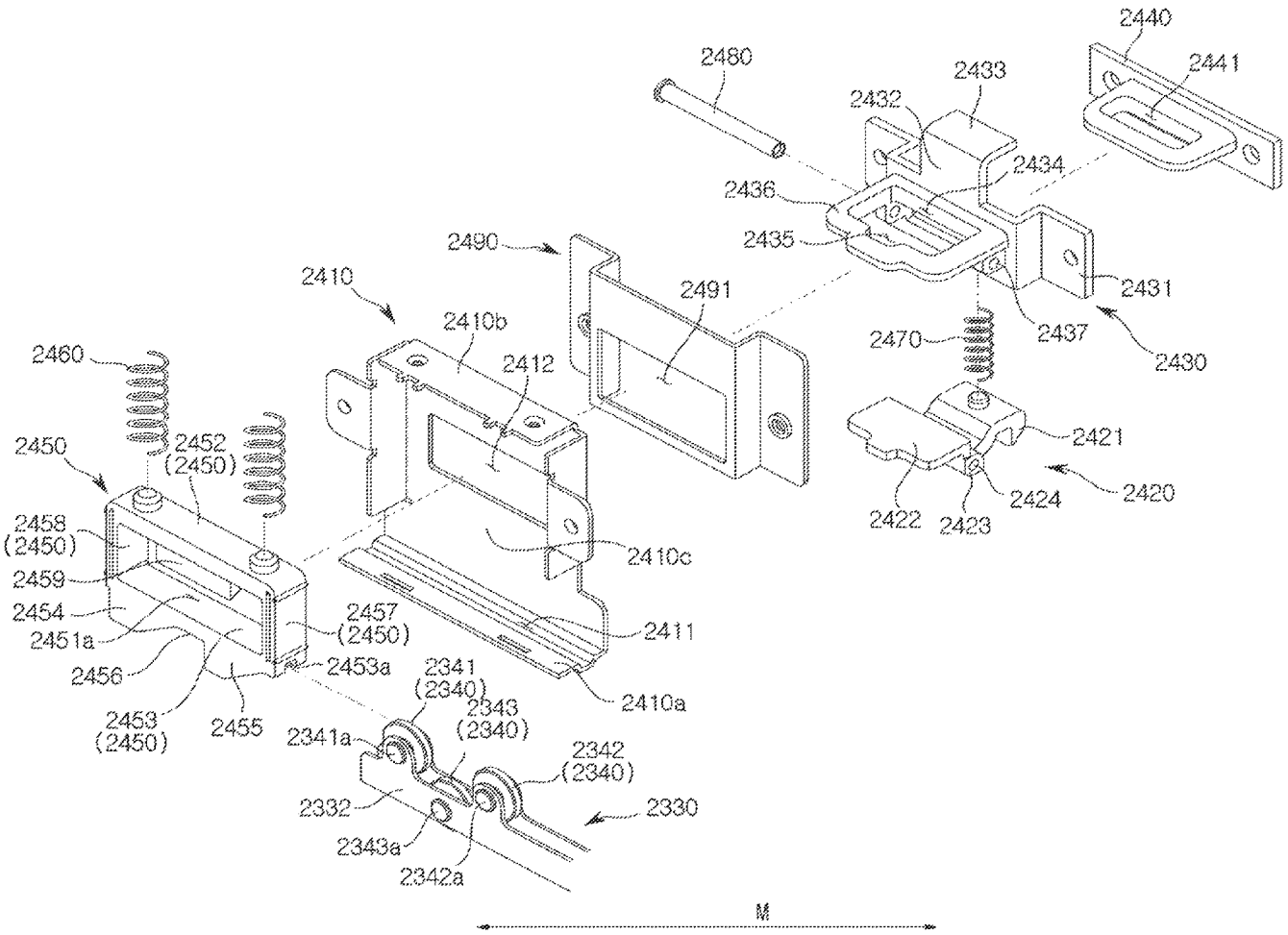
FIG. 21 is an exploded perspective view showing a restraining unit of an oven in accordance with a fourth embodiment of the disclosure.
Figure 22:
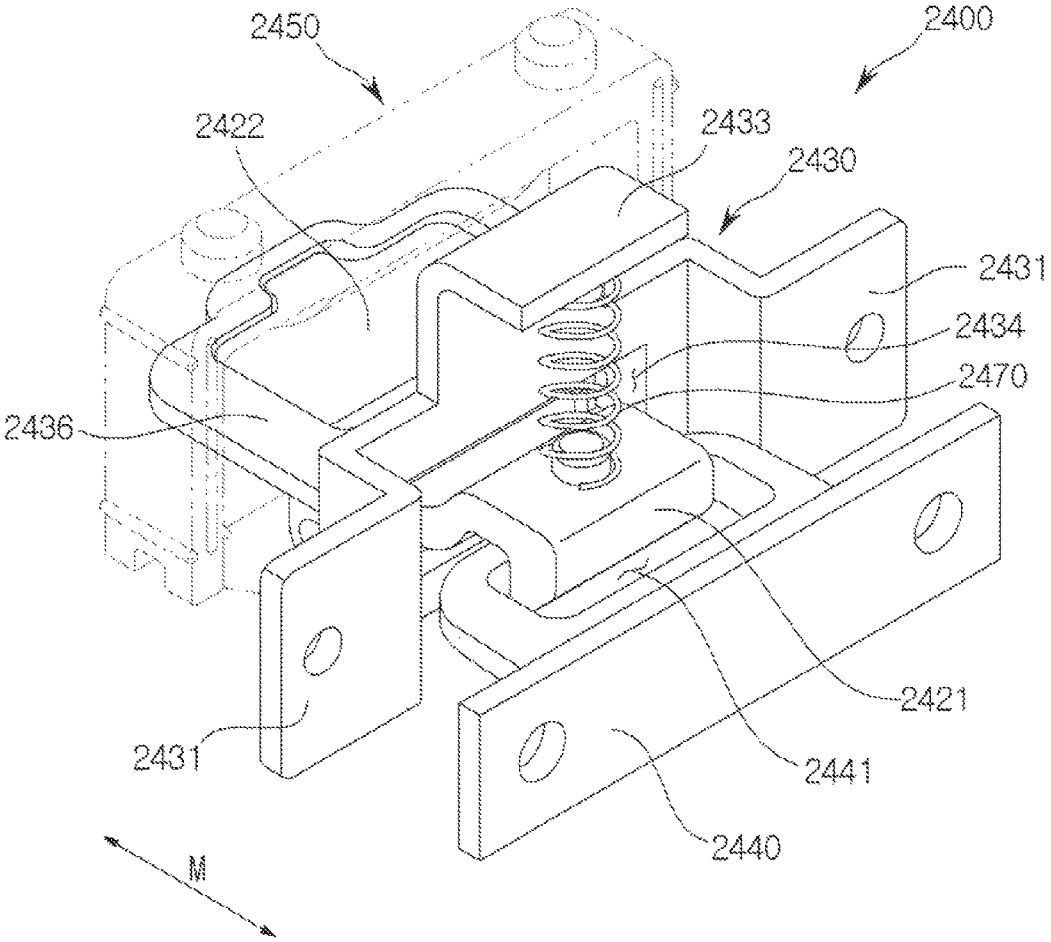
FIG. 22 illustrates a part of a restraining unit when a first door of an oven in accordance with a fourth embodiment of the disclosure is restrained.
Figure 23:
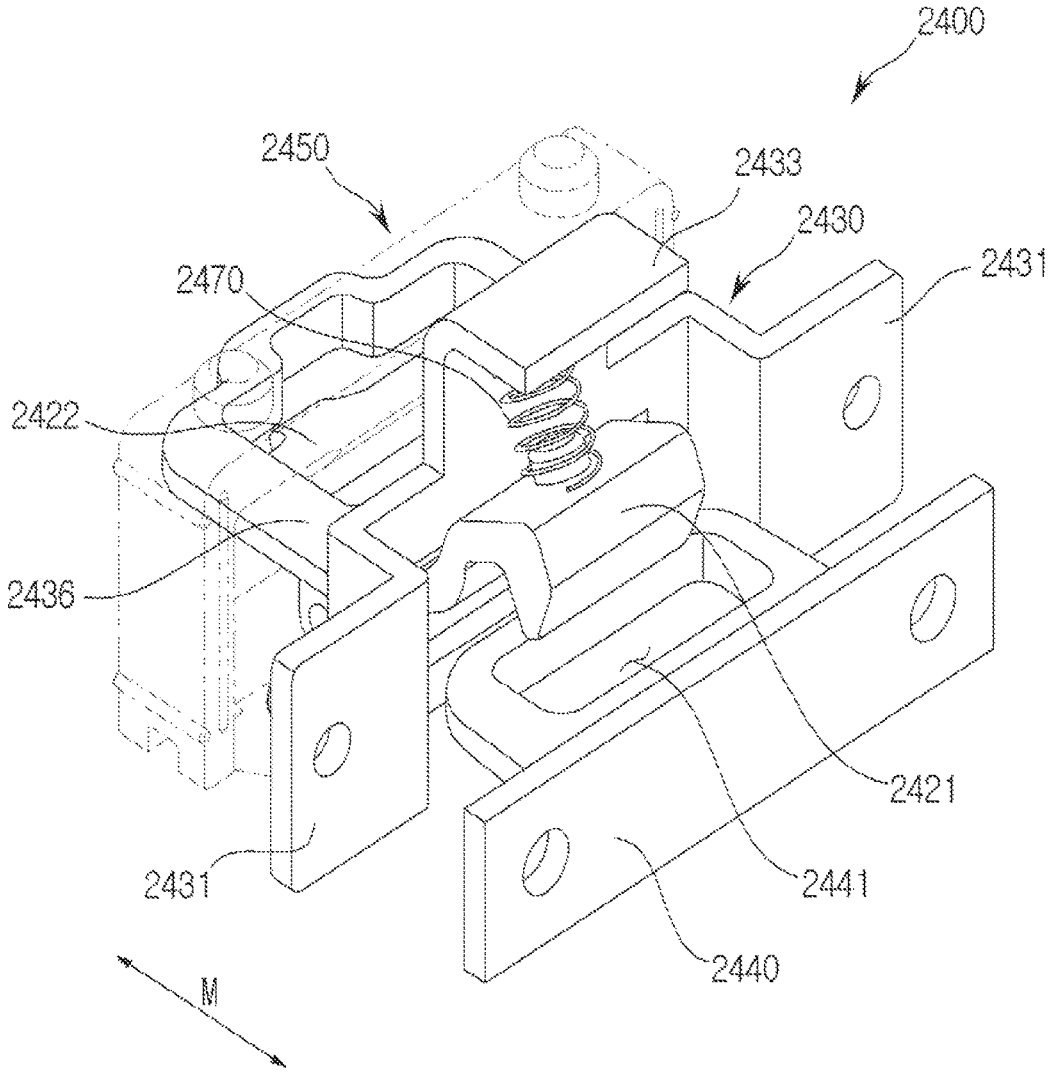
FIG. 23 illustrates a part of a restraining unit when restraint of a first door of an oven in accordance with a fourth embodiment of the disclosure is released.
Figure 24A:
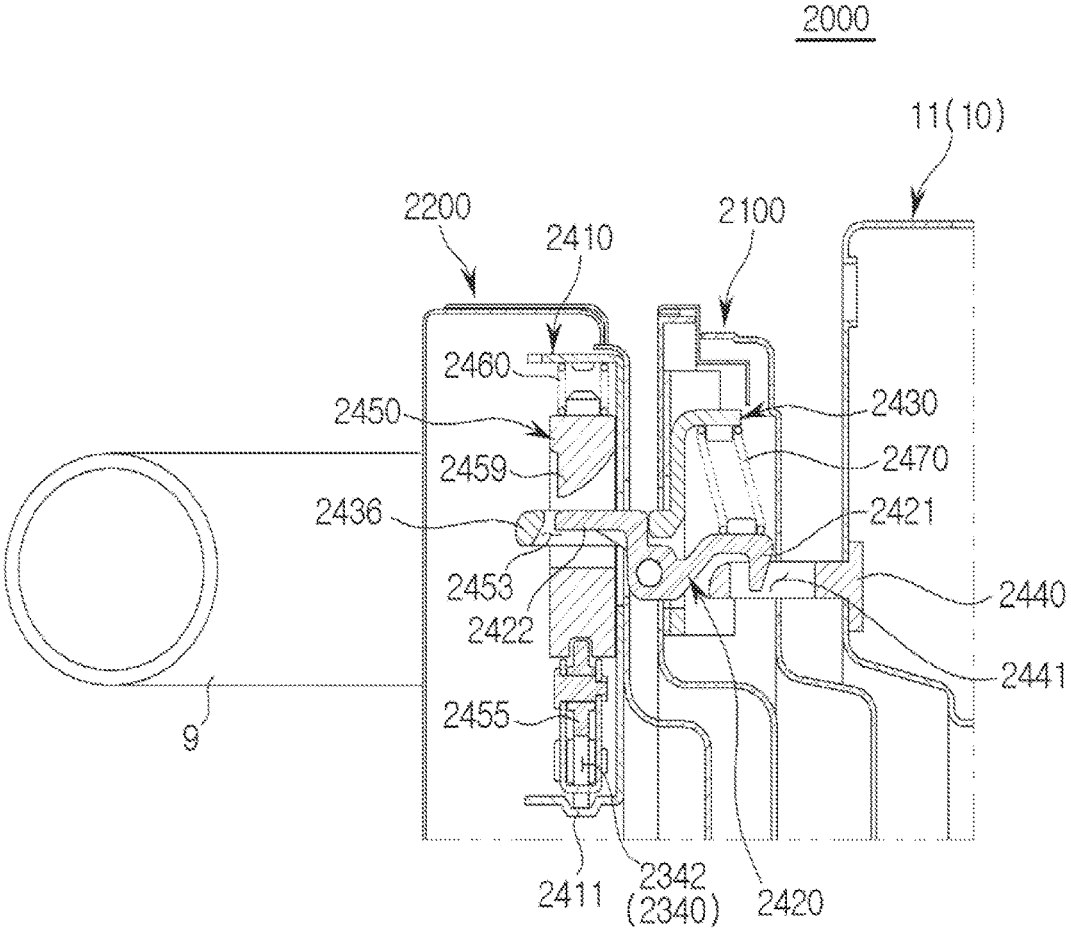
FIGS. 24*a* and 24*b* illustrate a state in which a locking unit is operated when a first door of an oven in accordance with a fourth embodiment of the disclosure is opened.
Figure 24B:
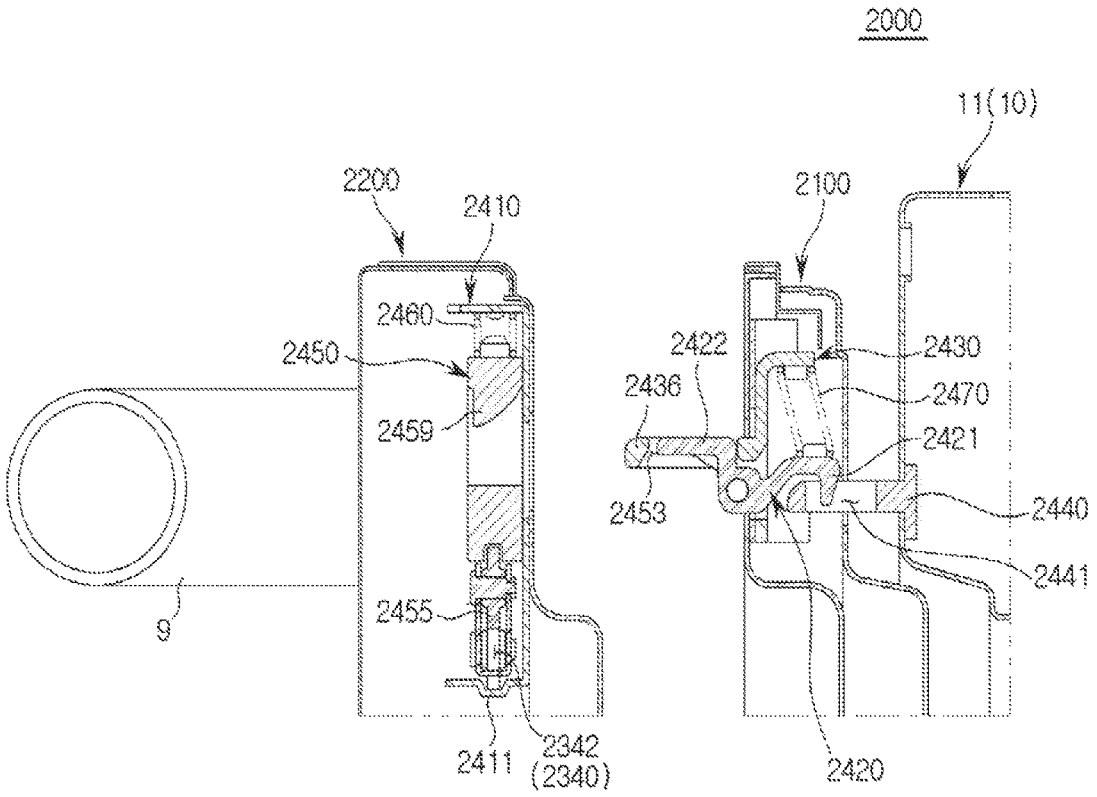
Figure 25A:
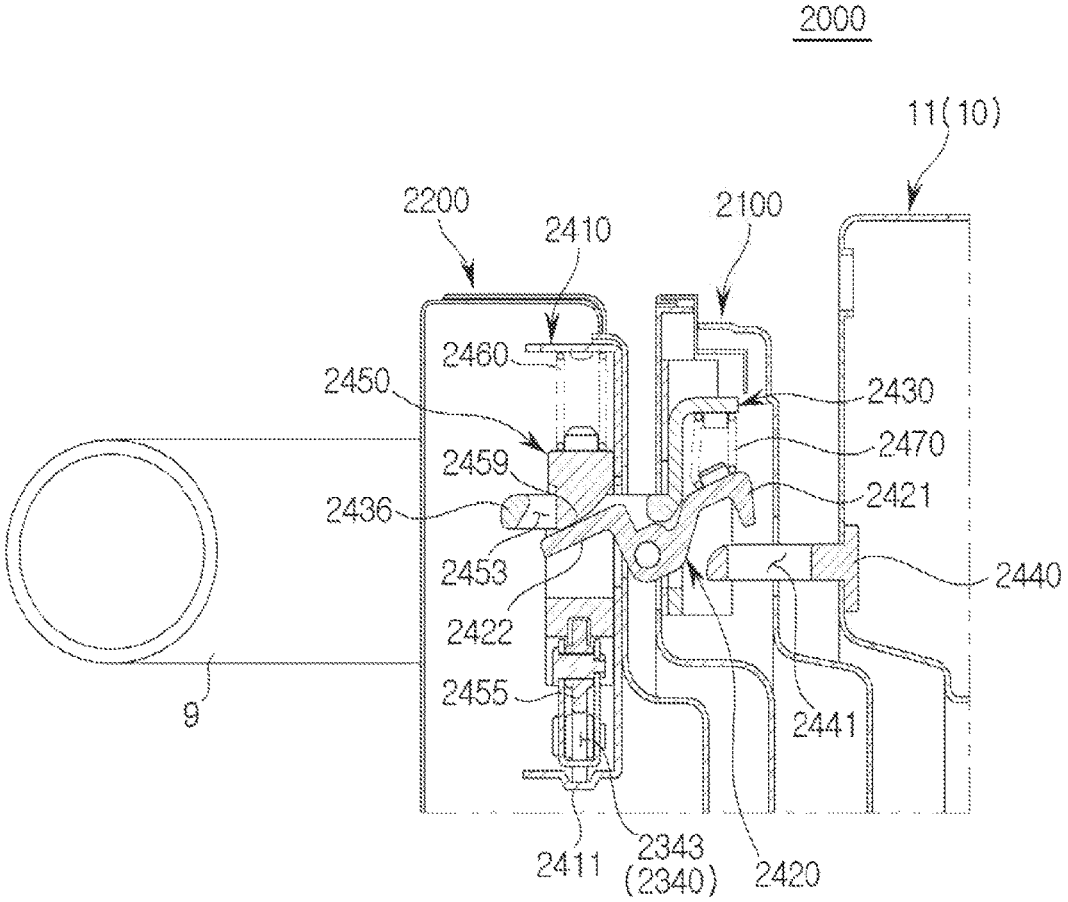
FIGS. 25*a* and 25*b* illustrate a state in which a locking unit is operated when a second door of an oven in accordance with a fourth embodiment of the disclosure is opened.
Figure 25B:
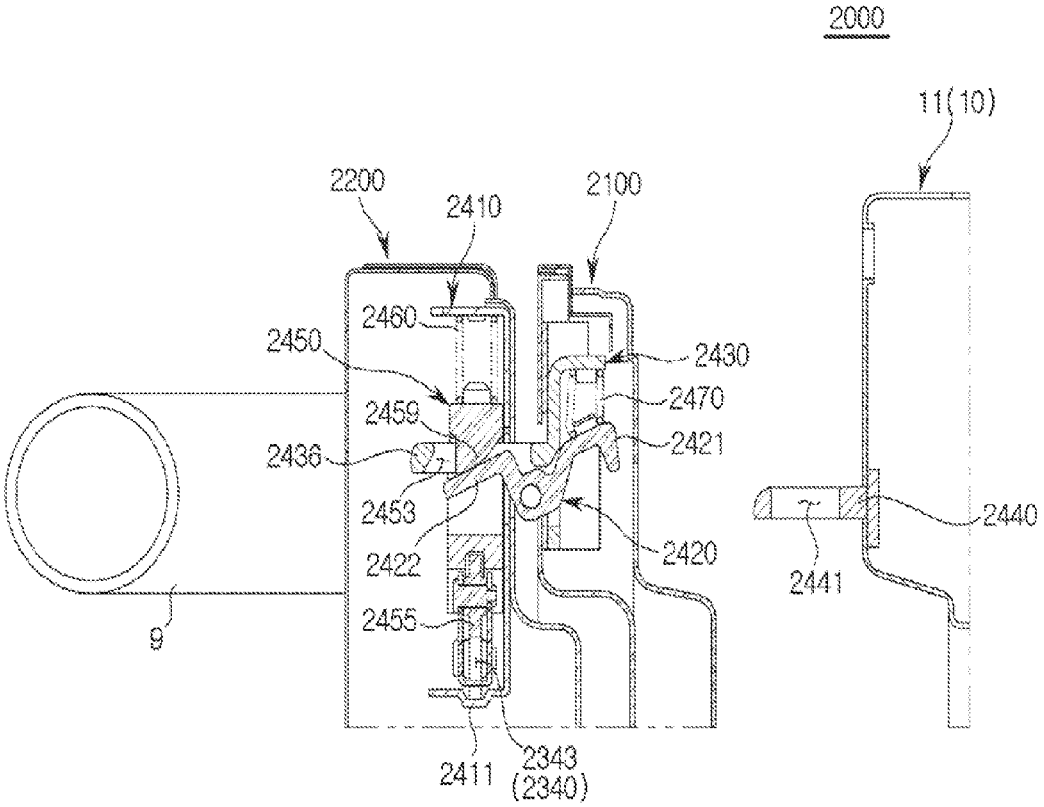

FIG. 18 is a cross-sectional view showing an oven in accordance with a fourth embodiment of the disclosure, FIG. 19 illustrates a state in which a restraining unit is operated when an operation unit of an oven in accordance with a fourth embodiment of the disclosure is moved in a first direction, FIG. 20 illustrates a state in which a restraining unit is operated when an operation unit of an oven in accordance with a fourth embodiment of the disclosure is moved in a second direction, FIG. 21 is an exploded perspective view showing a restraining unit of an oven in accordance with a fourth embodiment of the disclosure, FIG. 22 illustrates a part of a restraining unit when a first door of an oven in accordance with a fourth embodiment of the disclosure is restrained, FIG. 23 illustrates a part of a restraining unit when restraint of a first door of an oven in accordance with a fourth embodiment of the disclosure is released, FIGS. 24*a* and 24*b* illustrate a state in which a locking unit is operated when a first door of an oven in accordance with a fourth embodiment of the disclosure is opened, and FIGS. 25*a* and 25*b* illustrate a state in which a locking unit is operated when a second door of an oven in accordance with a fourth embodiment of the disclosure is opened. Hereinafter, a first door may be used to indicate an individual door 2200, and a second door may be used to indicate a door 2100. Hereinafter, repeated description with respect to the description in reference to FIGS. 1 to 4 will be omitted. In addition, reference numerals which are not shown may be referred to those in FIGS. 1 to 4.

As illustrated in FIGS. 18 to 25*b*, an oven 2000 may further include the door 2100 provided in the casing 10 so as to open and close the cooking chamber 16. The door 2100 may be rotatably disposed in the casing 10. The door 2100 may be rotatably provided in the front surface of the casing 10. That is, the door 2100 may be rotatably provided in the front panel 11.

The door 2100 may have the same structure as that described in FIGS. 8 to 13, but the disclosure is not limited thereto. However, for ease of description, it is assumed that the door 2100 has the same structure as that described in FIGS. 8 to 13.

The oven 2000 may further include an individual door 2200 that is rotatable separately from the door 2100 so as to open and close a part of the cooking chamber 16. The individual door 2200 may be provided in the door 2100.

The individual door 2200 may have the same structure as that described in FIGS. 8 to 13, but the disclosure is not limited thereto. However, for ease of description, it is assumed that the individual door 2200 has the same structure as that described in FIGS. 8 to 13.

The oven 2000 may further include an operation unit 2300 that is provided in at least one of the door 2100 and the individual door 2200 so as to selectively adjust rotation of the door 2100 and the individual door 2200.

The operation unit 2300 may be provided on a front surface of at least one of the door 2100 and the individual door 2200. The operation unit 2300 may be provided in the handle 9. The operation unit 2300 may be provided on one side of the handle 9, but is not limited thereto.

The operation unit 2300 may include a lever 2310, a connection member 2320, and a rod 2330.

The lever 2310 protrudes toward the front side of the handle 9 so as to facilitate user's operation. The lever 2310 may be moved in a first direction P or a second direction Q.

The rod 2330 is provided to provide the movement of the lever 2310 to a restraining unit 2400 which will be described later. The rod 2330 may be provided inside the individual door 2200. The rod 2330 may have a rod shape that extends in a left and right direction U (see FIG. 8) of the casing 10. In addition, the rod 2330 may have a rod shape whose one surface is opened. However, the shape of the rod 2330 is not limited to the rod shape, and any shape is possible as long as it can transmit the movement of the lever 2310 to the restraining unit 2400. On a first end 2331 of the rod 2330, a connection member coupling hole 2333 may be provided. On a second end 2332 of the rod 2330, a plurality of rollers 2340 may be provided. Specifically, the plurality of rollers 2340 may be rotatably received into the second end 2332 of the rod 2330. Preferably, the plurality of rollers 2340 include a first roller 2341, a second roller 2342, and a third roller 2343. The first roller 2341 and the second roller 2342 may be provided in the second end 2332 of the rod 2330 so as to be spaced apart from each other. The second roller 2342 may be provided in the second end 2332 of the rod 2330 so as to be adjacent to the lever 2310 rather than the first roller 2341. The third roller 2343 may be provided between the first roller 2341 and the second roller 2342. The plurality of rollers 2340 may be rotated about different axes 2341*a*, 2342*a*, and 2343*a*. One or more axes 2341*a*, 2342*a*, and 2343*a* of the plurality of rollers 2340 may be coupled to the rod 2330 so as to have different heights in a vertical direction N (see FIG. 8) of the casing 10. By way of example, the axis 2341*a* of the first roller 2341 and the axis 2342*a* of the second roller 2342 may be positioned above the axis 2343*a* of the third roller 2343 in the vertical direction N (see FIG. 8) of the casing 10. The axis 2341*a* of the first roller 2341 and the axis 2342*a* of the second roller 2342 may be positioned at the same height in the vertical direction N (see FIG. 8) of the casing 10. The axes 2341*a*, 2342*a*, and 2343*a* of the plurality of rollers 2340 may be coupled to the rod 2330 so as to pass through the rod 2330 in a front and rear direction M (see FIG. 8) of the casing 10. However, the number and position of the plurality of rollers 2340 may be variously changed.

The connection member 2320 is provided between the lever 2310 and the rod 2330 so as to connect the lever 2310 and the rod 2330. Specifically, one end of the connection member 2320 may be coupled to the lever 2310, and the other end thereof may be coupled to the connection member coupling hole 2333 of the rod 2330. That is, the connection member 2320 serves to transmit the movement of the lever 2310 to the rod 2330. The lever 2310, the connection member 2320, and the rod 2330 may be integrally moved.

The oven 2000 may further include a restraining unit 2400 that connects the door 2100 and the individual door 2200 so that the individual door 2200 may be moved integrally with or separately from the door 2100 in accordance with the operation of the operation unit 2300.

The restraining unit 2400 may include a support frame 2410.

The support frame 2410 may be provided inside the individual door 2200. In other words, the support frame 2410 may be fixedly coupled to the individual door 2200.

The support frame 2410 may include a bottom surface 2410*a* that faces the rod 2330 of the operation unit 2300. On the bottom surface 2410*a* of the support frame 2410, a rail unit 2411 that guides movement of a second end 2332 of the rod 2330 may be formed.

The support frame 2410 may further include a support surface 2410*b* that faces the bottom surface 2410*a*. The support surface 2410*b* may be positioned above the bottom surface 2410*a* in the vertical direction N (see FIG. 8) of the casing 10.

The support frame 2410 may further include a connection surface 2410*c* that connects the bottom surface 2410*a* and the support surface 2410*b*. On the connection surface 2410*c*, the holder 2430 and an insertion hole 2412 in which a part of a link 2420 is inserted may be provided.

The bottom surface 2410*a*, the support surface 2410*b*, and the connection surface 2410*c* may be integrally formed.

The restraining unit 2400 may include the link 2420.

The link 2420 may be rotatably coupled to the holder 2430.

The link 2420 may include a hook 2421 that is detachably coupled to a fastening groove 2441 provided on the front panel 11. The hook 2421 may be formed on one end of the link 2420 that faces rearward in the front and rear direction M (see FIG. 8) of the casing 10.

The link 2420 may further include a press portion 2422. The press portion 2422 may be formed on the other end of the link 2420 that faces forward in the front and rear direction M (see FIG. 8) of the casing 10. The press portion 2422 may be pressed by the pressure member 2450.

The link 2420 may further include a connection portion 2423 that connects the hook 2421 and the press portion 2422. On the connection portion 2423, an axial through-hole 2424 may be formed.

The restraining unit 2400 may further include the holder 2430.

The holder 2430 may be provided inside the door 2100.

The holder 2430 may include a fixing portion 2431 that is fixedly coupled to the door 2100. The fixing portion 2431 and the door 2100 may be coupled to each other by a fixing member (not shown). The fixing portion 2431 may extend toward a lateral side on a front surface 2432 of the holder 2430.

The holder 2430 may further include a support 2433. The support 2433 may extend from the holder 2430 so as to face the hook 2421 in the vertical direction N (see FIG. 8) of the casing 10. Specifically, the support 2433 may extend toward the rear side on the front surface 2432 of the holder 2430 that faces forward.

The holder 2430 may further include a link insertion portion 2434 into which the link 2420 is inserted. Specifically, the holder 2430 may further include the link insertion portion 2434 into which the hook 2421 of the link 2420 is inserted. When the link 2420 is inserted into the link insertion portion 2434, the support 2433 and the hook 2421 of the link 2420 may face each other in the vertical direction N (see FIG. 8) of the casing 10. A second elastic member 2470 may be provided between the support 2433 and the hook 2421 of the link 2420. The second elastic member 2470 may be coupled to at least one of the support 2433 and the hook 2421 of the link 2420. The hook 2421 may be detachably coupled to the fastening groove 2441 by a restoring force of the second elastic member 2470.

The holder 2430 may further include a coupling groove 2435. The coupling groove 2435 may be formed inside a coupling frame 2436. The coupling frame 2436 may have a shape that protrudes forward on the front surface 2432 of the holder 2430. On the coupling groove 2435, the press portion 2422 of the link 2420 may be rotatably disposed in the vertical direction N of the casing 10.

The holder 2430 may further include an axial coupling hole 2437. The axial coupling hole 2437 may be formed on the coupling frame 2436 of the holder 2430. By way of example, the axial coupling hole 2437 may be formed on the coupling frame 2436 so as to be positioned in a lower portion of the coupling groove 2435 in the vertical direction N (see FIG. 8) of the casing 10.

The link 2420 may be rotatably coupled to the holder 2430 in the vertical direction N (see FIG. 8) of the casing 10. Specifically, the link 2420 may be coupled to the holder 2430 to be rotatable in the vertical direction N (see FIG. 8) of the casing 10 about a rotational axis 2480 that connects the link 2420 and the holder 2430. The rotational axis 2480 connects the holder 2430 and the link 2420 while passing through the axial coupling hole 2437 of the holder 2430 and the axial through-hole 2424 of the link 2420.

The restraining unit 2400 may further include a support member 2490. The support member 2490 may be provided inside the door 2100. The fixing portion 2431 of the holder 2430 may be coupled to the support member 2490. On the support member 2490, the coupling groove 2435 of the holder 2430 and an insertion hole 2491 into which the press portion 2422 of the link 2420 is inserted may be provided.

The restraining unit 2400 may further include the fastening groove 2441 that is provided on the front panel 11 so as to adjust whether to open and close the door 2100 with respect to the cooking chamber 16. Specifically, the fastening groove 2441 may be formed inside a restraining member 2440 that is fixed to the front panel 11. The hook 2421 of the link 2420 may be detachably coupled to the fastening groove 2441 of the hook 2421.

The restraining unit 2400 may further include the rotational axis 2480 that connects the holder 2430 and the link 2420 while passing through the holder 2430 and the link 2420. The link 2420 may be moved about the rotational axis 2480 in the vertical direction N (see FIG. 8) of the casing 10.

The restraining unit 2400 may further include the pressure member 2450.

The pressure member 2450 may be provided inside the door 2100. The pressure member 2450 may be provided inside the door 2100 so as to be moved in the vertical direction N (see FIG. 8) of the casing 10.

The pressure member 2450 may be positioned on a front side of the support frame 2410 in the front and rear direction M (see FIG. 8) of the casing 10. The pressure member 2450 may be coupled to the support frame 2410 so as to be moved in the vertical direction N (see FIG. 8) of the casing 10.

The pressure member 2450 may be provided in the support frame 2410 so as to be positioned in an upper portion of the rod 2330 that is moved along the bottom surface 2410*a* of the support frame 2410 in the vertical direction N (see FIG. 8) of the casing 10.

The pressure member 2450 may include a frame 2451 that forms an appearance.

The frame 2451 of the pressure member 2450 may include a first wall 2452 that faces the support surface 2410*b* of the support frame 2410. A first elastic member 2460 may be provided between the pressure member 2450 and the support frame 2410. Specifically, the first elastic member 2460 may be provided between the first wall 2452 of the pressure member 2450 and the support surface 2410*b* of the support frame 2410. The first elastic member 2460 may be coupled to at least one of the first wall 2452 and the support surface 2410*b*.

The frame 2451 of the pressure member 2450 may further include a second wall 2453 that faces the rod 2330. The second wall 2453 may face the second end 2332 of the rod 2330. In other words, the second wall 2453 may face the plurality of rollers 2340. On the second wall 2453, irregularities may be formed. In other words, on the second wall 2453, a plurality of legs 2454 and 2455 may be formed. The plurality of legs 2454 and 2455 may have a shape that protrudes from the second wall 2453 toward the plurality of rollers 2340. That is, the plurality of legs 2454 and 2455 may have a shape that protrudes toward the bottom surface 2410*a* of the support frame 2410. A latch portion 2456 may be provided between the plurality of legs 2454 and 2455. By way of example, the plurality of legs 2454 and 2455 may include a first leg 2454 and a second leg 2455. The second leg 2455 may be formed on the second wall 2453 so as to be adjacent to the lever 2310 rather than the first leg 2454. The number of the plurality of legs 2454 and 2455 is not limited to 2, and may be variously changed.

On the second wall 2453, a movement guide 2453*a* may be formed. The movement guide 2453*a* may be formed on one surface of the second wall 2453 that faces the plurality of rollers 2340. In other words, the movement guide 2453*a* may be formed on the plurality of legs 2454 and 2455 facing the plurality of rollers 2340 and one surface of the latch portion 2456. The plurality of rollers 2340 may be rotated along the movement guide 2453*a*. The plurality of rollers 2340 may be rotated while being fitted into the movement guide 2453*a*. A rail unit 2411 formed on the bottom surface 2410*a* of the support frame 2410 and the movement guide 2453*a* formed on the second wall 2453 may guide the movement of the rod 2330. Specifically, the rail unit 2411 and the movement guide 2453*a* may guide the movement of the second end 2332 of the rod 2330.

The frame 2451 of the pressure member 2450 may include a third wall 2457 and a fourth wall 2458 between the first wall 2452 and the second wall 2453. The third wall 2457 may be provided between the first wall 2452 and the second wall 2453 so as to be adjacent to the lever 2310 rather than the fourth wall 2458.

The first wall 2452, the second wall 2453, the third wall 2457, and the fourth wall 2458 may be integrally formed.

The pressure member 2450 may further include a hollow portion 2451*a* formed inside the frame 2451. A part of the holder 2430 and the link 2420 passing through the insertion hole 2412 of the support frame 2410 may be inserted into the hollow portion 2451*a*. Specifically, the coupling frame 2436 of the holder 2430 and the press portion 2422 of the link 2420 which have passed through the insertion hole 2412 of the support frame 2410 may be inserted into the hollow portion 2451*a*.

The pressure member 2450 may further include a push portion 2459. The push portion 2459 may be formed in the frame 2451 so as to press the press portion 2422 of the link 2420. Specifically, the push portion 2459 may be formed on the first wall 2452 so as to protrude toward the hollow portion 2451*a*. The push portion 2459 may press the press portion 2422 of the link 2420, and then may be coupled to the coupling groove 2435 of the holder 2430.

The oven 2000 may further include a guide rail 2500. The guide rail 2500 may be provided inside the individual door 2200. The guide rail 2500 may be provided in the individual door 2200 so as to guide the movement of the rod 2330. Specifically, the guide rail 2500 may be provided in the individual door 2200 so as to guide the movement of the first end 2331 of the rod 2330.

When the lever 2310 is moved in the first direction P, the rod 2330 may be moved in the first direction P integrally with the lever 2310. The rod 2330 may be moved in the first direction P along the guide rail 2500 and the rail unit 2411 formed on the bottom surface 2410*a* of the support frame 2410. In this instance, the plurality of legs 2454 and 2455 of the pressure member 2450 may face rollers 2431 and 2342 positioned on an upper side in the vertical direction N (see FIG. 8) of the casing 10 among the plurality of rollers 2340. Specifically, the first leg 2454 may face the first roller 2341, and the second leg 2455 may face the second roller 2342. In other words, the first leg 2454 may be positioned on the first roller 2341, and the second leg 2455 may be positioned on the second roller 2342. The latch portion 2456 may be positioned on the plurality of rollers 2340 in the vertical direction N (see FIG. 8) of the casing 10. That is, the latch portion 2456 may be spaced apart from the plurality of rollers 2340 in the vertical direction N (see FIG. 8) of the casing 10. When the plurality of legs 2454 and 2455 are positioned on the plurality of rollers 2340 in the vertical direction N (see FIG. 8) of the casing 10, the pressure member 2450 may be moved toward the upper side of the casing 10. In this instance, the first elastic member 2460 may be retracted. In addition, the push portion 2459 of the pressure member 2450 is spaced apart from the press portion 2422 of the link 2420. When the pressure member 2450 is moved toward the upper side of the casing 10, the hook 2421 of the link 2420 may remain in a state in which the hook 2421 is coupled to the fastening groove 2441 of the restraining member 2440 by a restoring force of the second elastic member 2470. In this state, when a user pulls the handle 9 toward the front side of the casing 10, the individual door 2200 becomes rotatable separately from the door 2100. On the other hand, the door 2100 may remain in a state in which the door 2100 is restrained to the casing 10, that is, the front panel 11 separately from the individual door 2200.

When the lever 2310 is moved in the second direction Q, the rod 2330 may be moved in the second direction Q integrally with the lever 2310. The rod 2330 may be moved in the second direction Q along the guide rail 2500 and the rail unit 2411 formed on the bottom surface 2410*a* of the support frame 2410. In this instance, one of the plurality of legs 2454 and 2455 of the pressure member 2450 may face the roller 2340 positioned downward in the vertical direction N (see FIG. 8) of the casing 10 among the plurality of rollers 2340. Specifically, the second leg 2455 may face the third roller 2343. The first leg 2454 may be spaced apart from the plurality of rollers 2340 to face the bottom surface 2410*a* of the support frame 2410. In other words, the latch portion 2456 of the pressure member 2450 may face the first roller 2341. Specifically, the latch portion 2456 of the pressure member 2450 may be positioned on the first roller 2341. The second leg 2455 may be positioned between the first roller 2341 and the second roller 2342. That is, the second leg 2455 may be positioned on the third roller 2343. In this instance, the pressure member 2450 may be moved toward the lower side of the casing 10 by a restoring force of the first elastic member 2460. In addition, the push portion 2459 of the pressure member 2450 may be coupled to the coupling groove 2435 while pressing the press portion 2422 of the link 2420. When the push portion 2459 of the pressure member 2450 presses the press portion 2422 of the link 2420, the link 2420 is rotated about the rotational axis 2480, and the second elastic member 2470 is retracted. In this instance, the hook 2421 of the link 2420 is separated from the fastening groove 2441 of the restraining member 2440. In this state, when a user pulls the handle 9 toward the front side of the casing 10, the door 2100 becomes rotatable from the front panel 11. In other words, the locked state of the door 2100 is released. When the locked state of the door 2100 with respect to the front panel 11 is released, the individual door 2200 may be moved integrally with the door 2100.

Figure 26:
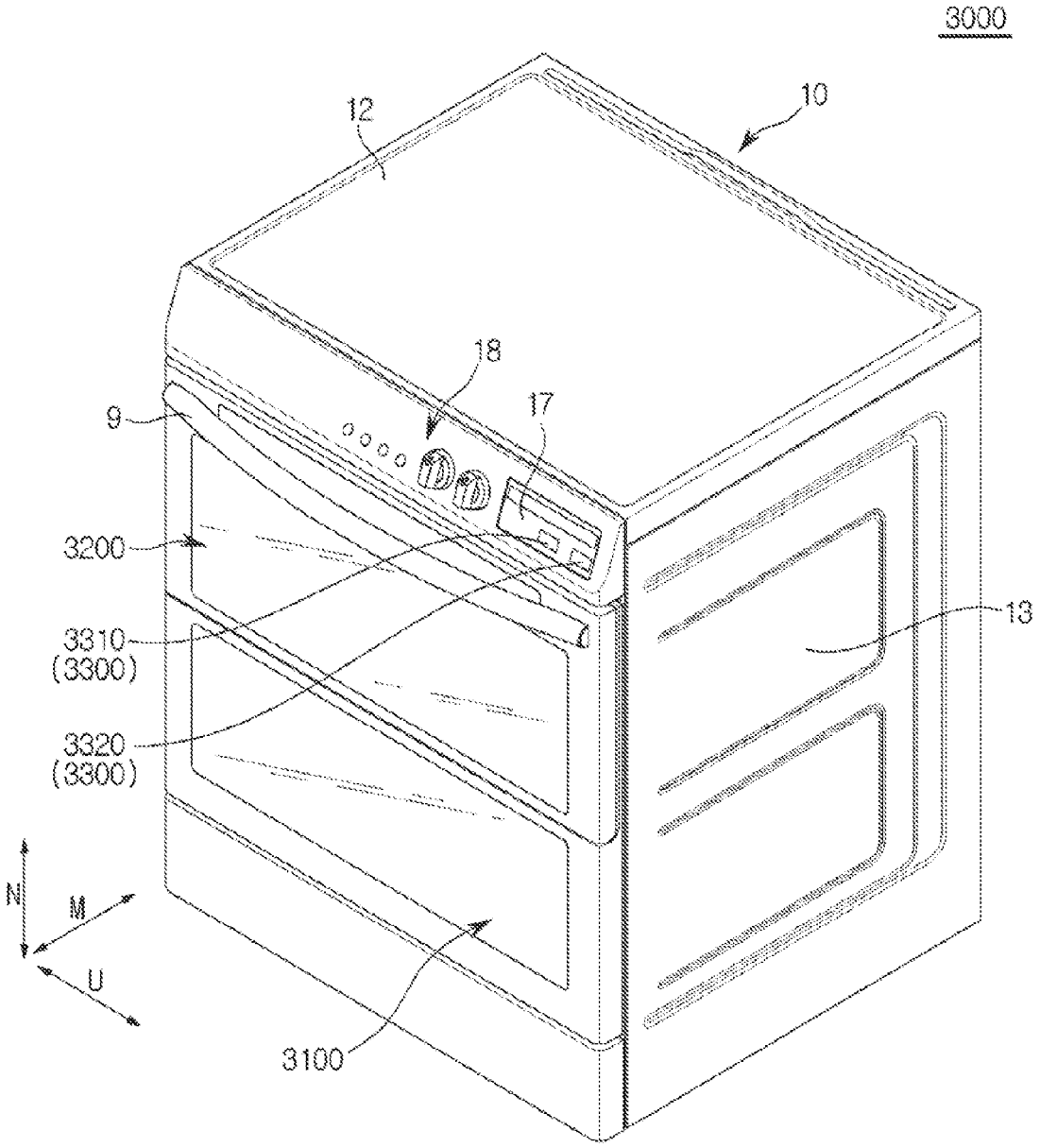
FIG. 26 illustrates an appearance of an oven in accordance with a fifth embodiment of the disclosure.
Figure 27:
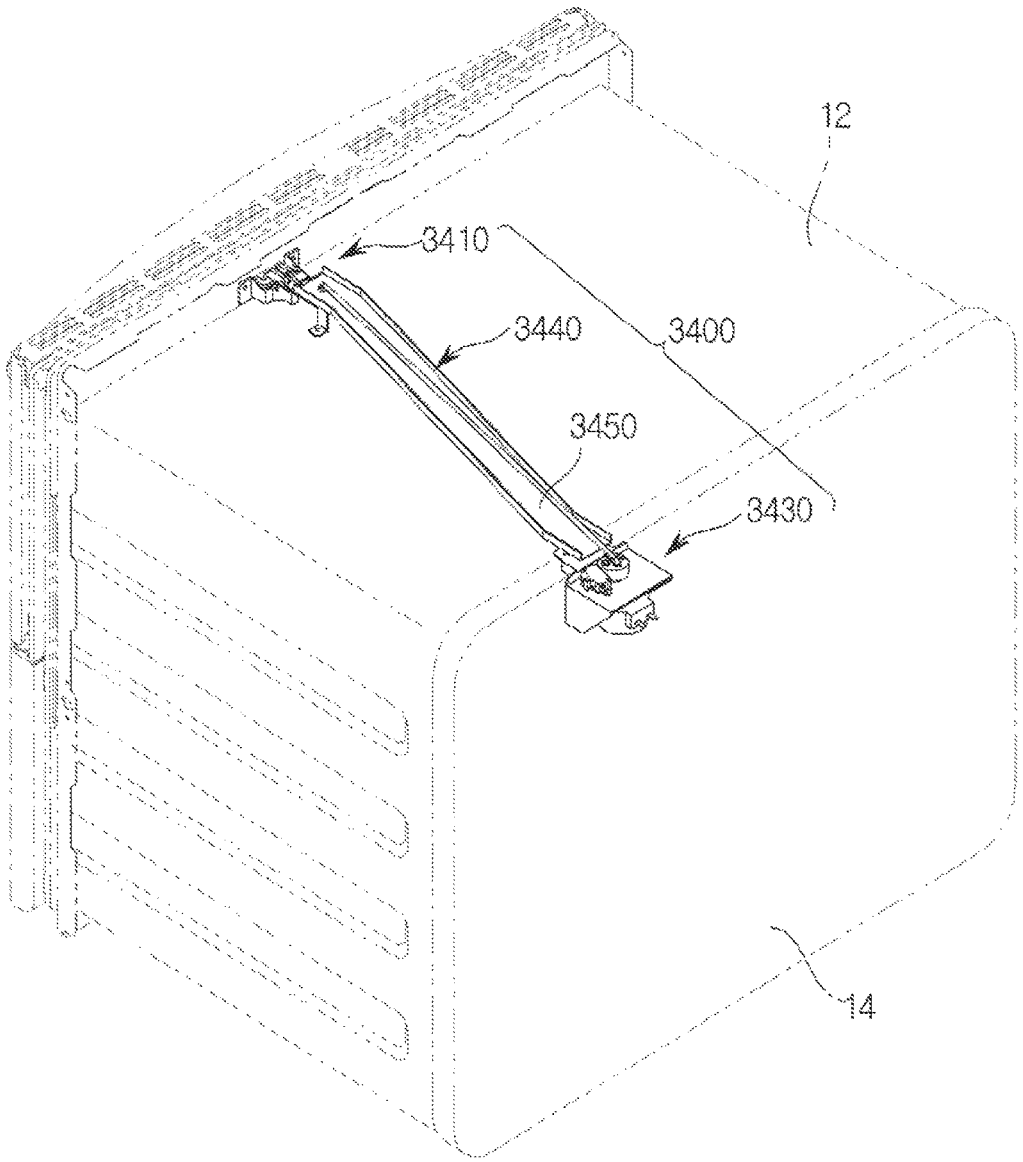
FIG. 27 illustrates an installation structure of a locking unit of an oven in accordance with a fifth embodiment of the disclosure.
Figure 28:
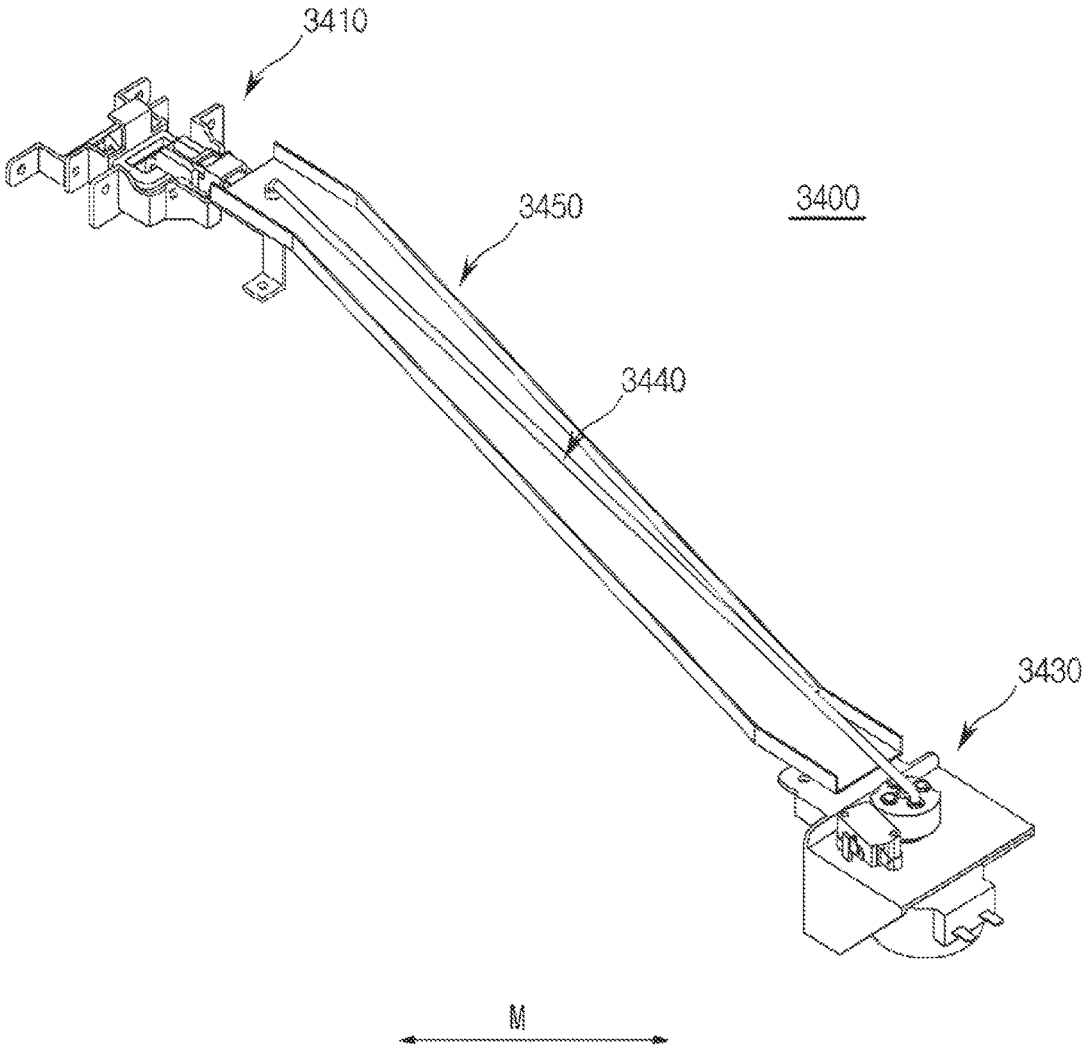
FIG. 28 illustrates a locking unit of an oven in accordance with a fifth embodiment of the disclosure.
Figure 29:
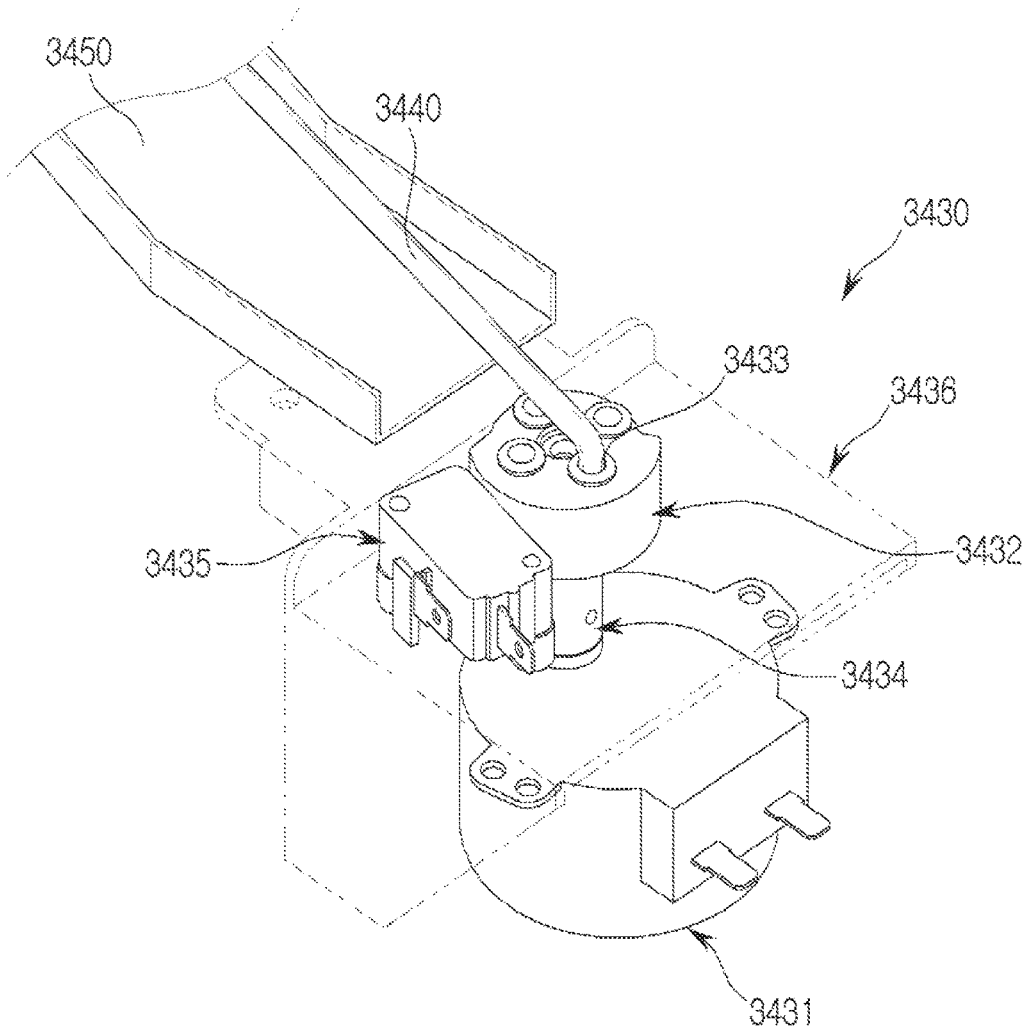
FIG. 29 is an enlarged view showing a driving unit of a locking unit of an oven in accordance with a fifth embodiment of the disclosure.
Figure 30:
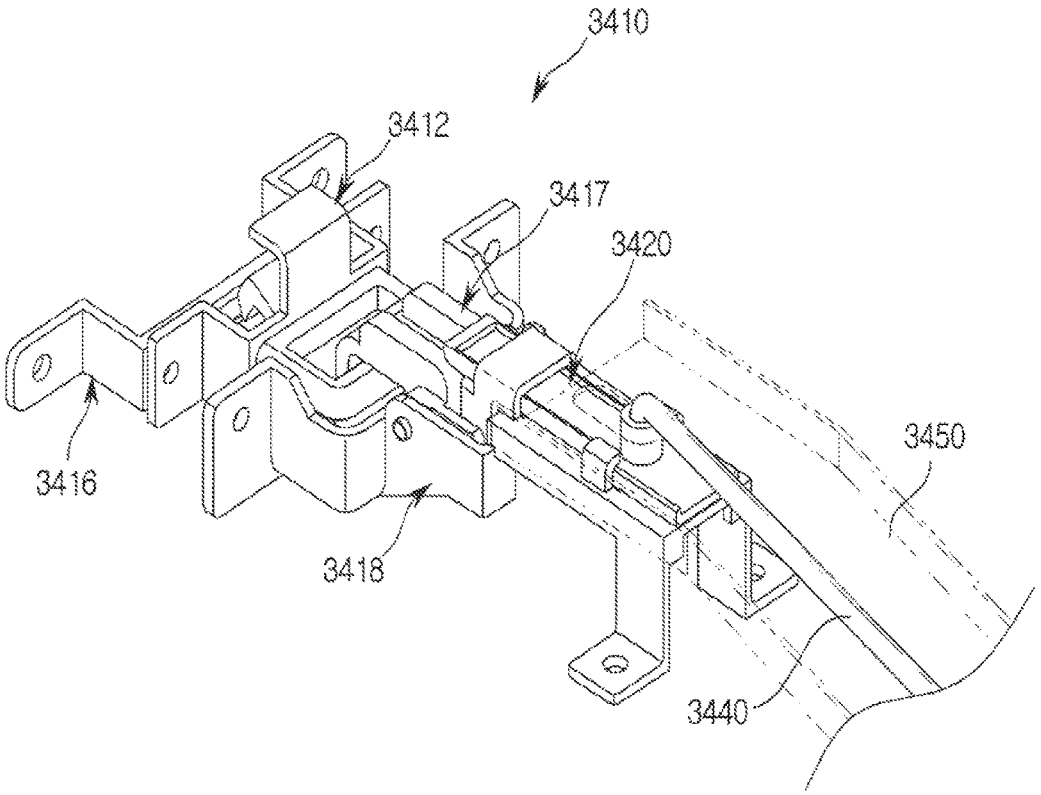
FIG. 30 is an enlarged view showing a restraining unit of a locking unit of an oven in accordance with a fifth embodiment of the disclosure.
Figure 31:
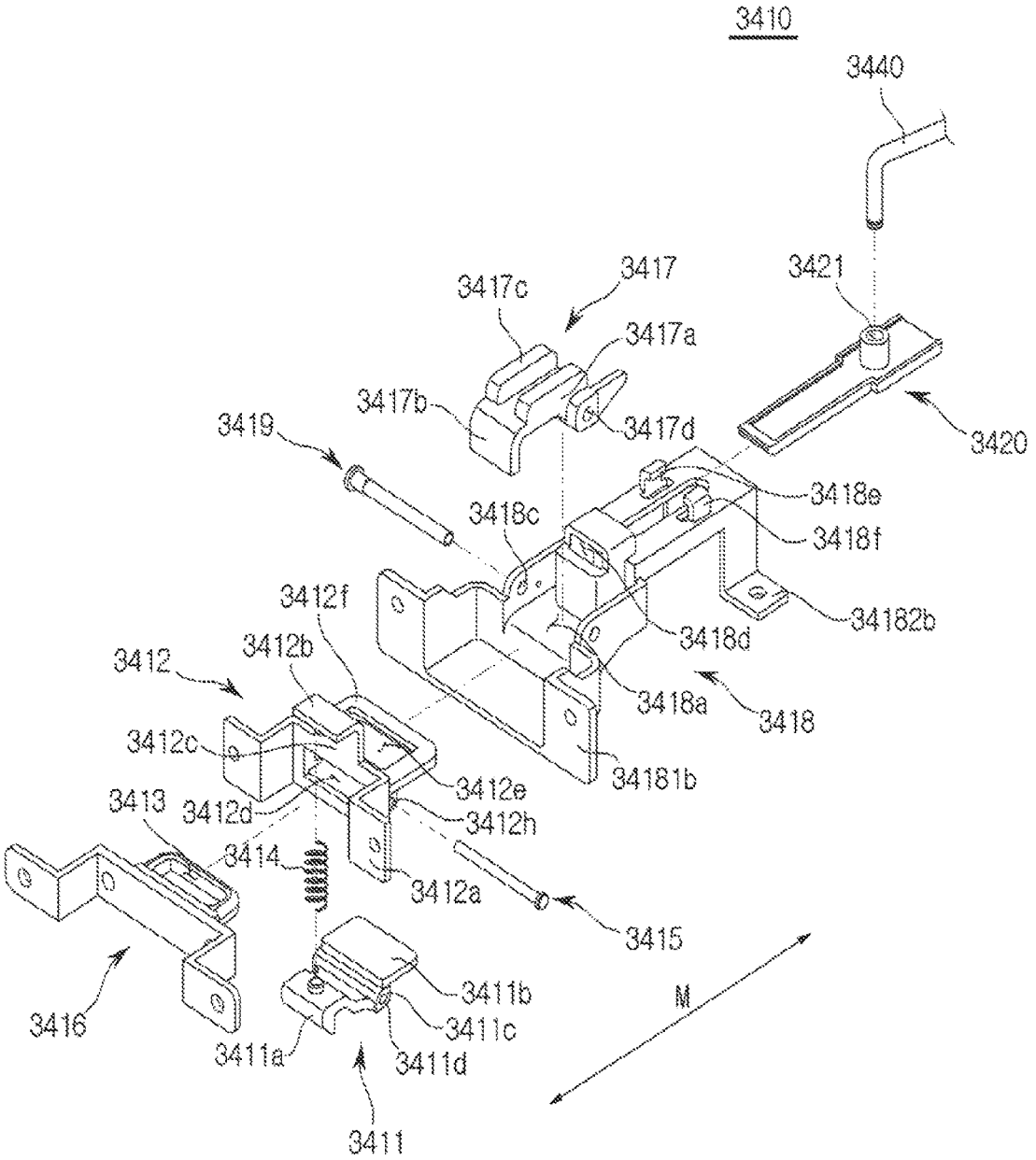
FIG. 31 is an exploded perspective view showing a restraining unit of a locking unit of an oven in accordance with a fifth embodiment of the disclosure.

FIG. 26 illustrates an appearance of an oven in accordance with a fifth embodiment of the disclosure, FIG. 27 illustrates an installation structure of a locking unit of an oven in accordance with a fifth embodiment of the disclosure, FIG. 28 illustrates a locking unit of an oven in accordance with a fifth embodiment of the disclosure, FIG. 29 is an enlarged view showing a driving unit of a locking unit of an oven in accordance with a fifth embodiment of the disclosure, FIG. 30 is an enlarged view showing a restraining unit of a locking unit of an oven in accordance with a fifth embodiment of the disclosure, and FIG. 31 is an exploded perspective view showing a restraining unit of a locking unit of an oven in accordance with a fifth embodiment of the disclosure. Hereinafter, a first door may be used to indicate an individual door 3200, and a second door may be used to indicate a door 3100. Hereinafter, repeated description with respect to the description in reference to FIGS. 1 to 4 will be omitted. Reference numerals which are not shown may be referred to those in FIGS. 1 to 4.

As illustrated in FIGS. 26 to 31, an oven 3000 may further include the door 3100 that is provided in the casing 10 so as to open and close the cooking chamber 16. The door 3100 may be rotatably disposed in the casing 10. The door 3100 may be rotatably provided on the front surface of the casing 10. That is, the door 3100 may be rotatably provided in the front panel 11.

The door 3100 may have the same structure as that which has been described in FIGS. 8 to 13, but the disclosure is not limited thereto. However, for ease of description, it is assumed that the door 3100 has the same structure as that which has been described in FIGS. 8 to 13.

The oven 3000 may further include the individual door 3200 that is rotatable separately from the door 3100 so as to open and close a part of the cooking chamber 16. The individual door 3200 may be provided in the door 3100.

The individual door 3200 may have the same structure as that which has been described in FIGS. 8 to 13, but the disclosure is not limited thereto. However, for ease of description, it is assumed that the individual door 3200 has the same structure as that which has been described in FIGS. 8 to 13.

The oven 3000 may further include a touch portion 3300 that is provided in the display 17 so as to selectively adjust rotation of the door 3100 and the individual door 3200.

The touch portion 3300 may include a first touch portion 3310 that inputs an instruction to open the individual door 3200 and a second touch portion 3320 that inputs an instruction to open the door 3100.

The oven 3000 may further include a locking unit 3400 that is provided so that the individual door 3200 is moved integrally with or separately from the door 3100 in accordance with manipulation of the touch portion 3300.

The locking unit 3400 may be provided between the cooking chamber 16 and the casing 10. By way of example, the locking unit 3400 may be provided between the cooking chamber 16 and the top panel 12.

The locking unit 3400 may further include a restraining unit 3410.

The restraining unit 3410 may further include a link 3411.

The link 3411 may be rotatably coupled to the holder 3412. In other words, the link 3411 may be coupled to the holder 3412 so as to be moved in the vertical direction N of the casing 10.

The link 3411 may include a hook 3411*a* that is detachably coupled to a fastening groove 3413 provided in the individual door 3200. The hook 3411*a* may be formed on one end of the link 3411 that faces forward in the front and rear direction M of the casing 10.

The link 3411 may further include a press portion 3411*b*. The press portion 3411*b* may be formed on the other end of the link 3411 that faces rearward in the front and rear direction M of the casing 10. The press portion 3411*b* may be pressurized by a pressure member 3417.

The link 3411 may further include a connection portion 3411*c* that connects the hook 3411*a* and the press portion 3411*b*. On the connection portion 3411*c*, an axial through-hole 3411*d* may be formed.

The restraining unit 3410 may further include a holder 3412.

The holder 3412 may include a fixing portion 3412*a* that is fixedly coupled to the door 3100. The fixing portion 3412*a* and the door 3100 may be coupled to each other by a fixing member (not shown). The fixing portion 3412*a* may extend to a lateral side from a front surface 3412*c* of the holder 3412 that faces forward.

The holder 3412 may further include a support 3412*b*. The support 3412*b* may extend from the holder 3412 so as to face the hook 3411*a* in the vertical direction N of the casing 10. Specifically, the support 3412*b* may extend forward from the front surface 3412*c* of the holder 3412 that faces forward.

The holder 3412 may further include a link insertion portion 3412*d* into which the link 3411 is inserted. When the link 3411 is inserted into the link insertion portion 3412*d*, the support 3412*b* and the hook 3411*a* of the link 3411 may face each other in the vertical direction N of the casing 10. An elastic member 3414 may be provided between the support 3412*b* and the hook 3411*a* of the link 3411. The elastic member 3414 may be coupled to at least one of the support 3412*b* and the hook 3411*a* of the link 3411. The hook 3411*a* may be detachably coupled to the fastening groove 3413 by a restoring force of the elastic member 3414.

The holder 3412 may further include a coupling groove 3412*e*. The coupling groove 3412*e* may be formed inside a coupling frame 3412*f*. The coupling frame 3412*f* may have a shape that protrudes to a rear side from a rear surface 3412*g* of the holder 3412. In the coupling groove 3412*e*, the press portion 3411*b* of the link 3411 may be rotatably disposed in the vertical direction N of the casing 10.

The holder 3412 may further include an axial coupling hole 3412*h*. The axial coupling hole 3412*h* may be formed in the coupling frame 3412*f* of the holder 3412. By way of example, the axial coupling hole 3412*h* may be formed in the coupling frame 3412*f* so as to be positioned below the coupling groove 3412*e* in the vertical direction N of the casing 10.

The link 3411 may be rotatably coupled to the holder 3412 in the vertical direction N of the casing 10. Specifically, the link 3411 may be coupled to the holder 3412 so as to be rotatable in the vertical direction N of the casing 10 about a link rotational axis 3415 that connects the link 3411 and the holder 3412. The link rotational axis 3415 may connect the holder 3412 and the link 3411 while passing through the axial coupling hole 3412*h* of the holder 3412 and the axial through-hole 3411*d* of the link 3411.

The restraining unit 3410 may further include the fastening groove 3413 that is provided in the individual door 3200. Specifically, the fastening groove 3413 may be formed inside a restraining member 3416 that is fixed to the individual door 3200. The hook 3411*a* of the link 3411 may be detachably coupled to the fastening groove 3413.

The restraining unit 3410 may further include a link rotational axis 3415 that connects the holder 3412 and the link 3411 while passing through the holder 3412 and the link 3411. The link 3411 may be moved about the link rotational axis 3415 in the vertical direction N of the casing.

The restraining unit 3410 may further include a pressure member 3417.

The pressure member 3417 may be provided inside the casing 10. The pressure member 3417 may be provided inside the casing 10 so as to be moved in the vertical direction N of the casing 10.

The pressure member 3417 may be positioned in a pressure member seating portion 3418*a* formed in the support frame 3418. The pressure member 3417 may be provided in the pressure member seating portion 3418*a* to be rotatable in the vertical direction N of the casing 10.

The pressure member 3417 may include a body 3417*a* and a latch portion 3417*b*.

The latch portion 3417*b* may extend from the body 3417*a* to face the front side of the casing 10. The latch portion 3417*b* may be detachably coupled to the coupling groove 3412*e* of the holder 3412. The latch portion 3417*b* may have a hook shape so as to be fastened to the coupling groove 3412*e* of the holder 3412, but the shape of the latch portion 3417*b* is not limited thereto.

The pressure member 3417 may further include a pressure surface 3417*c*. The pressure surface 3417*c* may be formed on a top surface of the body 3417*a*, but it not limited thereto. The pressure surface 3417*c* may be selectively pressurized by a push lever 3420. When the pressure surface 3417*c* is pressurized, the latch portion 3417*b* may be coupled to the coupling groove 3412*e* of the holder 3412 while pressing the press portion 3411*b* of the link 3411.

A through-hole 3417*d* may be formed in the body 3417*a* of the pressure member 3417.

The restraining unit 3410 may further include a support frame 3418.

The support frame 3418 may be provided inside the casing 10. Specifically, the support frame 3418 may be fixedly coupled to the front panel 11. The support frame 3418 may be positioned on a rear side of the holder 3412 and the link 3411 in the front and rear direction M of the casing 10.

The support frame 3418 may include a frame fixing portion 3418*b*. Specifically, the frame fixing portion 3418*b* may include a first frame fixing portion 34181*b* that is fixed to the front panel 11, and a second frame fixing portion 34182*b* that is fixed to the top panel 12 of the casing 10.

The support frame 3418 may further include the pressure member seating portion 3418*a* that is formed inside the support frame 3418. In the pressure member seating portion 3418*a*, the pressure member 3417 may be positioned to be rotatable. In both side surfaces of the support frame 3418 corresponding to the pressure member seating portion 3418*a*, a fastening hole 3418*c* may be formed. A pressure member rotational axis 3419 may be coupled to a fastening hole 3418*c* and the through-hole 3417*d* of the pressure member 3417.

The support frame 3418 may further include a push lever insertion groove 3418*d*. The push lever insertion groove 3418*d* may be provided on a rear side of the pressure member seating portion 3418*a* in the front and rear direction M of the casing 10. A push lever 3420 may be coupled to the push lever insertion groove 3418*d* so that the push lever 3420 can pass through the push lever insertion groove 3418*d*. The push lever 3420 that has coupled to the push lever insertion groove 3418*d* may selectively pressurize the pressure surface 3417*c* of the pressure member 3417.

The support frame 3418 may further include guides 3418*e* and 3418*f* that guide the movement of the push lever 3420. The guides 3418*e* and 3418*f* may include first and second guides 3418*e* and 3418*f* which are coupled to both sides of the push lever 3420 and disposed to guide the movement of the push lever 3420. The first and second guides 3418*e* and 3418*f* are disposed so as to be spaced apart from each other. The push lever 3420 may be moved in the front and rear direction M of the casing 10 while being restrained to the guides 3418*e* and 3418*f* and the push lever insertion groove 3418*d*.

The restraining unit 3410 may further include a pressure member rotational axis 3419 that connects the support frame 3418 and the pressure member 3417 while passing through the support frame 3418 and the pressure member 3417. The pressure member 3417 may be moved about the pressure member rotational axis 3419 in the vertical direction N of the casing 10.

The restraining unit 3410 may further include the push lever 3420.

The push lever 3420 may be coupled to the support frame 3418 to be slidable in the front and rear direction M of the casing 10. The push lever 3420 may be provided in the support frame 3418 so as to selectively pressurize the pressure surface 3417*c* of the pressure member 3417. In the push lever 3420, a rod coupling portion 3421 to which a rod 3440 is coupled may be formed. Thus, the push lever 3420 may be moved integrally with the rod 3440.

The locking unit 3400 may further include a driving unit 3430. That is, the locking unit 3400 may further include the driving unit 3430 so as to open and close the individual door 3200 integrally with or separately from the door 3100 through electric driving of the driving unit 3430. The driving unit 3430 may be positioned on a rear side of the restraining unit 3410 in the front and rear direction M of the casing 10. The driving unit 3430 may be provided on the rear panel 14, but is not limited thereto.

The driving unit 3430 may include one or more motors 3431. The one or more motors 3431 provide a driving force so that a cam 3432 can be rotated. The one or more motors 3431 may include various kinds of motors such as an AC motor, a DC motor, a BLDC motor, and the like.

The driving unit 3430 may further include the cam 3432 that achieves a rotary motion. The cam 3432 may achieve the rotary motion by receiving the driving force from the one or more motors 3431. In the cam 3432, a rod coupling hole 3433 to which one end of the rod 3440 facing the rear side of the casing 10 is coupled may be provided. The cam 3432 may be provided to be rotatable in one direction, but the disclosure is not limited thereto.

The driving unit 3430 may further include a cam shaft 3434. The cam shaft 3434 may be positioned between the cam 3432 and the one or more motors 3431 so as to connect the cam 3432 and the one or more motors 3431. The cam 3432 may be rotationally moved with respect to the cam shaft 3434.

The driving unit 3430 may further include a lever switch 3435. The lever switch 3435 may be disposed so as to be adjacent to the cam 3432. The lever switch 3435 may serve to detect whether the door 3100 or the individual door 3200 is in an openable state. That is, when the lever switch 3435 is turned on, this indicates that the door 3100 is in the openable state. When the lever switch 3435 is turned off, this indicates that the individual door 3200 is in the openable state.

The driving unit 3430 may further include a bracket 3436. The bracket 3436 may be positioned between the one or more motors 3431 and the cam 3432. Alternatively, the bracket 3436 may be positioned between the one or more motors 3431 and the lever switch 3435.

The locking unit 3400 may further include the rod 3440 that connects the restraining unit 3410 and the driving unit 3430. In other words, the locking unit 3400 may further include the rod 3440 that transmits the movement of the driving unit 3430 to the restraining unit 3410. The rod 3440 may be respectively connected to the restraining unit 3410 and the driving unit 3430. Specifically, the rod 3440 may be respectively coupled to the rod coupling portion 3421 of the push lever 3420 and the rod coupling hole 3433 of the cam 3432. The rod 3440 converts the rotary motion of the cam 3432 into a linear motion to transmit the linear motion to the restraining unit 3410, that is, the push lever 3420. When the rod coupling hole 3433 is moved toward the front side of the casing 10 while the cam 3432 is rotated, the rod 3440 is also moved toward the front side of the casing 10. In this instance, the push lever 3420 moved integrally with the rod 3440 pressurizes the pressure surface 3417*c* of the pressure member 3417 while sliding toward the front side of the casing 10. On the other hand, when the rod coupling hole 3433 is moved toward the rear side of the casing 10 while the cam 3432 is rotated, the rod 3440 is also moved toward the rear side of the casing 10. In this instance, the push lever 3420 moved integrally with the rod 3440 may not pressurize the pressure surface 3417*c* of the pressure member 3417 while sliding toward the rear side of the casing 10.

The locking unit 3400 may further include a case 3450 provided between the restraining unit 3410 and the driving unit 3430 so as to correspond to the rod 3440. The case 3450 may be positioned on a lower side of the rod 3440 in the vertical direction N of the casing 10.

Figure 32:
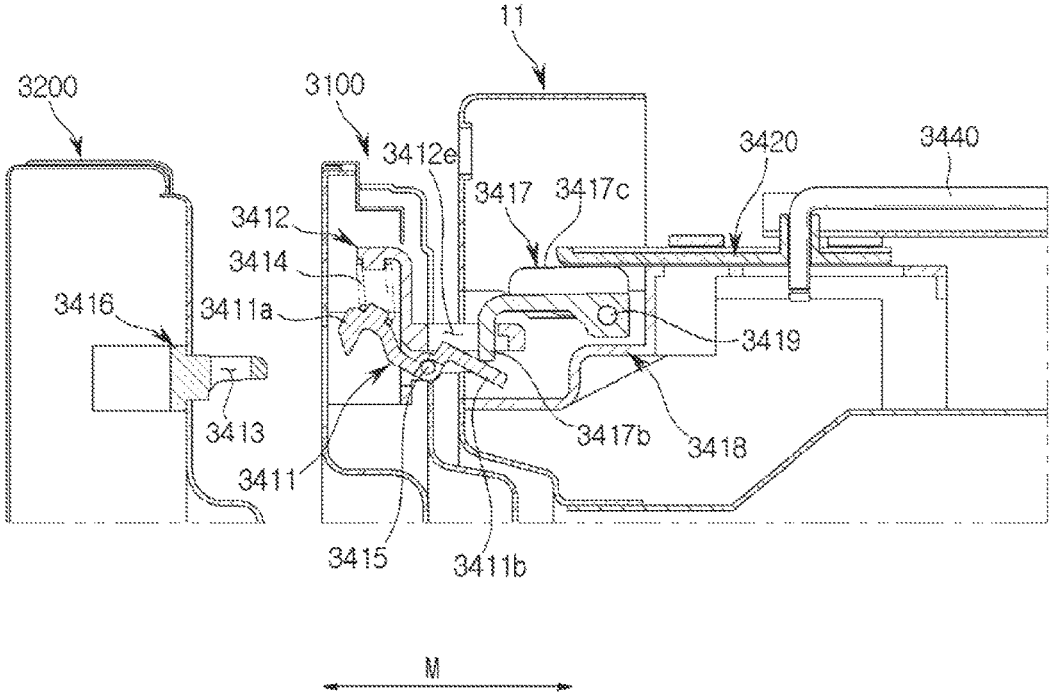
FIG. 32 illustrates a state in which a locking unit is operated when a first door of an oven in accordance with a fifth embodiment of the disclosure is opened.
Figure 33:
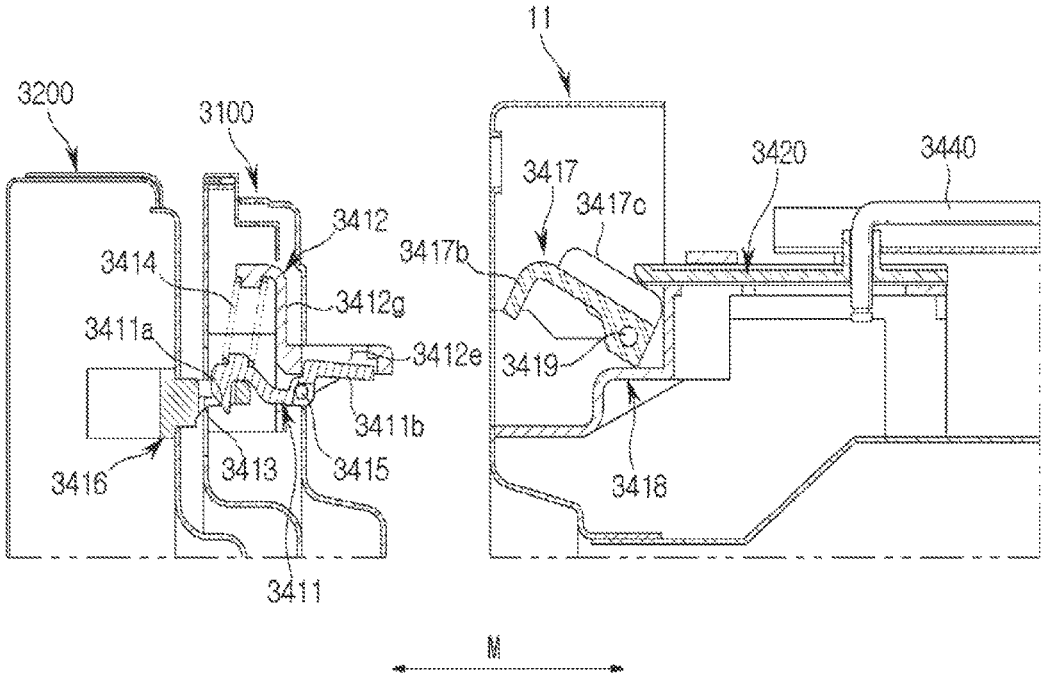
FIG. 33 illustrates a state in which a locking unit is operated when a second door of an oven in accordance with a fifth embodiment of the disclosure is opened.

FIG. 32 illustrates a state in which a locking unit is operated when a first door of an oven in accordance with a fifth embodiment of the disclosure is opened, and FIG. 33 illustrates a state in which a locking unit is operated when a second door of an oven in accordance with a fifth embodiment of the disclosure is opened. Hereinafter, a first door may be used to indicate an individual door 3200, and a second door may be used to indicate a door 3100. Hereinafter, repeated description with respect to the description in reference to FIGS. 1 to 4 will be omitted. In addition, reference numerals which are not shown may be referred to those in FIGS. 1 to 4 and FIGS. 26 to 31.

As illustrated in FIG. 32, when a user touches a first touch portion 3310, one or more motors 3431 are operated. As the one or more motors 3431 is operated, the cam shaft 3434 and the cam 3432 are rotated integrally with each other. The cam 3432 is rotated until the lever switch 3435 is turned off. When the rod coupling hole 3433 is moved toward the front side of the casing 10 as the cam 3432 is rotated, the rod 3440 is also moved toward the front side of the casing 10. In this instance, the push lever 3420 moved integrally with the rod 3440 pressurizes the pressure surface 3417*c* of the pressure member 3417 while sliding toward the front side of the casing 10. When the push lever 3420 pressurizes the pressure surface 3417*c* of the pressure member 3417, the latch portion 3417*b* of the pressure member 3417 is coupled to the coupling groove 3412*e* of the holder 3412 while pressurizing the press portion 3411*b* of the link 3411. In this instance, the link 3411 is rotated with respect to the link rotational axis 3415, and the hook 3411*a* of the link 3411 is separated from the fastening groove 3413 of the restraining member 3416. The elastic member 3414 is retracted while the hook 3411*a* of the link 3411 is rotated toward the upper side of the casing 10. Consequently, the door 3100 is restrained to the casing 10, that is, the front panel 11 by coupling between the latch portion 3417*b* of the pressure member 3417 and the coupling groove 3412*e* of the holder 3412. The individual door 3200 is rotatable separately from the door 3100 as the hook 3411*a* of the link 3411 is separated from the fastening groove 3413 of the restraining member 3416.

As illustrated in FIG. 33, when a user touches the second touch portion 3320, the one or more motors 3431 are operated. As the one or more motors 3431 is operated, the cam shaft 3434 and the cam 3432 are rotated integrally with each other. The cam 3432 is rotated until the lever switch 3435 is turned on. When the rod coupling hole 3433 is moved toward the rear side of the casing 10 as the cam 3432 is rotated, the rod 3440 is also moved toward the rear side of the casing 10. In this instance, the push lever 3420 moved integrally with the rod 3440. In this instance, the push lever 3420 moved integrally with the rod 3440 slides toward the rear side of the casing 10. That is, the push lever 3420 may not pressurize the pressure surface 3417*c* of the pressure member 3417 while moving toward the rear side of the casing 10 integrally with the rod 3440. The pressure member 3417 is separated from the coupling groove 3412*e* of the holder 3412 by a restoring force of an elastic member (not shown) provided in the pressure member seating portion 3418*a*. The elastic member (not shown) includes a torsion spring. In this instance, the hook 3411*a* of the link 3411 remains in a state in which the hook 3411*a* is coupled to the fastening groove 3413 of the restraining member 3416 by a restoring force of the elastic member 3414. Consequently, the door 3100 and the individual door 3200 may be restrained to each other by coupling between the fastening groove 3413 of the restraining member 3416 and the hook 3411*a* of the link 3411. That is, the door 3100 and the individual door 3200 are coupled to each other so as to be moved integrally with each other by coupling between the fastening groove 3413 and the hook 3411*a*. The individual door 3200 is in a state in which the individual door 3200 is detachable from the casing 10, that is, the front panel 11 as the latch portion 3417*b* of the pressure member 3417 is separated from the coupling groove 3412*e* of the holder 3412. When the door 3100 is opened, the individual door 3200 may be opened integrally with the door 3100.

Figure 34:
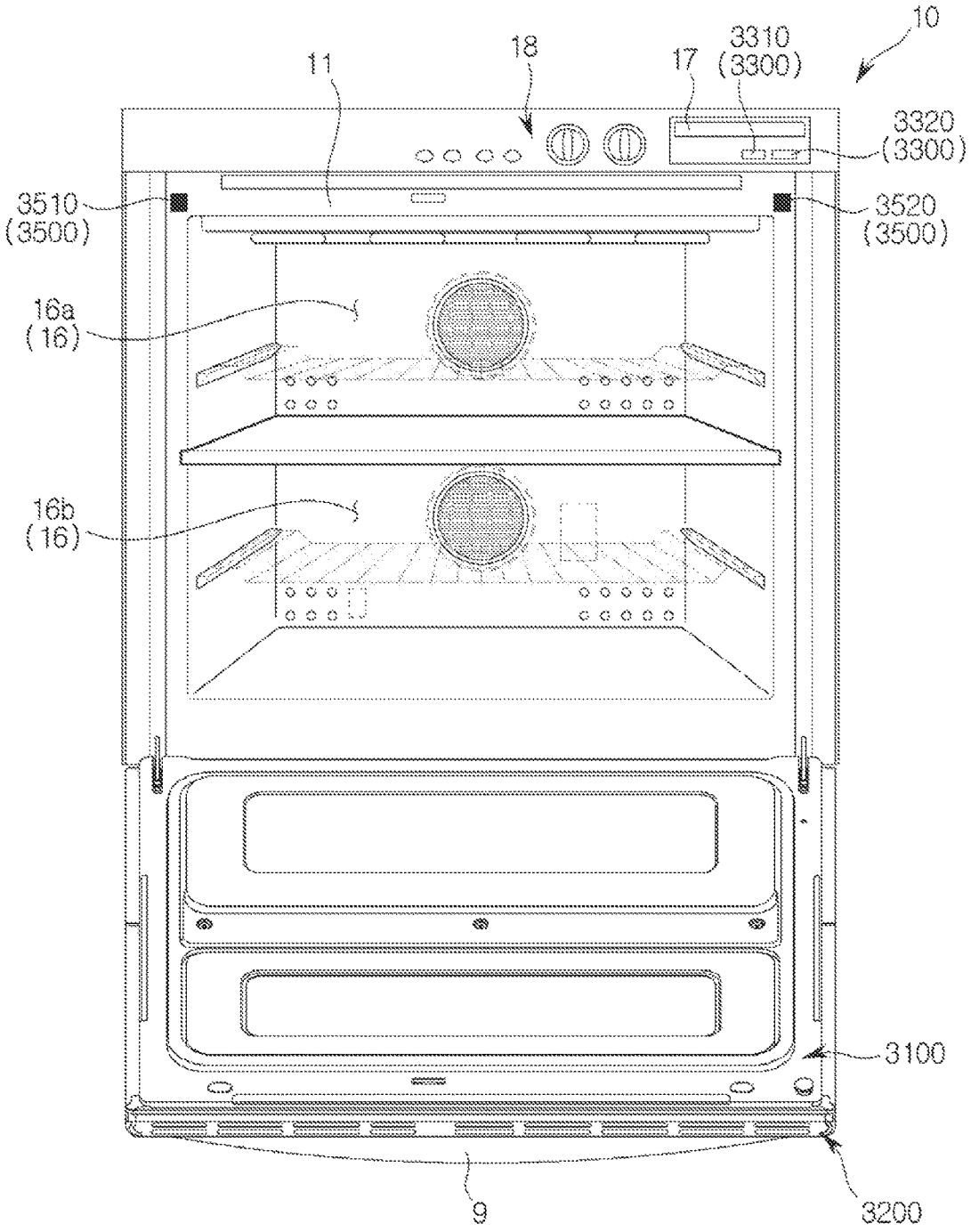
FIG. 34 illustrates a position of a sensor for detecting the opening and closing state of first and second doors of an oven in accordance with a fifth embodiment of the disclosure.

FIG. 34 illustrates a position of a sensor for detecting the opening and closing state of first and second doors of an oven in accordance with a fifth embodiment of the disclosure. Hereinafter, a first door may be used to indicate the individual door 3200, and a second door may be used to indicate the door 3100. Hereinafter, repeated description with respect to the description in reference to FIGS. 1 to 4 will be omitted. In addition, reference numerals which are not shown may be referred to those in FIGS. 26 to 31.

As illustrated in FIG. 34, the oven 3000 may further include one or more sensors 3500. The one or more sensors 3500 may include a first detection sensor 3510 that detects the opening and closing state of the door 3100 and a second detection sensor 3520 that detects the opening and closing state of the individual door 3200. The first detection sensor 3510 and the second detection sensor 3520 may be provided on the front panel 11. Specifically, the first detection sensor 3510 may be provided on the front panel 11 that faces the door 3100. The second detection sensor 3520 may be provided on the front panel 11 that faces the individual door 3200. On of the first detection sensor 3510 indicates an opened state of the door 3100. Off of the first detection sensor 3510 indicates a closed state of the door 3100. On of the second detection sensor 3520 indicates an opened state of the individual door 3200. Off of the second detection sensor 3520 indicates a closed state of the individual door 3200. The one or more sensors 3500 may include an optical sensor and a pressure sensor, but types of the one or more sensors 3500 are not limited thereto. The number and position of the one or more sensors 3500 are not limited thereto. By way of example, the opening and closing state of the door 3100 and the individual door 3200 may be detected by a single sensor.

The one or more sensors 3500 may further include a lever switch 3435. The lever switch 3435 may be disposed so as to be adjacent to the cam 3432. The lever switch 3435 may serve to detect whether the door 3100 or the individual door 3200 is in an opened state. That is, when the lever switch 3435 is turned on, this indicates that the door 3100 is in an opened state. When the lever switch 3435 is turned off, this indicates that the individual door 3200 is in an opened state.

Figure 35:
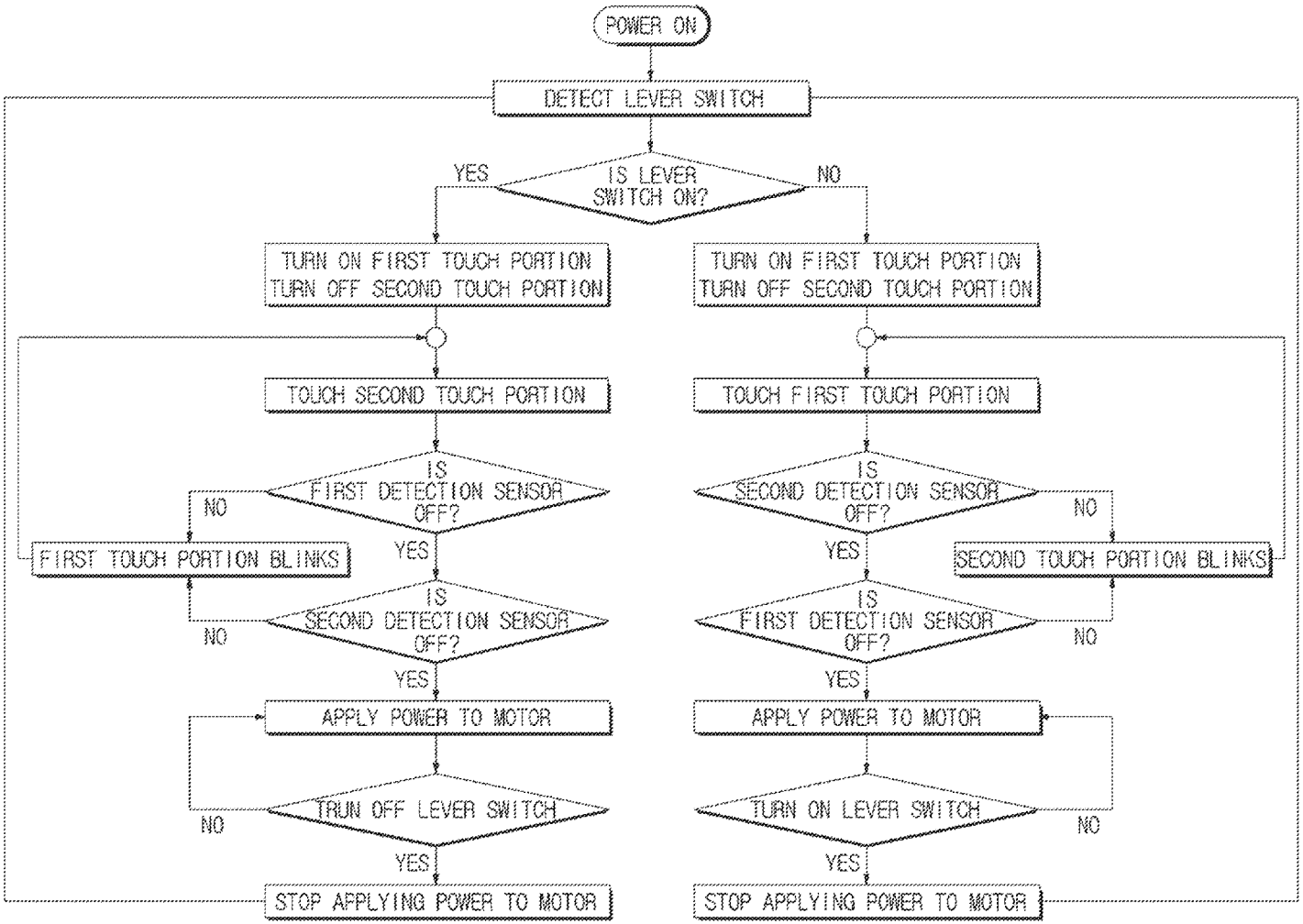
FIG. 35 is a flowchart showing a process of controlling opening and closing of a first door or a second door in an oven in accordance with a fifth embodiment of the disclosure.

FIG. 35 is a flowchart showing a process of controlling opening and closing of a first door or a second door in an oven in accordance with a fifth embodiment of the disclosure. Hereinafter, a first door may be used to indicate the individual door 3200, and a second door may be used to indicate the door 3100. In addition, reference numerals which are not shown may be referred to those in FIGS. 26 to 31 and FIG. 34.

Opening of the door 3100 or the individual door 3200 may be performed on the assumption that both the door 3100 and the individual door 3200 are all closed. In addition, when the door 3100 is opened, the individual door 3200 is separated from the casing 10, that is, the front panel 11, and therefore the first detection sensor for detecting the opening and closing state of the door 3100 and the second detection sensor for detecting the opening and closing state of the individual door 3200 are all turned on. On the other hand, the individual door 3200 may be rotated separately from the door 3100, and therefore, when only the individual door 3200 is opened, the first detection sensor 3510 for detecting the opening and closing state of the door 3100 may be turned off, and the second detection sensor 3520 for detecting the opening and closing state of the individual door 3200 may be turned on.

A process of opening the individual door 3200 is as follows.

As illustrated in FIG. 35, when the power of the oven 3000 is turned on, the lever switch 3435 detects whether the door 3100 or the individual door 3200 is in an opened state. When the lever switch 3435 is turned on, the door 3100 is in an opened state, and therefore the first touch portion 3310 that inputs an instruction to open the door 3100 blinks. In this instance, the individual door 3200 is in a closed state, and therefore the second touch portion 3320 that inputs an instruction to open the individual door 3200 does not blink. The second touch portion 3320 may be touched by a user in order to open the individual door 3200. In this instance, when the first detection sensor 3510 for detecting the opening and closing state of the door 3100 and the second detection sensor 3520 for detecting the opening and closing state of the individual door 3200 are all turned off, power is supplied to the one or more motors 3431. In other words, when the first detection sensor 3510 and the second detection sensor 3520 are all turned off, the door 3100 and the individual door 3200 are all in the closed state, and therefore the assumption that it is possible to open the individual door 3200 is satisfied. On the other hand, when the first detection sensor 3510 or the second detection sensor 3520 is turned on, the door 3100 still remains opened, and therefore the first touch portion 3310 that inputs the instruction to open the door 3100 continues to blink. The blinking of the first touch portion 3310 is stopped when the door 3100 is closed. When the assumption that it is possible to open the individual door 3200 is satisfied, the lever switch 3435 is turned off, and the operation of the one or more motors 3431 stops. In this instance, a user may open the individual door 3200 by pulling the handle 9.

A process of opening the door 3100 is as follows.

As illustrated in FIG. 35, when the power of the oven 3000 is turned on, the lever switch 3435 detects whether the door 3100 or the individual door 3200 is in an opened state. When the lever switch 3435 is turned off, the individual door 3200 is in an opened state, the second touch portion 3320 that inputs the instruction to open the individual door 3200 blinks. In this instance, the door 3100 is in the closed state, and therefore the first touch portion 3310 that inputs the instruction to open the door 3100 does not blink. The first touch portion 3310 may be touched by a user in order to open the door 3100. In this instance, when the second detection sensor 3520 for detecting the opening and closing state of the individual door 3200 and the first detection sensor 3510 for detecting the opening and closing state of the door 3100 are all turned off, power is applied to the one or more motors 3431. In other words, when the second detection sensor 3520 and the first detection sensor 3510 are all turned off, the door 3100 and the individual door 3200 are all in the closed state, and therefore the assumption that it is possible to open the door 3100 is satisfied. On the other hand, when the second detection sensor 3520 or the first detection sensor 3510 is turned on, the individual door 3200 still remains opened, and therefore the second touch portion 3320 that inputs the instruction to open the individual door 3200 continues to blink. The blinking of the second touch portion 3320 is stopped when the individual door 3200 is closed. When the assumption that it is possible to open the door 3100 is satisfied, the lever switch 3435 is turned on, and the operation of the one or more motors 3431 stops. In this instance, a user may open the door 3100 by pulling the handle 9.

Figure 36:
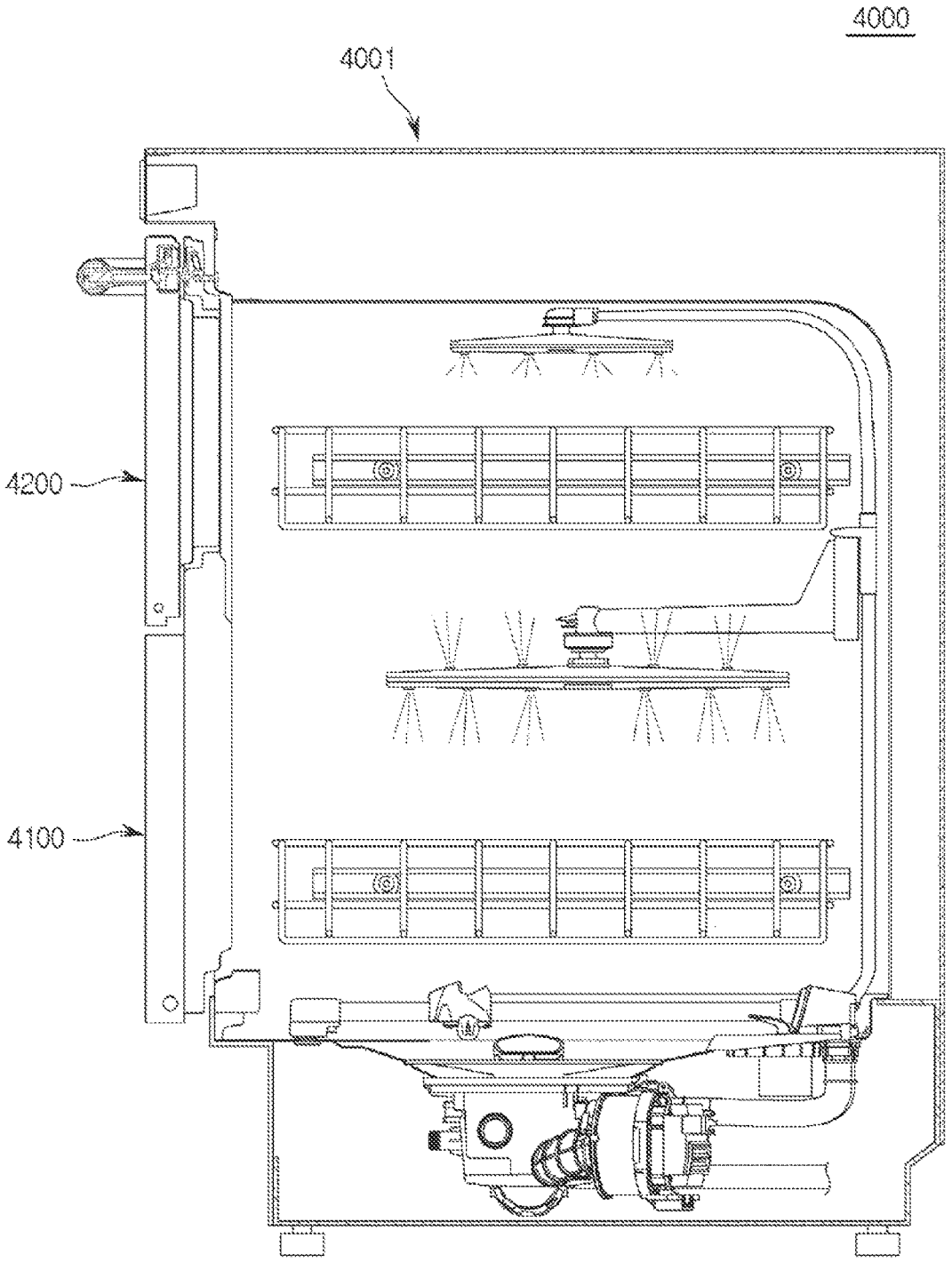
FIG. 36 illustrates a dishwasher to which first and second doors of an oven in accordance with an embodiment of the disclosure are applied.

FIG. 36 illustrates a dishwasher to which first and second doors of an oven in accordance with one embodiment of the disclosure are applied. Hereinafter, a first door may be used to indicate an individual door 4200, and a second door may be used to indicate a door 4100.

As illustrated in FIG. 36, the structures of the door 4100 and the individual door 4200 may be applicable to a dishwasher 4000 as well as the oven 1, 1000, 2000, and 3000. The door 4100 and the individual door 4200 may be provided on a front side of a casing 4001 that forms an appearance of the dishwasher 4000. Specifically, the door 4100 may be rotatably disposed in the casing 4001 of the dishwasher 4000, and the individual door 4200 may be rotatably disposed in the door 4100. The structures of the door 4100 and the individual door 4200 that can be applied to the dishwasher 4000 are be the same as those applied to the oven 1, 1000, 2000, and 3000, and thus, detailed description thereof will be omitted.

While various embodiments of the disclosure have been shown and described, it will be understood and appreciated by those skilled in the art that various changes in form and details may be made therein without departing from the spirit and scope of the disclosure as defined by the appended claims and their equivalents.

The invention claimed is:

1. An oven, comprising:

a casing having a front panel;

a cooking chamber provided inside the casing;

a door rotatably disposed in the casing so as to open and close the cooking chamber, and having a frame;

an individual door rotatably provided in the frame so as to open and close an opening provided in the frame;

an operation unit provided in at least one of the door and the individual door so that rotation of the door and the individual door is selectively adjusted; and a locking unit including a first locking unit detachably coupled to the operation unit and a second locking unit detachably coupled to the first locking unit, so that the cooking chamber is opened or closed by the individual door integrally with or separately from the door.

2. The oven according to claim 1, wherein the individual door has a separate rotational axis from that of the door.

3. The oven according to claim 1, wherein the individual door is provided on a front side of the opening, and a seating portion that protrudes forward is provided in the door so that the individual door is seated on the seating portion.

4. The oven according to claim 1, further comprising:

a handle provided on a front surface of at least one of the door and the individual door, wherein the operation unit is provided in the handle.

5. The oven according to claim 1, further comprising:

the locking unit that connects the door and the individual door so that the individual door is moved integrally with or separately from the door in accordance with an operation of the operation unit, wherein the locking unit includes a fastening groove provided on the front panel so that whether the door is opened and closed with respect to the cooking chamber is adjustable.

6. The oven according to claim 5, wherein the locking unit includes:

a rear holder provided inside the door, a rear link rotatably coupled to the rear holder, and a rear rotational axis that passes through the rear holder and the rear link and connects the rear holder and the rear link, and the rear link is moved about the rear rotational axis in a vertical direction.

7. The oven according to claim 6, wherein the rear link includes a hook that is detachably coupled to the fastening groove.

8. The oven according to claim 7, wherein the hook is detachably coupled to the fastening groove by a restoring force of an elastic member provided between a support and the hook, the support extending from the rear holder so that the support faces the hook in a vertical direction.

9. The oven according to claim 7, wherein the locking unit further includes:

a front holder provided inside the individual door, a front link that selectively transmits movement of the operation unit to the rear link, and is rotatably coupled to the front holder, and a front rotational axis that connects the front holder and the front link such that the front rotation axis passes through the front holder and the front link, and is disposed to be in parallel with the rear rotational axis, and wherein the front link is moved about the front rotational axis in a vertical direction.

10. The oven according to claim 9, wherein the rear link further includes a press portion that transmits movement of the front link to the hook, and the rear holder includes a coupling groove that is provided to face the front link.

11. The oven according to claim 10, wherein the front link includes a latch portion that is detachably coupled to the coupling groove in accordance with the movement of the operation unit, and the hook is separated from the fastening groove when the latch portion is coupled to the coupling groove while pressing the press portion positioned on an inner side of the coupling groove.

12. The oven according to claim 11, wherein the front link further includes a body having a convex portion that protrudes forward, and the operation unit includes:

a press member provided to be pressed by a user, and a pressure member rotatably coupled to the press member so that the pressure member selectively presses the convex portion in accordance with whether the press member is pressed.

13. The oven according to claim 12, wherein, when the user presses the press member, the pressuring member is rotated about a rotational axis that connects the press member and the pressure member to press the convex portion, and when the convex portion is pressurized, the latch portion is separated from the coupling groove.

14. An oven, comprising:

a casing having a front panel;

a cooking chamber provided inside the casing;

a plurality of doors provided to open and close at least a part of the cooking chamber, the plurality of doors including a first door provided to open and close a part of the cooking chamber, and a second door rotatably provided on the front panel so as to open and close the whole of the cooking chamber together with the first door;

an operation unit provided in at least one of the plurality of doors so that rotation of the plurality of doors is selectively adjusted; and a locking unit including a first locking unit detachably coupled to the operation unit and a second locking unit detachably coupled to the first locking unit, so that the cooking chamber is opened or closed by the first door integrally with or separately from the second door, wherein the second door includes a frame, and an opening that is provided in the frame and opened and closed by the first door.

15. The oven according to claim 14, wherein the first door is rotatably provided in the frame.

16. The oven according to claim 14, further comprising:

a handle provided on a front surface of at least one of the plurality of doors; and the operation unit provided in the handle so as to adjust opening and closing of the at least a part of the cooking chamber.

17. The oven according to claim 16, wherein the operation unit includes a press member provided on a rear surface of the handle so that the press member is pressed, the first door is configured to be rotated when a user pulls the handle toward a front side of the casing while the press member is pressed, and the first door and the second door are configured to be integrally rotated when the user pulls the handle toward the front side of the casing while the press member is not pressed.

18. An oven, comprising:

a casing having an opened front surface;

a cooking chamber provided inside the casing;

a plurality of doors rotatably provided on a front side of the casing so as to open and close at least a part of the cooking chamber, the plurality of doors including:

a first door provided so as to open and close a part of the cooking chamber, and a second door that opens and closes the whole of the cooking chamber together with the first door, and configured to be rotatable about a separate rotational axis parallel to a rotational axis of the first door;

an operation unit provided in at least one of the first door and the second door so that opening and closing of the first door are adjusted independently from or integrally with opening and closing of the second door; and a locking unit including a first locking unit detachably coupled to the operation unit and a second locking unit detachably coupled to the first locking unit, so that the cooking chamber is opened or closed by the first door integrally with or separately from the second door.

19. The oven according to claim 18, wherein the second door includes a frame and an opening provided in the frame, and the first door is provided in the frame so as to open and close the opening.

* * * * *